US010301746B2

(12) United States Patent
Diaz de Leon Izquierdo et al.

(10) Patent No.: US 10,301,746 B2
(45) Date of Patent: May 28, 2019

(54) MULTI-ZONE SPINNERET, APPARATUS AND METHOD FOR MAKING FILAMENTS AND NONWOVEN FABRICS THEREFROM

(71) Applicant: AVINTIV Specialty Materials Inc., Charlotte, NC (US)

(72) Inventors: Sergio Rafael Diaz de Leon Izquierdo, Huntersville, NC (US); Marcal Bargallo Alabart, La Selva del Camp (ES); John Arthur Street, Churchville, VA (US); John F. Steffen, Denver, NC (US); Ralph A. Moody, III, Mooresville, NC (US)

(73) Assignee: AVINTIV Specialty Materials, Inc., Charlotte, NC (US)

( * ) Notice: Subject to any disclaimer, the term of this patent is extended or adjusted under 35 U.S.C. 154(b) by 1202 days.

(21) Appl. No.: 13/652,740

(22) Filed: Oct. 16, 2012

(65) Prior Publication Data

US 2014/0103556 A1 Apr. 17, 2014

(51) Int. Cl.
*D01D 4/02* (2006.01)
*D01D 5/088* (2006.01)

(52) U.S. Cl.
CPC ..... *D01D 4/02* (2013.01); *D01D 4/025* (2013.01); *D01D 5/088* (2013.01)

(58) Field of Classification Search
CPC ..... D01D 4/02; D01D 5/08; D01D 5/082
See application file for complete search history.

(56) References Cited

U.S. PATENT DOCUMENTS 2,936,482 A 5/1960 Kilian
3,508,390 A 4/1970 Bagnall et al.
(Continued)

OTHER PUBLICATIONS

Extended European Search Report and Opinion of corresponding European Application No. 13 847 097.6 dated Apr. 3, 2016.
(Continued)

*Primary Examiner* — Galen H Hauth
(74) *Attorney, Agent, or Firm* — Burr Forman McNair LLP

(57) ABSTRACT

A spinneret, apparatus, and method are provided for making filaments for fibrous nonwoven fabrics with more uniform filament and fabric formation while minimizing filament breaks and hard spot defects in webs and fabrics made therefrom. The spinneret has a spinneret body that has an overall length to hydraulic diameter ratio and defines orifices that extend through the spinneret body, wherein the orifices comprise capillaries that open at a face of the spinneret body for polymer filament extrusion therefrom, wherein the capillaries are arranged in a plurality of different rows at the face of the spinneret body, and wherein the plurality of different rows are arranged into a plurality of different zones at the face of the spinneret body. A spinneret body of the spinneret can have an overall length to hydraulic ratio of at least 3 percent and/or a zone-to-zone length to hydraulic ratio of at least 2% and/or the hydraulic diameters, lengths, and length to hydraulic diameter ratios can progressively increase or decrease zone-to-zone for at least three different zones of capillaries, which can be applied to cross-flow quench or quench from a single-side. The spinneret body is designed to better accommodate differing operational proximity of the various different zones to quench air sources or source at commercially useful throughputs and fiber uniformity.

39 Claims, 10 Drawing Sheets

(56) References Cited

U.S. PATENT DOCUMENTS

| | | | | |
|---|---|---|---|---|
| 4,248,581 | A | 2/1981 | Harrison | |
| 4,283,364 | A * | 8/1981 | Capps | D01D 5/08 264/177.13 |
| 4,330,989 | A * | 5/1982 | Schmieder et al. | 57/227 |
| 4,332,764 | A | 6/1982 | Brayford et al. | |
| 4,383,817 | A | 5/1983 | Mirhej | |
| 4,391,618 | A | 7/1983 | Lecron et al. | |
| 4,398,933 | A | 8/1983 | Lecron et al. | |
| 4,514,350 | A | 4/1985 | Roth et al. | |
| 4,605,364 | A | 8/1986 | Roth et al. | |
| 5,256,050 | A | 10/1993 | Davies | |
| 5,266,255 | A | 11/1993 | Gibbon et al. | |
| 5,344,297 | A | 9/1994 | Hills | |
| 5,505,889 | A | 4/1996 | Davies | |
| 5,536,157 | A | 7/1996 | Linz | |
| 5,562,930 | A | 10/1996 | Hills | |
| 6,596,049 | B1 | 7/2003 | Berger | |
| 2008/0026659 | A1 * | 1/2008 | Brandner et al. | 442/327 |
| 2009/0318048 | A1 * | 12/2009 | Rebouillat et al. | 442/192 |

OTHER PUBLICATIONS

First Office Action of corresponding Chinese Application No. 20130054206.6 dated Jul. 25, 2016.
Second Office Action of corresponding Chinese Application No. 20130054206.6 dated Mar. 14, 2017.
Notification to Grant Patent Right for Invention of corresponding Chinese Application No. 20130054206.6 dated Jun. 23, 2017.

* cited by examiner

MULTI-ZONE SPINNERET, APPARATUS AND METHOD FOR MAKING FILAMENTS AND NONWOVEN FABRICS THEREFROM

FIELD OF INVENTION

The present invention relates to a spinneret, apparatus, and method for making filaments for fibrous nonwoven fabrics with more uniform filament and fabric formation while minimizing filament breaks and hard spot defects in webs and fabrics made therefrom.

BACKGROUND

In the melt-spinning of filaments from synthetic organic polymers, the polymer is extruded downwardly with the aid of a spinning pump or some other device through a plurality of orifices in a spinneret (or spinnerette) to form molten filaments. The extruded molten filaments are attenuated while passing through a quench zone where a stream of fluid, such as air, is passed across the path of the filaments to cool or solidify them. By application of a draw force the filaments are attenuated into finer filaments until their surface solidifies. When solidified the filaments can be deposited onto a collection surface to form a web. Beams used for melt-spinning polymeric filaments are typically provided with spinnerets that comprise capillaries that are uniformly spaced and have similar exit diameters as well as similar lengths throughout the entire array of capillaries in the spinneret. Several previous variations of these uniform designs of capillary layouts and capillary dimensions in spinnerets are discussed hereinbelow.

In U.S. Pat. No. 4,248,581 ("581 patent"), a process for determining the arrangement of orifices in a spinneret is disclosed. The '581 patent does not appear to disclose variations in any orifice dimensions other than the spacing between orifices.

In U.S. Pat. No. 4,514,350 ("350 patent"), spinnerets are shown which have "graduated orifice sizes" (GOS) that are used in manufacturing melt-spun filaments with good birefringence (i.e., molecular orientation) uniformity at high polymer extrusion rates. The '350 patent does not relate to providing changes in length to hydraulic diameter ratio in different groups of different shaped capillaries in the spinneret, nor changes in length to hydraulic diameter ratio for any two or more different adjacent groups of capillaries in the spinneret, nor indicate that these parameters may effect spinneret, filament, and fabric performance.

In U.S. Pat. No. 5,266,255 ("255 patent"), a process is shown for high stress spinning of polyethylene terephthalate yarns to produce a yarn of high birefringence by using a spinneret having at least one row of orifices with a diameter greater than an adjacent row of orifices. The '255 patent does not appear to disclose variations in any other orifice dimension than diameter.

In U.S. Pat. No. 5,112,550 ("550 patent"), a process and apparatus for producing superfine fibers is shown that uses a spinneret having nozzle orifices arranged in a lattice pattern extending toward a quench direction and the right angled direction to the quench direction with the arrangement being provided to satisfy certain formulae described therein. However, the '550 patent does not appear to disclose orifices (e.g., capillaries) that have different diameters or lengths, or different ratios thereof.

The present inventors have recognized that there is a need for a spinneret with a plurality of zones having various combinations of capillaries with various dimensions that can accommodate higher overall polymer throughputs and produce uniform filaments while minimizing filament breaks and nonwoven web and fabric hard spot defects.

SUMMARY

A spinneret for melt-spinning polymeric filaments is provided which includes a spinneret body having an overall length to hydraulic diameter ratio and defining orifices extending through the spinneret body, wherein the orifices comprise capillaries that open at a face of the spinneret body for polymer filament extrusion therefrom, wherein the capillaries are arranged in a plurality of different rows at the face of the spinneret body, and wherein the plurality of different rows are arranged into a plurality of different zones at the face of the spinneret body, wherein each of the plurality of different zones has a capillary density; and each of the capillaries in each of the plurality of zones has a particular capillary length, cross-sectional shape, hydraulic diameter and a length to hydraulic diameter ratio. The hydraulic diameter is a calculated value using a formula defined herein with reference made to a cross-sectional area and a perimeter of the cross-sectional shape of the capillary of a given zone. The spinneret bodies of the spinnerets of the present invention have at least three of the indicated zones at the face of the spinneret body. Spinneret bodies of the spinnerets of the present invention each have a plurality of zone-to-zone length to hydraulic diameter ratios. The spinnerets of the present invention can reduce frost line variation at commercial throughputs, which generally improve fiber and nonwoven fabric uniformity and may allow higher production throughput without increasing occurrence of defects like filament break and merged filaments which can cause defects in the fabric.

In one embodiment, the spinneret body of the spinneret of the present invention has an overall length to hydraulic diameter ratio of at least 3 percent, or even higher range values. In this embodiment, the spinneret body, provides a plurality of different capillary zones which have different relative proximities to the quench gas discharge outlet or outlets. The spinneret body is designed such that a plurality of the different zones, such as at least two, or three, or four, or five or more zones, have different length to hydraulic diameter ratios, such that the greatest difference between these various ratio values of all the zones is at least 3 percent or higher. This design can provide unexpectedly better fiber uniformity and performance by reducing frost line variation and problems associated therewith while providing enhanced or at least comparable commercial throughputs as spinneret bodies that use a single uniform design of capillaries throughout.

In another embodiment, the spinneret body has a plurality of zone-to-zone length to hydraulic diameter ratios; and at least one of the zone-to-zone length to hydraulic diameter ratios is at least 2 percent, or at least 3 percent, or even higher. In this embodiment, the spinneret body, provides a plurality of different capillary zones which have different relative proximities to the quench gas discharge outlet or outlets on an adjacent zone-to-zone basis. The spinneret body is designed such that a plurality of the various adjacent zones on the spinneret body have different length to hydraulic diameter ratios, such that the zone-to-zone difference between the ratio values of at least one, or two, or three, or four, or five, or more, of the adjacent zones is at least 2 percent. This design also can provide or enhance unexpectedly fiber and fabric uniformity and performance.

In another embodiment, the hydraulic diameters, lengths, and length to hydraulic diameter ratios of capillaries in different zones at the face of the spinneret body in spinnerets of the present invention progressively increase or decrease, such as zone-to-zone or at least in the same direction across the spinneret body, for at least three, or four, or five or more, different zones of capillaries depending on the relative proximity of the various different zones to the quench gas discharge outlet or outlets. This configuration can be used with single-side quench or cross-flow quench processing.

In another embodiment of the invention, the capillary density may be the same or may be different among the different zones. In an embodiment of the invention, when different zones are designed to be disposed along an axis oriented perpendicular to the direction of the stream of quench air towards the spinneret body, the zones located at the lateral sides of the spinneret body along this axis can have lower capillary density than the zone or zones located in between those two zones. This embodiment may be useful when the filaments produced by the zone or zones at the lateral sides of the face of the spinneret body of spinnerets of the present invention are impacted by wall effects as further defined herein. In another embodiment of the invention, when different zones are designed to be disposed along an axis oriented parallel to the direction of the stream of quench air towards the spinneret body, all the zones can have the same density of capillaries, such as where there are no wall effects (as described more fully herein) impacting the zones or the wall effects were compensated by other means.

In another embodiment of the invention, one or more of the at least three zones has a plurality of capillaries with a length, cross-sectional shape, hydraulic diameter and/or a length to hydraulic diameter ratio that varies from and is not substantially the same as the length, cross-sectional shape, hydraulic diameter, and/or length to hydraulic diameter ratio of a plurality of capillaries in at least one of the other zones. Generally, the length of each of the capillaries in one or more zones generally closer to the quench gas discharge outlet is longer than the capillary length of each of the plurality of capillaries that is located at the face of the spinneret body furthest away from the quench gas discharge outlet. Assuming the quench gas discharge outlet is located closer to the edges of the face of the spinneret body, the capillary lengths of the plurality of each of the capillaries in a zone near the center of the face of the spinneret body will tend to be shorter than the capillary lengths of each of the plurality of capillaries located in a zone at the edge of the face of the spinneret body. Generally, the hydraulic diameter (e.g., the diameter for a capillary having a circular shaped cross-section) of each of the plurality of capillaries located in a zone at the face of the spinneret body furthest away from a quench gas discharge outlet will be smaller than the hydraulic diameter of each of the plurality of capillaries located in a zone at the face of the spinneret body that is closer to the quench gas discharge outlet. In addition, the ratio of length to hydraulic diameter of each of the plurality of capillaries in a zone that is closer to the quench gas discharge outlet will tend to be larger than the length to hydraulic diameter ratio of each of the plurality of capillaries located in a zone that is further away from the quench gas discharge outlet. Generally, the capillary length and/or capillary hydraulic diameter can be selected for each zone in a way to minimize the difference in throughput between capillaries located in different zones.

In a preferred embodiment of the invention, the spinneret body of the spinneret has an overall length to hydraulic diameter ratio and has at least three zones with a first zone located centrally at the face of the spinneret body. The first zone having a plurality of first rows, and each of the first rows having a plurality of first capillaries, wherein the first capillaries are arranged in a first capillary density, and the first capillaries individually having a first cross-sectional shape, a first hydraulic diameter, a first length, and a first length to hydraulic diameter ratio. The second zone in this preferred embodiment of the invention, is located adjacent to the first zone at the face of the spinneret body, and has a plurality of second rows. Each of the second rows having a plurality of second capillaries, wherein the second capillaries are arranged in a second capillary density, and the second capillaries individually having a second cross-sectional shape, a second hydraulic diameter, a second length, and a second length to hydraulic diameter ratio. In this preferred embodiment of the invention, a third zone is located adjacent to the first zone at the face of the spinneret body, and includes a plurality of third rows, each of the third rows contains a plurality of third capillaries, wherein the third capillaries are arranged in a third capillary density, and the third capillaries each individually having a third cross-sectional shape, a third hydraulic diameter, a third length, and a third length to hydraulic diameter ratio. In this preferred embodiment, the first zone is located between the second and third zones, and the first zone is closer to a center of the face of the spinneret body than the second and third zones, and the overall length to hydraulic diameter ratio is at least 3 percent. In another embodiment of this spinneret, the spinneret body has an overall length to hydraulic ratio of at least 5 percent. In another embodiment of this spinneret, the spinneret body has a zone-to-zone hydraulic ratio of at least 2 percent.

In a more preferred embodiment of this invention, the first cross-sectional shape of each of the first capillaries and the second cross-sectional shape of each of the second capillaries and the third cross-sectional shape of each of the third capillaries are the same. In another preferred embodiment of this invention, the spinneret body includes at least one of (i) and (ii). Wherein (i) is the first hydraulic diameter of each of the first capillaries is less than the second hydraulic diameter of each of the second capillaries, and the first hydraulic diameter of each of the first capillaries is less than the third hydraulic diameter of each of the third capillaries; and (ii) is the first length of each of the first capillaries is less than the second length of each of the second capillaries, and the first length of each of the first capillaries is less than the third length of each of the third capillaries. In another preferred embodiment of the invention, the first length to hydraulic diameter ratio of each of the first capillaries is less than the second length to hydraulic diameter ratio of each of the second capillaries, and the first length to hydraulic diameter ratio of each of the first capillaries is less than the third length to hydraulic diameter ratio of each of the third capillaries. In another preferred embodiment of the invention, the second length to hydraulic diameter ratio of each of the second capillaries and the third length to hydraulic diameter ratio of each of the third capillaries are the same. In another preferred embodiment of the invention, the first cross-sectional shape of each of the first capillaries and the second cross-sectional shape of each of the second capillaries and the third cross-sectional shape of each of the third capillaries are circular or oval. In another preferred embodiment of the invention, the first cross-sectional shape of each of the first capillaries and the second cross-sectional shape of each of the second capillaries and the third cross-sectional shape of each of the third capillaries are not necessarily the same, but each is circular or oval. In another preferred embodiment of the invention, the sum of the capillaries that open at a face of the spinneret body is at least 3000. In another preferred embodiment of the invention, the face of the spinneret body is polygonal (e.g., rectangular, or polygonal shapes such as rectangular middle with trapezoidal ends, or other polygonal shapes).

In another preferred embodiment of this invention, the second zone is located at an end of the face of the spinneret body, and the third zone is located at an end of the face of the spinneret body opposite to the end at which the second zone is located, wherein the three zones are disposed in a linear arrangement oriented perpendicular to the direction of the flow of quenching air. In a further embodiment of this spinneret, the first capillary density is greater than each of the second capillary density and the third capillary density.

As another option, the spinneret can include at least four different types of capillary zones including a central zone having a first type of capillaries located centrally at the face of the spinneret body that is located between a pair of inner side zones having a second type of capillaries and a pair of outer side zones having a third type of capillaries. The third, second, and first types of capillary hydraulic diameters and lengths can progressively decrease in the direction extending from the outer side zones located nearer to an outer edge of the spinneret body towards the first zone located at the center of the spinneret body. As an option, the indicated zones of the first, second, and third types of capillaries can be positioned between a pair of end zones having a fourth type of capillaries. The capillary hydraulic diameters and lengths of these different capillary zones can progressively decrease from the fourth, to the third, to the second, to the first types of capillaries.

In a more preferred embodiment of the invention, the spinneret has at least five zones at the face of the spinneret body. In addition to the first three zones generally described above, the spinneret body includes a fourth zone having a plurality of fourth rows, each of said fourth rows comprising a plurality of fourth capillaries, wherein the fourth capillaries are arranged in a fourth capillary density, and the fourth capillaries individually having a fourth cross-sectional shape, a fourth hydraulic diameter, a fourth length, and a fourth length to hydraulic diameter ratio. The spinneret body of this preferred embodiment also has a fifth zone having a plurality of fifth rows, and each of said fifth rows having a plurality of fifth capillaries, wherein the fifth capillaries are arranged in a fifth capillary density and the fifth capillaries individually have a fifth cross-sectional shape, a fifth hydraulic diameter, a fifth length, and a fifth length to hydraulic diameter ratio; wherein the first zone is located between the fourth and fifth zones, and wherein the fourth cross-sectional shape of each of the fourth capillaries and the fifth cross-sectional shape of each of the fifth capillaries are the same as the first cross-sectional shape of each of the first capillaries and the second cross-sectional shape of each of the second capillaries and the third cross-sectional shape of each of the third capillaries, and wherein the fourth hydraulic diameter of each of the fourth capillaries and the fifth hydraulic diameter of each of the fifth capillaries are less than the second hydraulic diameter of each of the second capillaries and are less than the third hydraulic diameter of each of the third capillaries; and the first hydraulic diameter of each of the first capillaries is less than the fourth hydraulic diameter of each of the fourth capillaries, and the first hydraulic diameter of each of the first capillaries is less than the fifth hydraulic diameter of each of the fifth capillaries; and wherein the fourth length of each of the fourth capillaries and the fifth length of each of the fifth capillaries are less than the second length of each of the second capillaries and the third length of each of the third capillaries; and the first length of each of the first capillaries is less than the fourth length of each of the fourth capillaries, and the first length of each of the first capillaries is less than the fifth length of each of the fifth capillaries. In another preferred embodiment, the first capillary density, the fourth capillary density, and the fifth capillary density are the same. In another preferred embodiment of this invention, the first length to hydraulic diameter ratio of each of the first capillaries is less than the fourth length to hydraulic diameter ratio of each of the fourth capillaries, and the first length to hydraulic diameter ratio of each of the first capillaries is less than the fifth length to hydraulic diameter ratio of each of the fifth capillaries.

In another preferred embodiment of the invention, there are at least seven zones at the face of the spinneret body in the spinneret. There are the five zones mentioned above, and at least two additional zones as follows. There is a sixth zone having a plurality of sixth rows, each of said sixth rows comprising a plurality of sixth capillaries, wherein the sixth capillaries are arranged in a sixth capillary density, and each of the sixth capillaries individually having a sixth cross-sectional shape, a sixth hydraulic diameter, a sixth length, and a sixth length to hydraulic diameter ratio. In this preferred embodiment, the seventh zone has a plurality of seventh rows, each of said seventh rows having a plurality of seventh capillaries, wherein the seventh capillaries are arranged in a seventh capillary density, and the seventh capillaries individually having a seventh cross-sectional shape, a seventh hydraulic diameter, a seventh length, and a seventh length to hydraulic diameter ratio; wherein the first, fourth, and fifth zones are located between the sixth and seventh zones, and wherein the sixth cross-sectional shape of each of the sixth capillaries and the seventh cross-sectional shape of each of the seventh capillaries are the same as the first cross-sectional shape of each of the first capillaries, the second cross-sectional shape of each of the second capillaries, the third cross-sectional shape of each of the third capillaries, the fourth cross-sectional shape of each of the fourth capillaries, and the fifth cross-sectional shape of each of the fifth capillaries; wherein the sixth hydraulic diameter of each of the sixth capillaries and the seventh hydraulic diameter of each of the seventh capillaries are less than the second hydraulic diameter of each of the second capillaries and the third hydraulic diameter of each of the third capillaries; and the fourth hydraulic diameter of each of the fourth capillaries and the fifth hydraulic diameter of each of the fifth capillaries are less than the sixth hydraulic diameter of each of the sixth capillaries and less than the seventh hydraulic diameter of each of the seventh capillaries; and wherein the sixth length of each of the sixth capillaries and the seventh length of each of the seventh capillaries are less than the second length of each of the second capillaries and the third length of each of the third capillaries; and the fourth length of each of the fourth capillaries and the fifth length of each of the fifth capillaries are less than the sixth length of each of the sixth capillaries and are less than the seventh length of each of the seventh capillaries.

In a further more preferred embodiment, the first capillary density, the fourth capillary density, the fifth capillary density, the sixth capillary density, and the seventh capillary density are the same. In addition, in another further preferred embodiment of this invention, the fourth length to hydraulic diameter ratio of each of the fourth capillaries and the fifth length to hydraulic diameter ratio of each of the fifth capillaries are respectively less than the sixth length to hydraulic diameter ratio of each of the sixth capillaries and the seventh length to hydraulic diameter ratio of each of the seventh capillaries. In other words, in this embodiment, both of the fourth and fifth length to hydraulic diameter ratios of each of the fourth and fifth capillaries are less than the sixth and seventh length to hydraulic diameter ratios of each of the sixth and seventh capillaries.

In another preferred embodiment of this invention, a spinneret for melt-spinning polymeric filaments has a spinneret body having an overall length to hydraulic diameter ratio and defining orifices extending through the spinneret body, wherein the orifices comprise capillaries that open at a face of the spinneret body for polymer filament extrusion therefrom, wherein the capillaries are arranged in a plurality of different rows at the face of the spinneret body, and wherein the plurality of different rows are arranged into a plurality of different zones at the face of the spinneret body, wherein the plurality of different zones has at least a first zone, second zone, and a third zone. The first zone in this preferred embodiment is located centrally at the face of the spinneret body, and comprises a plurality of first rows, each of said first rows comprising a plurality of first capillaries, wherein the first capillaries are arranged in a first capillary density, and the first capillaries individually having a first cross-sectional shape, a first hydraulic diameter, a first length, and a first length to hydraulic diameter ratio. The second zone in this preferred embodiment is located adjacent to the first zone at the face of the spinneret body, and comprises a plurality of second rows, each of said second rows comprising a plurality of second capillaries, wherein the second capillaries are arranged in a second capillary density, and the second capillaries individually having a second cross-sectional shape, a second hydraulic diameter, a second length, and a second length to hydraulic diameter ratio. The third zone in this preferred embodiment is located adjacent to the first zone at the face of the spinneret body, and comprises a plurality of third rows, each of said third rows comprising a plurality of third capillaries, wherein the third capillaries are arranged in a third capillary density, and the third capillaries individually having a third cross-sectional shape, a third hydraulic diameter, a third length, and a third length to hydraulic diameter ratio. In this preferred embodiment, the first zone is located between the second and third zones, and the first zone is closer to a center of the face of the spinneret body than the second and third zones. Also, in this preferred embodiment, the first cross-sectional shape of each of the first capillaries and the second cross-sectional shape of each of the second capillaries and the third cross-sectional shape of each of the third capillaries are the same, wherein the first hydraulic diameter of each of the first capillaries is less than the second hydraulic diameter of each of the second capillaries, and the first hydraulic diameter of each of the first capillaries is less than the third hydraulic diameter of each of the third capillaries, and the first length of each of the first capillaries is less than the second length of each of the second capillaries, and the first length of each of the first capillaries is less than the third length of each of the third capillaries. In a more preferred embodiment, the first length to hydraulic diameter ratio of each of the first capillaries is less than the second length to hydraulic diameter ratio of each of the second capillaries, and the first length to hydraulic diameter ratio of each of the first capillaries is less than the third length to hydraulic diameter ratio of each of the third capillaries. In addition, the first capillary density and second capillary density and the third capillary density in this more preferred embodiment can be the same. Further, in a preferred embodiment, the face of the spinneret body can be polygonal, such as rectangular.

In addition to at least the first three zones mentioned above of a preferred embodiment, a spinneret body can more preferably have the following additional zones. In this more preferred embodiment, the face of the spinneret body further can have fourth and fifth zones, wherein the fourth zone comprising a plurality of fourth rows, each of said fourth rows comprising a plurality of fourth capillaries, wherein the fourth capillaries are arranged in a fourth capillary density, and the fourth capillaries individually having a fourth cross-sectional shape, a fourth hydraulic diameter, a fourth length, and a fourth length to hydraulic diameter ratio; and the fifth zone comprising a plurality of fifth rows, each of said fifth rows comprising a plurality of fifth capillaries, wherein the fifth capillaries are arranged in a fifth capillary density and the fifth capillaries individually having a fifth cross-sectional shape, a fifth hydraulic diameter, a fifth length, and a fifth length to hydraulic diameter ratio. In this more preferred embodiment, the first zone, second zone, and third zone are located between the fourth zone and fifth zone, wherein the fourth cross-sectional shape of each of the fourth capillaries and the fifth cross-sectional shape of each of the fifth capillaries are the same as the first cross-sectional shape of each of the first capillaries and the second cross-sectional shape of each of the second capillaries and the third cross-sectional shape of each of the third capillaries. Also, in this more preferred embodiment, the second hydraulic diameter of each of the second capillaries and the third hydraulic diameter of each of the third capillaries are less than the fourth hydraulic diameter of each of the fourth capillaries and the fifth hydraulic diameter of each of the fifth capillaries, and the second length of each of the second capillaries and the third length of each of the third capillaries are less than the fourth length of each of the fourth capillaries and the fifth length of each of the fifth capillaries. In other words, in this embodiment, both the second and third hydraulic diameters of each of the second and third capillaries, respectively, are less than both the fourth and fifth hydraulic diameters of each of the fourth and fifth capillaries, respectively. In addition, in this embodiment, both the second and third lengths of each of the second and third capillaries, respectively, are less than the fourth and fifth lengths of each of the fourth and fifth capillaries, respectively.

In addition to the more preferred embodiment of this invention with at least five zones, the spinneret can have the second length to hydraulic diameter ratio of each of the second capillaries and the third length to hydraulic diameter ratio of each of the third capillaries that are less than the fourth length to hydraulic diameter ratio of each of the fourth capillaries and the fifth length to hydraulic diameter ratio of each of the fifth capillaries. Furthermore, in this more preferred embodiment, the first capillary density, the second capillary density, the third capillary density, the fourth capillary density, and the fifth capillary density can be the same. Furthermore, in spinnerets of the present invention, the capillary density and dimensions of capillaries in each zone of capillaries can be selected to produce an equal and targeted polymer throughput among the different zones of capillaries based on the equation for shear stress calculated for a given polymer processed at a given set of process conditions.

In another preferred embodiment of this invention, a spinneret for melt-spinning polymeric filaments has a spinneret body having an overall length to hydraulic diameter ratio and defining orifices extending through the spinneret body, wherein the orifices comprise capillaries that open at a face of the spinneret body for polymer filament extrusion therefrom, wherein the capillaries are arranged in a plurality of different rows at the face of the spinneret body, and wherein the plurality of different rows are arranged into a plurality of different zones at the face of the spinneret body, wherein the plurality of different zones has at least a first zone, second zone, and a third zone. The first zone in this preferred embodiment is located centrally at the face of the spinneret body, and comprises a plurality of first rows, each of said first rows comprising a plurality of first capillaries, wherein the first capillaries are arranged in a first capillary density, and the first capillaries individually having a first cross-sectional shape, a first hydraulic diameter, a first length, and a first length to hydraulic diameter ratio. The second zone in this preferred embodiment is located adjacent to the first zone at the face of the spinneret body, and comprises a plurality of second rows, each of said second rows comprising a plurality of second capillaries, wherein the second capillaries are arranged in a second capillary density, and the second capillaries individually having a second cross-sectional shape, a second hydraulic diameter, a second length, and a second length to hydraulic diameter ratio. The third zone in this preferred embodiment is located adjacent to the first zone at the face of the spinneret body, and comprises a plurality of third rows, each of said third rows comprising a plurality of third capillaries, wherein the third capillaries are arranged in a third capillary density, and the third capillaries individually having a third cross-sectional shape, a third hydraulic diameter, a third length, and a third length to hydraulic diameter ratio. Also, in this preferred embodiment, the first zone is located between the second and third zones, wherein the third hydraulic diameter of each of the third capillaries is less than the first hydraulic diameter of each of the first capillaries, and the first hydraulic diameter of each of the first capillaries is less than the second hydraulic diameter of each of the second capillaries, and the third length of each of the third capillaries is less than the first length of each of the first capillaries, and the first length of each of the first capillaries is less than the second length of each of the second capillaries, and the third length to hydraulic diameter ratio of each of the third capillaries is less than the first length to hydraulic diameter ratio of each of the first capillaries, and the first length to hydraulic diameter ratio of each of the first capillaries is less than the second length to hydraulic diameter ratio of each of the second capillaries. In a further embodiment, the overall length to hydraulic diameter ratio can be at least 3%. In a further embodiment, the face of the spinneret body can be annular. In a further embodiment, the spinneret body has a plurality of zone-to-zone length to hydraulic diameter ratios, and at least one of said zone-to-zone length to hydraulic diameter ratios is at least 2%. In addition, in a further embodiment of the spinneret, the first, second, and third capillary densities are the same.

These various features of the spinneret of the invention can allow more uniform quenching of the filaments at higher line speeds and polymer throughputs while minimizing variability in polymer throughput through the capillaries and enhancing filament uniformity than when a single zone design of capillaries is used in the spinneret or than when only one of the capillary dimensions varies and is not substantially the same from zone to zone. This type of controlled filament extrusion allows more polymer to be extruded through the capillaries at higher throughputs with more uniform filament and nonwoven web and fabric formation while minimizing the filament breaks and nonwoven web and fabric hard spot defects.

As another option, an apparatus is provided for producing a melt-spun nonwoven web that is useful in a nonwoven fabric, and the apparatus includes a polymer supply system; a collection surface; the indicated spinneret located above the collection surface for extruding polymer received from the polymer supply system for producing extruded filaments that move downward along a path toward the collection surface; at least one quench gas supply device for supplying at least one stream of cooling gas; a cooling region below the spinneret in which the at least one stream of cooling gas is directed to flow beneath the spinneret and across extruded filaments. In an embodiment of this apparatus, a cooling region arranged below the spinneret has streams of cooling gas directed to cross-flow from opposite directions beneath the spinneret and across extruded filaments along the path toward the collection surface. In another embodiment of this apparatus, a cooling region arranged below the spinneret has a stream of cooling gas directed to flow from a single direction beneath the spinneret and across extruded filaments. Preferably, there is a means to apply a force on the filaments that is located between the cooling region and the collection surface and that force causing the filaments to be attenuated while still in the molten state.

In one embodiment of this invention, an apparatus for producing a melt-spun nonwoven web includes: a) a polymer supply system; b) a filament collection surface; c) a spinneret located above the collection surface for extruding polymer received from the polymer supply system for producing extruded filaments that move downward along a path toward the collection surface; d) at least one quench gas supply device for supplying at least one stream of cooling gas; and e) a cooling region below the spinneret in which the at least one stream of the cooling gas is directed to flow beneath the spinneret and across extruded filaments along the path toward the collection surface. In this embodiment, the spinneret includes: a spinneret body having an overall length to hydraulic diameter ratio and defining orifices extending through the spinneret body, wherein the orifices comprise capillaries that open at a face of the spinneret body for polymer filament extrusion therefrom, wherein the capillaries are arranged in a plurality of different rows at the face of the spinneret body, and wherein the plurality of different rows are arranged into a plurality of different zones at the face of the spinneret body. In this embodiment, the plurality of different zones comprises: a first zone located centrally at the face of the spinneret body, comprising a plurality of first rows, each of said first rows comprising a plurality of first capillaries, wherein the first capillaries are arranged in a first capillary density, and the first capillaries individually having a first cross-sectional shape, a first hydraulic diameter, a first length, and a first length to hydraulic diameter ratio; a second zone located adjacent to the first zone at the face of the spinneret body, comprising a plurality of second rows, each of said second rows comprising a plurality of second capillaries, wherein the second capillaries are arranged in a second capillary density, and the second capillaries individually having a second cross-sectional shape, a second hydraulic diameter, a second length, and a second length to hydraulic diameter ratio; and a third zone located adjacent to the first zone at the face of the spinneret body, comprising a plurality of third rows, each of said third rows comprising a plurality of third capillaries, wherein the third capillaries are arranged in a third capillary density and the third capillaries individually having a third cross-sectional shape, a third hydraulic diameter, a third length, and a third length to hydraulic diameter ratio. In this embodiment, the first zone is located between the second and third zones, and the first zone is closer to a center of the face of the spinneret body than the second and third zones, wherein the overall length to hydraulic diameter ratio is at least 3 percent. In another embodiment of this apparatus, the spinneret body has an overall length to hydraulic ratio of at least 5 percent. In a further embodiment of this apparatus, the spinneret body has a plurality of zone-to-zone length to hydraulic diameter ratios, and wherein at least one of the zone-to-zone length to hydraulic diameter ratios is at least 2%. In another embodiment of this apparatus, the first capillary density can be greater than each of the second capillary density and the third capillary density and the three zones are disposed in a linear arrangement oriented perpendicular to the direction of the flow(s) of cooling gas (e.g., quenching air).

In a further embodiment of this apparatus, the first cross-sectional shape of each of the first capillaries and the second cross-sectional shape of each of the second capillaries and the third cross-sectional shape of each of the third capillaries are the same. In another preferred embodiment of this apparatus, the sum of the capillaries that open at a face of the spinneret body is at least 3000. In another preferred embodiment of this apparatus, the face of the spinneret body is polygonal, such as rectangular.

In another embodiment of this apparatus, the spinneret body includes at least one of (i) and (ii). Wherein (i) is the first hydraulic diameter of each of the first capillaries is less than the second hydraulic diameter of each of the second capillaries, and the first hydraulic diameter of each of the first capillaries is less than the third hydraulic diameter of each of the third capillaries; and (ii) is the first length of each of the first capillaries is less than the second length of each of the second capillaries, and the first length of each of the first capillaries is less than the third length of each of the third capillaries.

In yet another embodiment of this apparatus, the first length to hydraulic diameter ratio of each of the first capillaries is less than the second length to hydraulic diameter ratio of each of the second capillaries, and the first length to hydraulic diameter ratio of each of the first capillaries is less than the third length to hydraulic diameter ration of each of the third capillaries. Further, the second length to hydraulic diameter ratio of each of the second capillaries and the third length to hydraulic diameter ratio of each of the third capillaries can be the same.

A further embodiment of this apparatus includes a spinneret having the first cross-sectional shape of each of the first capillaries and the second cross-sectional shape of each of the second capillaries and the third cross-sectional shape of each of the third capillaries are circular or oval. Another embodiment of this invention includes the first cross-sectional shape of each of the first capillaries and the second cross-sectional shape of each of the second capillaries and the third cross-sectional shape of each of the third capillaries being circular or oval, and the second zone can be located at an end of the face of the spinneret body, and the third zone can be located at an end of the face of the spinneret body opposite to the end at which the second zone is located, wherein the three zones are disposed in a linear arrangement oriented perpendicular to the direction of the flow(s) of cooling gas (e.g., quenching air).

An even further embodiment of the apparatus of this invention can also include a spinneret having in addition to the first three zones described above a fourth zone containing a plurality of fourth rows, each of said fourth rows comprising a plurality of fourth capillaries, wherein the fourth capillaries are arranged in a fourth capillary density, and the fourth capillaries individually having a fourth cross-sectional shape, a fourth hydraulic diameter, a fourth length, and a fourth length to hydraulic diameter ratio, and a fifth zone comprising a plurality of fifth rows, each of said fifth rows having a plurality of fifth capillaries, wherein the fifth capillaries are arranged in a fifth capillary density, and the fifth capillaries individually having a fifth cross-sectional shape, a fifth hydraulic diameter, a fifth length, and a fifth length to hydraulic diameter ratio, wherein the first zone is located between the fourth and fifth zones. In this even further embodiment of the apparatus of the present invention, the fourth cross-sectional shape of each of the fourth capillaries and the fifth cross-sectional shape of each of the fifth capillaries are the same as the first cross-sectional shape of each of the first capillaries and the second cross-sectional shape of each of the second capillaries and the third cross-sectional shape of each of the third capillaries, wherein the fourth hydraulic diameter of each of the fourth capillaries and the fifth hydraulic diameter of each of the fifth capillaries are less than the second hydraulic diameter of each of the second capillaries and are less than the third hydraulic diameter of each of the third capillaries; and wherein the first hydraulic diameter of each of the first capillaries is less than the fourth hydraulic diameter of each of the fourth capillaries, and the first hydraulic diameter of each of the first capillaries is less than the fifth hydraulic diameter of each of the fifth capillaries; and wherein the fourth length of each of the fourth capillaries and the fifth length of each of the fifth capillaries are less than the second length of each of the second capillaries and the third length of each of the third capillaries; and wherein the first length of each of the first capillaries is less than the fourth length of each of the fourth capillaries, and the first length of each of the first capillaries is less than the fifth length of each of the fifth capillaries.

An apparatus in an additional embodiment of this invention can also have a spinneret having at least seven zones, wherein, in addition to the above indicated five zones, sixth and seventh zones also can be included. In this additional embodiment of the apparatus, the sixth zone includes a plurality of sixth rows, each of said sixth rows having a plurality of sixth capillaries, wherein the sixth capillaries are arranged in a sixth capillary density, and the sixth capillaries individually having a sixth cross-sectional shape, a sixth hydraulic diameter, a sixth length, and a sixth length to hydraulic diameter ratio, and wherein the seventh zone has a plurality of seventh rows, each of said seventh rows comprising a plurality of seventh capillaries, wherein the seventh capillaries are arranged in a seventh capillary density and the seventh capillaries individually having a seventh cross-sectional shape, a seventh hydraulic diameter, a seventh length, and a seventh length to hydraulic diameter ratio; and wherein the first, fourth, and fifth zones are located between the sixth and seventh zones, and wherein the sixth cross-sectional shape of each of the sixth capillaries and the seventh cross-sectional shape of each of the seventh capillaries are the same as the first cross-sectional shape of each of the first capillaries, the second cross-sectional shape of each of the second capillaries, the third cross-sectional shape of each of the third capillaries, the fourth cross-sectional shape of each of the fourth capillaries, and the fifth cross-sectional shape of each of the fifth capillaries; and wherein the sixth hydraulic diameter of each of the sixth capillaries and the seventh hydraulic diameter of each of the seventh capillaries are less than the second hydraulic diameter of each of the second capillaries and the third hydraulic diameter of each of the third capillaries, and wherein the fourth hydraulic diameter of each of the fourth capillaries and the fifth hydraulic diameter of each of the fifth capillaries are less than the sixth hydraulic diameter of each of the sixth capillaries and less than the seventh hydraulic diameter of each of the seventh capillaries; and wherein the sixth length of each of the sixth capillaries and the seventh length of each of the seventh capillaries are less than the second length of each of the second capillaries and the third length of each of the third capillaries, and wherein the fourth length of each of the fourth capillaries and the fifth length of each of the fifth capillaries are less than the sixth length of each of the sixth capillaries and are less than the seventh length of each of the seventh capillaries.

The apparatus of this invention can also have a spinneret having the above described first capillary density, the fourth capillary density, the fifth capillary density, the sixth capillary density, and the seventh capillary density be the same. The apparatus of this invention can also have a spinneret having the above described fourth length to hydraulic diameter ratio of each of the fourth capillaries and the fifth length to hydraulic diameter ratio of each of the fifth capillaries be less than the sixth length to hydraulic diameter ratio of each of the sixth capillaries and the seventh length to hydraulic diameter ratio of each of the seventh capillaries.

In another embodiment of the present invention, an apparatus for producing a melt-spun nonwoven web includes: a) a polymer supply system; b) a filament collection surface; c) a spinneret located above the collection surface for extruding polymer received from the polymer supply system for producing extruded filaments that move downward along a path toward the collection surface; d) at least one quench gas supply device for supplying at least one stream of cooling gas; and e) a cooling region below the spinneret in which the at least one stream of cooling gas is directed to flow beneath the spinneret and across extruded filaments along the path toward the collection surface. In this embodiment, the spinneret includes: a spinneret body having an overall length to hydraulic diameter ratio and defining orifices extending through the spinneret body, wherein the orifices comprise capillaries that open at a face of the spinneret body for polymer filament extrusion therefrom, wherein the capillaries are arranged in a plurality of different rows at the face of the spinneret body, and wherein the plurality of different rows are arranged into a plurality of different zones at the face of the spinneret body. In this embodiment, the plurality of different zones comprises: a first zone located centrally at the face of the spinneret body, comprising a plurality of first rows, each of said first rows comprising a plurality of first capillaries, wherein the first capillaries are arranged in a first capillary density, and the first capillaries individually having a first cross-sectional shape, a first hydraulic diameter, a first length, and a first length to hydraulic diameter ratio; a second zone located adjacent to the first zone at the face of the spinneret body, comprising a plurality of second rows, each of said second rows comprising a plurality of second capillaries, wherein the second capillaries are arranged in a second capillary density, and the second capillaries individually having a second cross-sectional shape, a second hydraulic diameter, a second length, and a second length to hydraulic diameter ratio; and a third zone located adjacent to the first zone at the face of the spinneret body, comprising a plurality of third rows, each of said third rows comprising a plurality of third capillaries, wherein the third capillaries are arranged in a third capillary density and the third capillaries individually having a third cross-sectional shape, a third hydraulic diameter, a third length, and a third length to hydraulic diameter ratio. In this embodiment, the first zone is located between the second and third zones, wherein the third hydraulic diameter of each of the third capillaries is less than the first hydraulic diameter of each of the first capillaries, the first hydraulic diameter of each of the first capillaries is less than the second hydraulic diameter of each of the second capillaries, the third length of each of the third capillaries is less than the first length of each of the first capillaries, the first length of each of the first capillaries is less than the second length of each of the second capillaries, the third length to hydraulic diameter ratio of each of the third capillaries is less than the first length to hydraulic diameter ratio of each of the first capillaries, and the first length to hydraulic diameter ratio of each of the first capillaries is less than the second length to hydraulic diameter ratio of each of the second capillaries.

As another embodiment, a process for melt-spinning polymeric filaments is provided which includes steps of extruding molten polymer through an indicated spinneret to produce filaments extruded below the spinneret; passing the extruded filaments through a quench zone below the spinneret, wherein said filaments are quenched by directing a flow of at least one stream of cooling gas beneath the spinneret and across the extruded filaments; and collecting the filaments after the quenching thereof.

In an embodiment of the invention, a process for melt-spinning polymeric filaments, includes: a) extruding molten polymer through a spinneret to produce filaments extruded below the spinneret; b) passing the extruded filaments through a quench region below the spinneret, wherein said filaments are quenched by directing at least one stream of cooling gas beneath the spinneret and across the extruded filaments; and c) collecting the quenched filaments. In this embodiment of a process of the invention, the spinneret includes: a spinneret body having an overall length to hydraulic diameter ratio and defining orifices extending through the spinneret body, wherein the orifices comprise capillaries that open at a face of the spinneret body for polymer filament extrusion therefrom, wherein the capillaries are arranged in a plurality of different rows at the face of the spinneret body, and wherein the plurality of different rows are arranged into a plurality of different zones at the face of the spinneret body, wherein the plurality of different zones comprises: a first zone located centrally at the face of the spinneret body, comprising a plurality of first rows, each of said first rows comprising a plurality of first capillaries, wherein the first capillaries are arranged in a first capillary density, and the first capillaries individually having a first cross-sectional shape, a first hydraulic diameter, a first length, and a first length to hydraulic diameter ratio, a second zone located adjacent to the first zone at the face of the spinneret body, comprising a plurality of second rows, each of said second rows comprising a plurality of second capillaries, wherein the second capillaries are arranged in a second capillary density, and the second capillaries individually having a second cross-sectional shape, a second hydraulic diameter, a second length, and a second length to hydraulic diameter ratio, a third zone located adjacent to the first zone at the face of the spinneret body, comprising a plurality of third rows, each of said third rows comprising a plurality of third capillaries, wherein the third capillaries are arranged in a third capillary density and the third capillaries individually having a third cross-sectional shape, a third hydraulic diameter, a third length, and a third length to hydraulic diameter ratio; wherein the first zone is located between the second and third zones, and the first zone is closer to a center of the face of the spinneret body than the second and third zones, wherein the overall length to hydraulic diameter ratio is at least 3 percent. In another embodiment of this process, the overall length to hydraulic ratio is at least 5 percent. In another embodiment of this process, the spinneret body has a plurality of zone-to-zone length to hydraulic diameter ratios, and wherein at least one of the zone-to-zone length to hydraulic diameter ratios is at least 2%. In another embodiment of this process, the passing of the extruded filaments through the quench region below the spinneret comprises quenching the filaments by directing the at least one stream of cooling gas in cross-flowing directions beneath the spinneret and across the extruded filaments. In another preferred embodiment of this process, the sum of the capillaries that open at a face of the spinneret body is at least 3000. In another preferred embodiment of this process, the face of the spinneret body is polygonal, such as rectangular or trapezoidal.

A process of this invention can also include a spinneret having at least five zones, wherein fourth and fifth zones are added to the first three zones as described above. In this embodiment of the process of the invention, the fourth zone comprises a plurality of fourth rows, each of said fourth rows comprising a plurality of fourth capillaries, wherein the fourth capillaries are arranged in a fourth capillary density, and the fourth capillaries individually having a fourth cross-sectional shape, a fourth hydraulic diameter, a fourth length, and a fourth length to hydraulic diameter ratio, and the fifth zone comprises a plurality of fifth rows, each of said fifth rows comprising a plurality of fifth capillaries, wherein the fifth capillaries are arranged in a fifth capillary density and the fifth capillaries individually having a fifth cross-sectional shape, a fifth hydraulic diameter, a fifth length, and a fifth length to hydraulic diameter ratio; wherein the first zone is located between the fourth and fifth zones, and wherein the fourth hydraulic diameter of each of the fourth capillaries and the fifth hydraulic diameter of each of the fifth capillaries are less than the second hydraulic diameter of each of the second capillaries and are less than the third hydraulic diameter of each of the third capillaries; and the first hydraulic diameter of each of the first capillaries is less than the fourth hydraulic diameter of each of the fourth capillaries, and the first hydraulic diameter of each of the first capillaries is less than the fifth hydraulic diameter of each of the fifth capillaries; and wherein the fourth length of each of the fourth capillaries and the fifth length of each of the fifth capillaries are less than the second length of each of the second capillaries and the third length of each of the third capillaries; and the first length of each of the first capillaries is less than the fourth length of each of the fourth capillaries, and the first length of each of the first capillaries is less than the fifth length of each of the fifth capillaries. In another embodiment of the process of this invention, the spinneret can have the first cross-sectional shape of each of the first capillaries, the second cross-sectional shape of each of the second capillaries, and the third cross-sectional shape of each of the third capillaries all be circular or all oval, and wherein the extruded filaments from each of said first capillaries, second capillaries, and third capillaries have cross-sectional shapes that correspond to each of said capillaries.

In an embodiment of the invention, a process for melt-spinning polymeric filaments, includes: a) extruding molten polymer through a spinneret to produce filaments extruded below the spinneret; b) passing the extruded filaments through a quench region below the spinneret, wherein said filaments are quenched by directing at least one stream of cooling gas in one direction free of opposite flowing cooling gas beneath the spinneret and across the extruded filaments; and c) collecting the quenched filaments. In this embodiment of a process of the invention, the spinneret includes: a spinneret body having an overall length to hydraulic diameter ratio and defining orifices extending through the spinneret body, wherein the orifices comprise capillaries that open at a face of the spinneret body for polymer filament extrusion therefrom, wherein the capillaries are arranged in a plurality of different rows at the face of the spinneret body, and wherein the plurality of different rows are arranged into a plurality of different zones at the face of the spinneret body, wherein the plurality of different zones comprises: a first zone located centrally at the face of the spinneret body, comprising a plurality of first rows, each of said first rows comprising a plurality of first capillaries, wherein the first capillaries are arranged in a first capillary density, and the first capillaries individually having a first cross-sectional shape, a first hydraulic diameter, a first length, and a first length to hydraulic diameter ratio, a second zone located adjacent to the first zone at the face of the spinneret body, comprising a plurality of second rows, each of said second rows comprising a plurality of second capillaries, wherein the second capillaries are arranged in a second capillary density, and the second capillaries individually having a second cross-sectional shape, a second hydraulic diameter, a second length, and a second length to hydraulic diameter ratio, a third zone located adjacent to the first zone at the face of the spinneret body, comprising a plurality of third rows, each of said third rows comprising a plurality of third capillaries, wherein the third capillaries are arranged in a third capillary density and the third capillaries individually having a third cross-sectional shape, a third hydraulic diameter, a third length, and a third length to hydraulic diameter ratio; wherein the first zone is located between the second and third zones, wherein the third hydraulic diameter of each of the third capillaries is less than the first hydraulic diameter of each of the first capillaries, the first hydraulic diameter of each of the first capillaries is less than the second hydraulic diameter of each of the second capillaries, the third length of each of the third capillaries is less than the first length of each of the first capillaries, the first length of each of the first capillaries is less than the second length of each of the second capillaries, the third length to hydraulic diameter ratio of each of the third capillaries is less than the first length to hydraulic diameter ratio of each of the first capillaries, and the first length to hydraulic diameter ratio of each of the first capillaries is less than the second length to hydraulic diameter ratio of each of the second capillaries.

In another embodiment the process of this invention may include the filaments being extruded from the spinneret at commercially useful throughputs and fiber uniformities.

It is to be understood that both the foregoing general description and the following detailed description are exemplary and explanatory only and are intended to provide a further explanation of the present invention, as claimed.

The accompanying drawings, which are incorporated in and constitute a part of this application, illustrate some of the embodiments of the present invention and together with the description, serve to explain the principles of the present invention. Features having the same referencing numeral in the various figures represent similar elements unless indicated otherwise. The figures and features depicted therein are not necessarily drawn to scale.

DEFINITIONS

Figure 1:
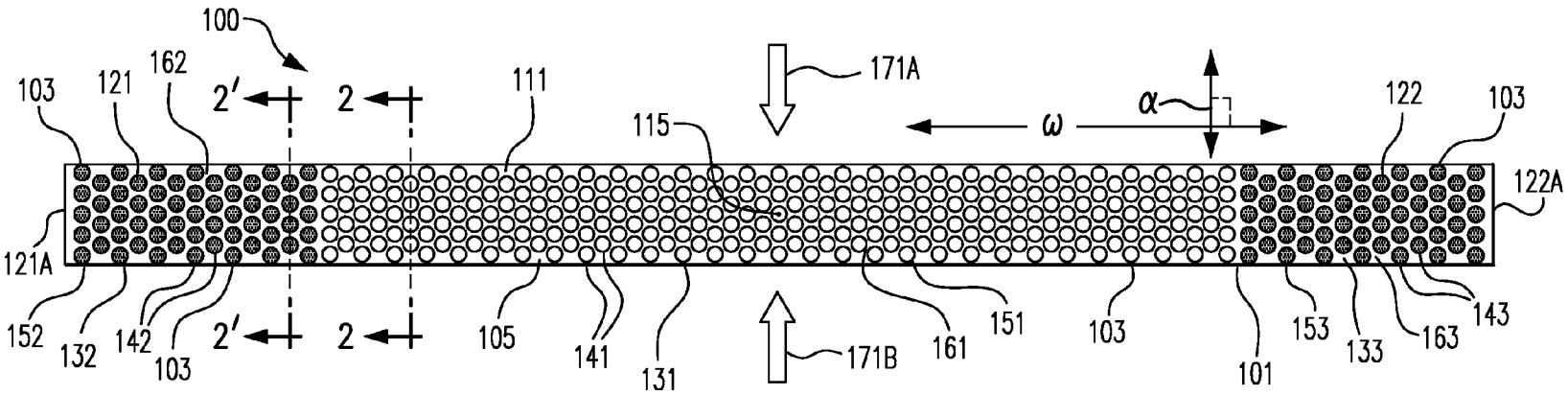
FIG. 1 is a bottom plan view of a multi-zone spinneret in accordance with an embodiment of the invention.

As used herein, the term "filament(s)" refers to a continuous polymer strand that is not intentionally broken during the regular course of formation.

As used herein, the term "fiber(s)" refers to filaments, substantially continuous filaments, staple fibers, discontinuous fibers, and other fibrous structures having a fiber length that is substantially greater than its cross-sectional dimension(s).

As used herein, the terms "nonwoven(s)" or "nonwoven web(s)" refer to randomly oriented filament-containing material(s) that are formed without the aid of a textile weaving, sewing, or knitting process.

As used herein, the terms "nonwoven fabric" or "nonwoven component(s)" may be used interchangeably and refer to a collection of one or more nonwoven webs in a close association to form one or more layers, as defined herein. The one or more layers of the nonwoven fabric or nonwoven component along with the one or more nonwoven webs can include staple length fibers, substantially continuous or discontinuous fibers, and combinations or mixtures thereof, unless specified otherwise. The one or more layers of the nonwoven fabric or nonwoven component can be stabilized or unstabilized.

The term "spunbond" or "S" refers to filaments which are formed by extruding a molten material from a plurality of capillaries in a spinneret body. The term "spunbond" also includes filaments that are formed as defined above, and which are then deposited on a collection surface or otherwise formed in a layer in a single step. Fabric structures encompassed by the invention also can include spunbond-spunbond (SS), spunbond-spunbond-spunbond (SSS), as well as other combinations and variations of layers.

As used herein, "meltspun" or "melt-spun" generally refers to fiber forming processes of spunbonding or melt-blowing.

As used herein, "substantially the same," as used with respect to a dimension of spinneret capillaries or orifices refers to differences in such dimension of less than machining tolerances.

As used herein, "comprising" or "comprises" is synonymous with "including," "containing," "having", or "characterized by," and is open-ended and does not exclude additional, unrecited elements or method steps, and thus should be interpreted to mean "including, but not limited to . . . ".

As used herein, "consisting of" excludes any element, step, or ingredient not specified.

As used herein, "consisting essentially of", refers to the specified materials, spinneret, apparatus, or steps and those additional items that do not materially affect the basic and novel characteristic(s) of the spinneret, apparatus, methods, or nonwoven fabrics of the invention as described herein.

As used herein, "spinneret body(ies)" is typically one or more metal plates that comprises orifices, and these orifices comprising capillaries through which polymer is extruded to form filaments or other fibers. The spinneret body also may be an assembly of metal plate elements each having orifices that can form part of an overall pattern of orifices. A spinneret body can be, for example, a single-piece construction having an overall pattern of orifices or, alternatively may be assembled in modular fashion from a plurality of metal plate elements which as assembled together provide a body having an overall pattern of orifices.

As used herein, a "spinneret" is a structure which includes a spinneret body having a number of small through-holes through which a fiber-forming polymer fluid is forced to form filaments or other fibers, and typically but not necessarily includes additional components used therewith, such as an overlying breaker plate for providing more uniform polymer feed distribution to the spinneret body, a filter layer or layers for filtering the polymer prior to its entering the breaker plate and/or spinneret body, or combinations thereof.

As used herein, "capillary(ies)" refers to the small through-holes from which polymer exits the spinneret body to form the fiber. Capillaries have a length, a cross-sectional shape, hydraulic diameter, and length to hydraulic diameter ratio. While not mandatory in the present invention, in general the hydraulic diameter and cross-sectional shape are substantially uniform along the length of a capillary.

As used herein, "capillary density" refers to the number of capillaries on a linear width basis at the face of the spinneret body or in a square area from the working area at the face of the spinneret body.

As used herein, "capillary length" or "length" refers to the length of the capillary through the spinneret body to a capillary opening at the face of the spinneret.

As used herein, the term "capillary cross-sectional area" or "CA" is a measurement of the exit area of the cross-sectional shape of one or more capillaries at the face of the spinneret body of the spinneret as described herein.

As used herein, "capillary perimeter" or "perimeter" or "CP" is the distance along the periphery defined by the exit geometry of the capillary at the face of the spinneret body surface. For a capillary having a circular cross-sectional shape, the perimeter is defined as the circumference of the capillary.

As used herein, "hydraulic diameter" or "$D_H$" is calculated by the formula:

$$D_H=4R_H$$

wherein $R_H$ represent hydraulic radius. Hydraulic radius ($R_H$) is calculated from the ratio: CA/CP, wherein CA is the capillary cross-sectional area of the capillary opening at the polymer exit at the face of the spinneret body of spinnerets of the present invention, and CP is the capillary perimeter of the same capillary opening. For calculating the hydraulic diameter of a capillary having a circular cross-sectional shape and a diameter "D" thereof, for example, use of the indicated formula for hydraulic diameter provides: $D_H=4*(\pi D^2/4)/(\pi D)$, which reduces to D, which refers to a measurement of the longest dimension from one side of the circular cross-sectional shape or area to the other. The CA and CP values can be determined for the capillary openings at the polymer exit at the face of the spinneret body in spinnerets of the present invention, such as by capturing a digital image of a representative opening of a zone of capillaries, such as by Scanning Electron Microscope (SEM) or optical microscope which can include a calibration scale on the viewer and/or digital images generated therewith. One knowledgeable in the art will select a method to measure the capillary perimeter and cross-sectional area that is appropriate to the shape of the opening at the polymer exit at the face of the spinneret body in spinnerets of the present invention. These methods are typically based on studying the capillary opening at the polymer exit at the face of the spinneret body using a microscope and more typically an optical microscope. For example, for simple geometric shapes such as a circle, square, rectangle or triangle, one can use an optical microscope in combination with a calibration standard (e.g., optical grid calibration slide 03A00429 Stage Mic 1 MM/0.01 DIV from Pyser-SGI Limited, Kent UK) to measure the variables used to calculate either the perimeter or cross-sectional area. For more complex cross-sectional shapes, such are multi-lobal, an example of a method is to use a microscope capable of capturing the image of the polymer exit of the capillary opening at the face of the spinneret body digitally, and using software to analyze the image to calculate the perimeter and cross-sectional area of the exit at the face of the spinneret body. For example, a microscope such as the Digital Microscope KH-7700 from Hirox Company, Ltd 2-15-17 Koenji Minami, Suginami-ku, Tokyo 155-0003 Japan, which is supplied with a proprietary software that can be used to analyze the digital image recorded by the microscope. More precisely, one could use the length and area measurement methodologies described in Chapter 3, pages 117 to 132 of the operation manual for this microscope, 1st edition with a revision date of October 2006 to calculate the perimeter and/or cross-sectional area of the capillary opening at the polymer exit at the face of the spinneret body. The cross-sectional area and perimeter dimensions of the capillary opening shape can be determined with use of any of calculations with known rules of geometry, or determinations using known or commercially available software algorithms applicable to evaluating digital or photographic images of cross-sectional shapes, or manual determinations. As manual determinations, a weight method can be used, which may be useful for very complex shapes, where a digital image or photograph of the opening shape can be provided at a known enlarged scale relative to the actual capillary shape on a discrete regular shaped piece of paper or the like of known overall dimensions (such as a square, rectangle, or circle). Then, the image of the opening shape can be cut out from the paper, and the weight proportion of the separated opening shape relative to overall weight of the original digital imaged piece of paper can be considered to yield the same ratio value as the cross-sectional area of the opening shape to the cross-sectional area of the piece of paper. The cross-sectional area of the opening shape in the enlarged digital image on the piece of paper can be readily calculated from these ratios, and then the cross-sectional area of the actual capillary shape can be calculated from that value by scaling it down based on the indicated known enlargement scale used in the digital image on the piece of paper. The peripheral length of the shape, such as a simple or complex shape, also may be determined by manually measuring the perimeter of the shape in the enlarged image by tracing it with a filament or the like of measurable length, and scaling the result back for the actual capillary shape based on the known enlargement scale used for the digital image.

As used herein, "capillary length to capillary hydraulic diameter ratio" or "length to hydraulic diameter ratio" refers to the numerical result of dividing a capillary length by a capillary hydraulic diameter.

As used herein, the "overall length to hydraulic diameter ratio" is calculated from the formula:

$$100\times[(L/D_H)_G-(L/D_H)_S]/(L/D_H)_G$$

wherein $(L/D_H)_G$ is the greatest value of capillary length to hydraulic diameter ratio for all the capillary zones of a spinneret body, and $(L/D_H)_S$ is the smallest value of capillary length to hydraulic diameter ratio for all the capillary zones at the face of a spinneret body. The result is expressed as a percentage value.

As used herein, the "zone-to-zone length to hydraulic diameter ratio(s)" is calculated from the formula:

$$100\times[(L/D_H)_{ZG}-(L/D_H)_{ZS}]/(L/D_H)_{ZG}$$

wherein $(L/D_H)_{ZG}$ is the greater value of capillary length to hydraulic diameter ratio for one of a pair of adjacent capillary zones at the face of a spinneret body, and $(L/D_H)_{ZS}$ is the smaller value of capillary length to hydraulic diameter ratio of the other capillary zone. The result is expressed as a percentage value.

As used herein, "capillary dimension(s)" or "dimension(s)" refers to one or more of the capillary length, capillary cross-sectional shape, capillary hydraulic diameter, capillary cross-sectional area, capillary perimeter, or capillary length to hydraulic diameter ratio.

The terms "cooling" and "quench(ing)" when referencing a fluid, such as a gas, are used interchangeably herein and refer to the function and temperature of the gas used to solidify the molten polymer exiting from capillaries at the face of the spinneret body of spinnerets of the present invention.

DETAILED DESCRIPTION

The present invention is directed to a spinneret that can be used for the production of melt-spun filaments. The spinneret has zones each with different capillary designs. The zones can differ from each other based on capillary density, capillary dimensions, or both. The capillary dimensions that can differ can be, for example, capillary polymer exit opening: hydraulic diameter, cross-sectional area, perimeter, length, cross-sectional shape, and the length to hydraulic diameter ratio. The design of each different zone at the face of the spinneret body can be selected to allow an increase in the overall number of capillaries, therefore potentially allowing for higher polymer throughput for the entire spinneret and/or improved filament uniformity, which facilitates improved nonwoven web and fabric uniformity while maintaining a stable process. The design of each different zone at the face of the spinneret body can also be selected to allow for an improvement in filament denier uniformity at higher polymer throughputs without increasing the capillary density. Other benefits of the multi-zone spinneret of the invention may include more uniform polymer flow rates through the capillaries across the face of the spinneret body, minimization of variation in polymer throughput per capillary, and minimization of variation in filament denier among capillaries in various zones at the face of the spinneret body. The quenching of the filaments can be made more uniform across the face of the spinneret body by using the spinnerets of this invention. It is also believed that variation in the "quench distance to spinneret body face" for each filament, which is the distance from the face of the spinneret body to the location on each filament at which the surface of the filament becomes solid (also known as the "frost line") may be minimized by use of spinnerets of the present invention. The principles of spinneret design of the present invention indicated herein can be used to provide spinnerets useful for different quench modalities, such as cross-flow or dual side quenching of filaments or single side quenching of filaments produced by the spinnerets.

Embodiments of spinnerets of the present invention can be operable with higher polymer throughputs than a comparable spinneret made with only one type of capillary design and uniform capillary dimensions across the face of the spinneret body, while maintaining similar or achieving better filament, nonwoven web, and nonwoven fabric uniformity. This design can allow drawing of more of the filaments to achieve a lower average fiber denier than feasible with a standard spinneret having only a single capillary design while still maintaining a stable spinning process.

Based at least in part on results of experimental studies conducted and described in the examples herein, the present investigators believe that a predominant cause for the filament breaks and nonwoven web and fabric hard spot defects observed when operating such single capillary design and dimension spinnerets at high polymer throughputs can be significant variability in cooling of the filaments across the face of the spinneret body. More precisely, it is thought that the filaments extruded furthest away from the quench gas discharge outlet (e.g., in the center rows of capillaries of a spinneret body that has a single capillary design and receives quench air from two opposite sides) are being cooled less efficiently by the quench gas (e.g., air) than those filaments extruded from rows of capillaries that are located closer to the quench gas discharge outlet (e.g., closer to the edges of the spinneret body where the quench air penetrates the filament bundle), and those filaments that are further away from the quench gas discharge outlet to be contacted by quench gas having risen in temperature, causing the solidification point for the surface of those filaments to occur further away from the spinneret body face than for filaments extruded closer to the quench gas discharge outlet. For example, filaments extruded from the center rows of a spinneret used in a cross-flow or dual quench configuration (i.e., further away from the quench gas discharge outlet), have more opportunities to come in contact with each other when still molten or tacky causing breakage or touching of each other and producing a disturbance that can result in hard spot defects in the nonwoven web or nonwoven fabric. It is also believed that the filaments from these center rows may have a lower denier than those filaments extruded from the capillaries closer to the quench gas discharge outlet because of their lower frost line, allowing them to be drawn (i.e., attenuated) more. A similar problem can occur in single-sided quench configurations or modalities wherein filaments extruded furthest away from the quench gas discharge outlet (e.g., in the rows of capillaries that have a single capillary design that are located on the side of the spinneret body opposite to the side closest to the quench gas discharge outlet or quench source in single side quench modalities) can be cooled less efficiently by the quench gas than those filaments extruded from rows of capillaries that are located closer to the quench gas discharge outlet (e.g., closer to the edge of the spinneret body where the quench air initially penetrates the filament bundle).

A way to deal with the frost line variation among filaments that are closer and further away from the quench gas discharge outlet in spinneret bodies used in cross-flow quench configurations has been to leave a strip free of capillaries in the middle of the single capillary design spinneret, which, however, would reduce polymer throughput and require the collection surface to be slowed to provide a fabric with the same collected basis weight. A multi-zone spinneret of this invention can reduce or eliminate these drawbacks of the single capillary design spinneret to allow higher overall polymer throughput through the spinneret and more uniform nonwoven web and nonwoven fabric formation, while minimizing filament breaks and nonwoven web and nonwoven fabric hard spot defects.

The multi-zone spinnerets of the present invention can achieve this goal by combining several elements, which are illustrated herein with reference to the accompanying drawings. The spinneret body of the spinneret of the invention defines orifices extending through the spinneret body that comprise capillaries that open at a face of the spinneret body for polymer filament extrusion therefrom. The capillaries are arranged in a plurality of different rows, which are arranged in a plurality of zones at the face of the spinneret body. These capillaries have a distinct length, a distinct cross-sectional shape, a distinct cross-sectional area, a distinct perimeter, and a distinct hydraulic diameter calculated using the cross-sectional area and perimeter, at their exit or opening at the face of the spinneret body. The capillary length extends from the capillary opening at the bottom face of the spinneret body to an opposite capillary end thereof, such as where the capillary may merge structurally and fluidly with a larger hole portion of the orifice that extends from the opposite top face of the same spinneret body. The spinnerets of the invention have a plurality of zones of capillaries that can differ, for example, based on the overall length to hydraulic diameter ratio, the zone-to-zone length to hydraulic diameter ratios, the density of capillaries, the hydraulic diameter of the capillaries, the lengths of the capillaries, the cross-sectional shape of the capillaries, or any combinations thereof.

In one embodiment, the spinneret body of the spinneret has an overall length to hydraulic ratio of at least 3 percent (i.e., 3% or greater up to 100%), or at least 4 percent, or at least 5 percent, or at least 10 percent, or at least 15 percent, or at least 20 percent, or at least 25 percent, or at least 50 percent, or at least 75 percent, or 100 percent, or from 3 to 100 percent, or from 4 to 75 percent, or from 5 to 50 percent, or from 10 to 25 percent, or any other values between 3 and 100 percent.

In another embodiment, the spinneret body has a plurality of zone-to-zone length to hydraulic diameter ratios, and wherein at least one of the zone-to-zone length to hydraulic diameter ratios is at least 2 percent (i.e., 2% or greater up to 100%), or at least 3 percent, or at least 4 percent, or at least 5 percent, or at least 10 percent, or at least 15 percent, or at least 20 percent, or at least 25 percent, or at least 50 percent, or at least 75 percent, or 100 percent, or from 2 to 100 percent, or from 3 to 75 percent, or from 4 to 50 percent, or from 5 to 25 percent, or any other values between 2 and 100 percent.

As another option, the inventive spinneret can be divided into zones that are differentiated from each other by their capillary hydraulic diameter and capillary length. For example, the capillary hydraulic diameter and capillary length can be smaller in zones of capillaries that are located on the face of the spinneret body further away from the quench gas discharge outlet as compared to different zones of capillaries located relatively closer to the quench gas discharge outlet. As another option, the inventive spinneret can be divided into zones that are differentiated from each other by their capillary hydraulic diameter, length, and length to hydraulic diameter ratio. For example, the capillary hydraulic diameter, length, and length to hydraulic diameter ratio can be smaller in zones of capillaries that are located on the face of the spinneret body further away from the quench gas source (e.g., discharge outlet) when compared to different zones of capillaries located relatively closer to the quench gas source. As another option, the inventive spinneret can be divided into zones that are differentiated from each other by any combination of these features or any combination of capillary dimensions. Further, the capillary hydraulic diameter, the capillary length, or both, can be reduced in the zone(s) of capillaries closer to the geometric center at the face of the spinneret body, assuming the geometric center is further away from the quench gas discharge outlet than those zone(s) that are closer to the quench gas discharge outlet.

The difference in any one or more capillary dimensions (excluding cross-sectional shape) provided between the capillaries of adjacent zones, for example, can be at least greater than machining tolerances in making the capillaries, and specifically may be different from each other by at least 2% different, or at least about 2.5%, or at least 3%, or at least 4%, or at least 5%, or at least 6%, or at least 7%, or at least 8%, or at least 9%, or at least 10%, or at least 15%, or at least 20%, or at least 25%, or at least 30%, or at least 35% different, or at least 40%, or any ranges based on any two different ones of these nonzero values (e.g., about 2% to about 30%), or other values. Similar values as these can apply to differences in capillary length to hydraulic diameter ratios provided between the capillaries of different zones and used to calculate the overall length to hydraulic diameter ratio and the various zone-to-zone length to hydraulic diameter ratios for zones at the face of the spinneret body. The difference in capillary length provided between the capillaries of adjacent zones, for example, can be at least greater than machining tolerances in making the capillaries, and specifically may be different from each other by at least 2% different, or at least 2.5%, or at least 3%, or at least 4%, or at least 5%, or at least 6%, or at least 7%, or at least 8%, or at least 9%, or at least 10%, or at least 15%, or at least 20%, or at least 25%, or at least 30%, or at least about 35%, or at least 40%, or any ranges based on any two different ones of these nonzero values (e.g., about 2% to about 35%), or other values. All of these percentage differences can be calculated by dividing the absolute positive value of the numerical difference of the two numbers by the larger number of the two, and multiplying the resulting value by 100.

As another option, the inventive spinneret can be divided into zones that are differentiated from each other by their capillary density. For example, at least one zone of capillaries can be located centrally between two other zones of capillaries located at opposite ends of the spinneret body wherein the three zones are disposed in a linear arrangement oriented perpendicular to the direction of the flow of cooling gas (e.g., quenching air), wherein the centrally located zone or zones of capillaries have a greater capillary density than each of the outer (i.e., less centrally located) zones of capillaries. The indicated difference in capillary densities that can be provided, such as between the indicated central zone and outer zones of capillaries wherein the three zones are disposed in a linear arrangement oriented perpendicular to the direction of the flow of cooling gas (e.g., quenching air), can be at least greater than machining tolerances in making the capillaries, and, for example, can be different from each other by at least 1% different, or at least about 2%, or at least 3%, or at least 4%, or at least 5%, or at least 6%, or at least 7%, or at least 8%, or at least 9%, or at least 10%, or at least 15%, or at least 20%, or at least 25%, or at least 30%, or at least 35%, or any ranges based on any two different ones of these nonzero values (e.g., about 1% to about 30%), or other values. These capillary density values can be based on spinneret body width.

The inventive spinneret also can contain more capillaries without proportionally increasing the open area at the face of the spinneret body, and the open area can also be reduced without sacrificing polymer throughput. When compared to the indicated single capillary design spinneret, this can be, for example, about up to a 20% to about 25% increase in number of capillaries at the face of the spinneret body with about an open face of the spinneret body area that can be reduced up to 5% or up to 7%, or other improved values thereof.

With reference to FIG. 1, a multi-zone spinneret 100 of an embodiment of the invention is shown. The spinneret has a spinneret body 101 that defines orifices 103 in three zones 111, 121, and 122 that extend through the spinneret body 101. The orifices 103 of zone 111 comprise first capillaries 131, and zones 121 and 122 comprise second and third capillaries 132 and 133, that all open at a bottom face 105 of the spinneret body 101 from which polymer filament extrusion occurs downwardly. In FIG. 1, the orifices/capillaries of the different zones are differentiated from each other for purposes of this description by arbitrarily added markings (viz., empty circles (zone 111) and mottled grey circles (zones 121, 122)), which markings are not parts of the actual spinneret structure. The first capillaries 131 of zone 111 are arranged in a plurality of different first rows 141 at the face 105 of the spinneret body 101. Similarly, the capillaries 132 and 133 of zones 121 and 122 are arranged in a plurality of different second and third rows 142 and 143. The plurality of different rows 141, 142, and 143 are arranged into the indicated plurality of different zones 111, 121, and 122 with the first zone 111 located between the zones 121 and 122. The first zone 111 is located closer to an imaginary geometric center 115 of the face 105 of the spinneret body 101 than the other zones 121 and 122. The first capillaries 131 of the first zone 111 individually have a first cross-sectional shape 151. The first rows 141 of the first capillaries 131 of the first zone 111 are arranged in a first capillary density 161. The second capillaries 132 of the second zone 121 individually have a second cross-sectional shape 152. The second rows 142 of the second capillaries 132 of the second zone 121 are arranged in a second capillary density 162. The third capillaries 133 of the third zone 122 individually have a third cross-sectional shape 153. The third rows 143 of the third capillaries 133 of the third zone 122 are arranged in a third capillary density 163. In an embodiment, the capillaries can be equispaced within a given row for all or substantially all of the rows. In an embodiment, the adjacent rows of capillaries can be equispaced for all or substantially all of the rows relative to the width direction ω of spinneret body 101. A cross-flow of quench air flow can be directed in general directions 171A and 171B towards and below spinneret body 101 of spinneret 100 in a direction α oriented orthogonal to the width direction ω of the spinneret body, such as described in more detail in other embodiments described herein.

The cross-sectional shapes of the indicated capillaries shown in FIG. 1 are based on the exit opening geometry of the capillaries at the face of the spinneret body. As shown in figures described herein, the cross-sectional shape can extend at least partly through the thickness of the spinneret body in which the capillaries have been defined. The cross-sectional shapes of the capillaries are shown to be circular in this illustration. Other geometries of the cross-sectional shapes can be used, such as oval, rectangular, square, parallelogram, triangular, multi-lobal, and others. In an embodiment, the spinneret has capillaries with a distinct cross-sectional shape at the exit openings thereof that can impart a similar cross-sectional geometry to the extruded filaments formed using the spinneret capillaries. For example, spinnerets with circular cross-sectional shaped capillaries can be used to form filaments that have circular cross sectional shapes, rectangular cross-sectional-shaped capillaries can be used to form rectangular cross-sectional shaped filaments, and/or oval cross-sectional shaped capillaries can be used to form filaments that have oval cross-sectional shapes.

In an embodiment, the capillary density 161 of the first or central zone 111 can be greater than each of the capillary densities 162 and 163 of the end (or outer) zones 121 and 122. In addition to location of a zone of capillaries with respect to the cooling gas source (e.g., quench air discharge outlet), location of a zone with respect to a wall or other cooling gas flow obstruction may dictate capillary density differences between zones. For example, capillary density 161 may be not substantially the same as capillary density 162 and capillary density 163, because capillary density 162 and capillary density 163 may be closer to a wall (not shown) located at the outer edge(s) of the spinneret body. As walls have the potential to disrupt cooling gas flow which may cause more turbulence and likelihood of filament contact while in the molten state, the capillary density 162 and capillary density 163 at the edges of the face of the spinneret body may be less than the capillary density 161 even though zones 111, 121, and 122 are all closer to the quench air discharge outlet (not shown) but the air flow from which is indicated by general directions 171A and 171B. In embodiments, the capillary densities 162 and 163 of the end zones 121 and 122 can be the same or different from each other. In an embodiment, they are the same. As indicated, the capillary densities described herein can be expressed based on a linear width basis of the spinneret body or based on square area of the face of the spinneret body. The linear width direction ω of the spinneret body 101 is indicated in FIG. 1. The total linear width of the spinneret body 101 shown in FIG. 1 can be determined based on the linear distance in the linear width direction ω between ends 121A and 12A of the spinneret body 101. The spinneret body can be a metal plate, for example, of similar material types such as used in the industry for spinneret plates. The orifices and capillaries having the geometries described herein can be defined in the body of the spinneret body, such as by adaption and use of machining techniques known in the art for spinneret manufacture.

Figure 2B:
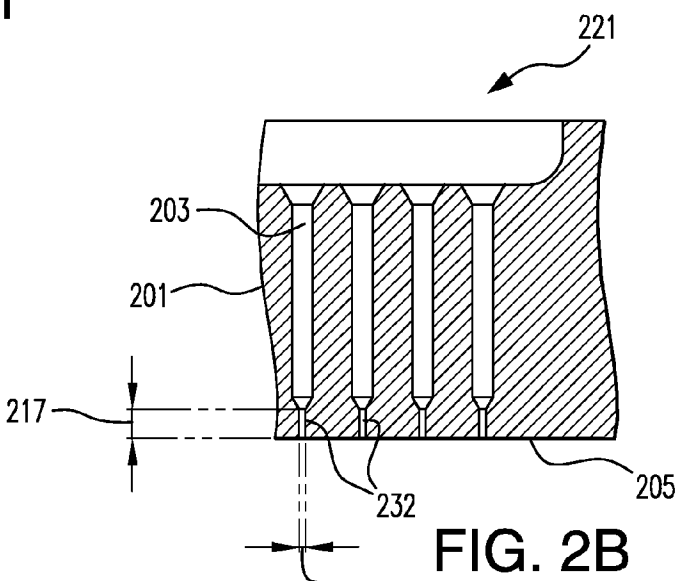
FIG. 2B is an enlarged cross section view of capillaries of a zone of the spinneret along line 2'-2' of FIG. 1 in accordance with an embodiment of the present invention.
Figure 2A:
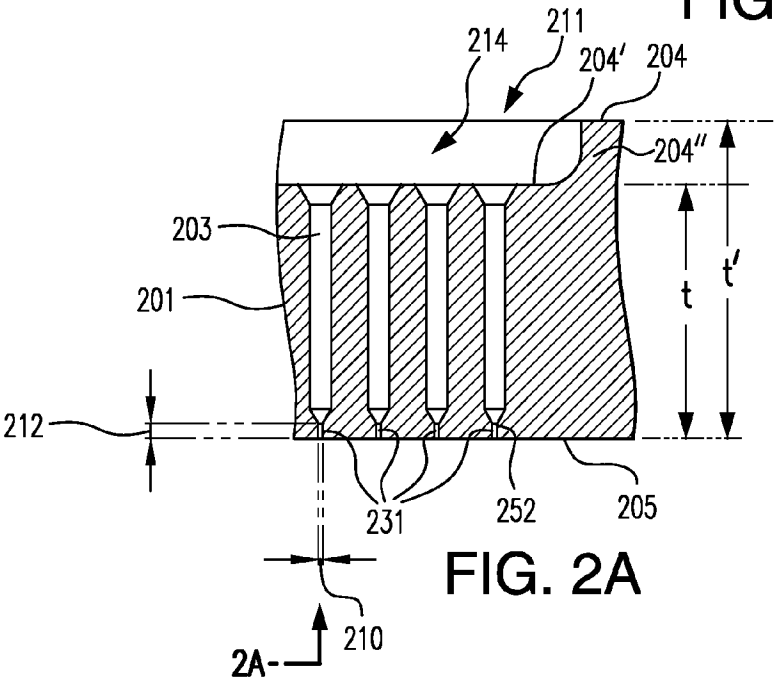
FIG. 2A is an enlarged cross section view of capillaries of a zone of the spinneret along line 2-2 of FIG. 1 in accordance with an embodiment of the present invention.

As shown in more detail in FIG. 2A, the orifices 203 (103) extend through the total thickness t of the spinneret body 201 (101) from a top face 204' of the spinneret body 201 (101) in which the orifices are located, which is opposite to the bottom face 205 (105) of the spinneret body 201 (101). The top face 204' is generally planar between the orifices and extends generally horizontally in this illustration. The parenthetical numbers used herein refer to the same features as identified in another figure. In this illustration, the top face 204' of the spinneret body 201 where the orifices 203 are formed is recessed with respect to an edge face portion 204 of an upraised protuberance 204" of the spinneret body 201 that encircles top face 204'. The outer edge portion 204 of the spinneret body 201 can have a thickness t'. The thickness t is less than thickness t' to define a space 214 between the top face portion 204', which is shown as a concave depression in the upper face of the spinneret body in this illustration, and that is encircled by protuberance 204", wherein molten polymer fed to the top face 204' of spinneret body 201 has reservoir space to collect in and fill before being pushed under hydraulic pressure into the orifices 203. In this manner, polymer flow from another component of a spinneret, such as a breaker plate, for example, into the spinneret body 201, can be eased. The first capillaries 231 (131) of the first zone 211 (111) individually can have a first hydraulic diameter 210 and a first length 212. The hydraulic diameter 210 indicated in FIG. 2A is for a circular cross-sectional shape. A portion 252 of the spinneret body 201 encircles and defines the capillary 231 as it extends through a bottom portion of the spinneret body 201 and opens at the bottom face 205 of the spinneret body 201. The capillaries illustrated herein have circular cross-sectional shapes, although other cross-sectional shapes such as indicated herein can be used. A first length to hydraulic diameter ratio ($L/D_H$) can be calculated or otherwise determined for these first capillaries 231. The hydraulic diameters are determined by the indicated formula as defined herein.

As shown in FIG. 2B, the second capillaries 232 (132) of the second zone 221 (121) individually can have a second hydraulic diameter 216 and a second length 217. The hydraulic diameter indicated in FIG. 2B is for a circular cross-sectional shape. A second length to hydraulic diameter ratio ($L/(D_H)$) can be calculated or otherwise determined for these second capillaries 232. As indicated, for circular cross-sectional area shaped capillaries, for example, hydraulic diameter ($D_H$) and length to hydraulic diameter ratio ($L/D_H$) values, can be readily calculated from these length and hydraulic diameter dimensional values. The hydraulic diameters are determined by the indicated formula as defined herein. In an embodiment, the orifices 203 and second capillaries 232 (132) of zone 221 (121) shown for spinneret body 201 in FIG. 2B and exemplified herein also can be representative of and the same for the orifices 103 and third capillaries 133 of the third zone 122 of the spinneret body 101 shown in FIG. 1. In an embodiment, each of the zones of the spinneret body contains capillaries that have the same capillary dimensions. In an embodiment, at least about 90%, or at least about 95%, or at least about 98%, or at least about 99%, or 100%, of all of the capillaries of a given zone of a spinneret of the present invention can have the same capillary dimensions. As indicated, in embodiments of the present invention variations in the dimensions of the capillaries are provided between some of the different capillary zones.

Figure 2E:
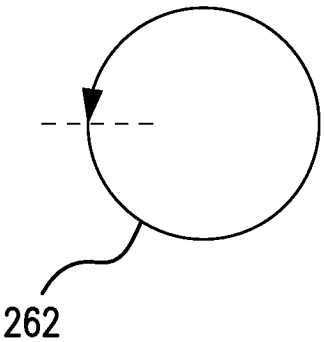
FIG. 2E is an enlarged view of the perimeter of the cross-sectional shape of the capillary of FIG. 2C.
Figure 2D:
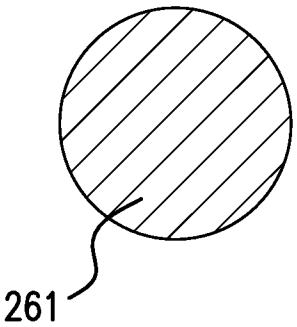
FIG. 2D is an enlarged view of the cross-sectional area of the cross-sectional shape of the capillary of FIG. 2C.
Figure 2C:
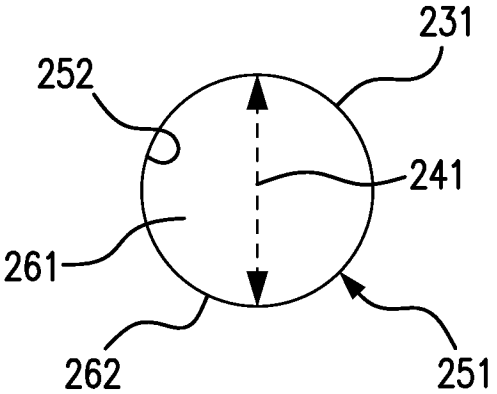
FIG. 2C is an enlarged view of a cross-sectional shape of a first capillary of a first zone of FIGS. 1 and 2A, in bottom view direction 2A shown in FIG. 2A, in accordance with an embodiment of the present invention.
Figure 2H:
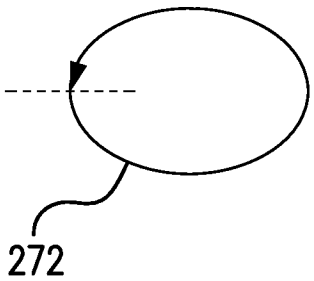
FIG. 2H is an enlarged view of the perimeter of the cross-sectional shape of the capillary of FIG. 2F.
Figure 2G:
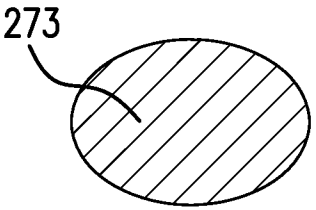
FIG. 2G is an enlarged view of the cross-sectional area of the cross-sectional shape of the capillary of FIG. 2F.
Figure 2F:
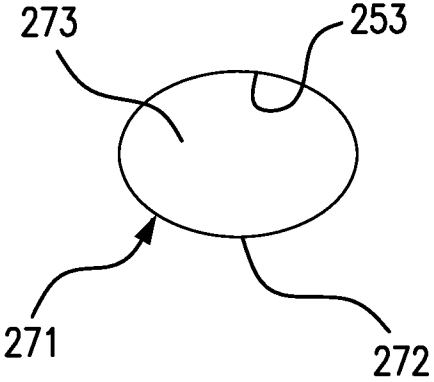
FIG. 2F is an enlarged view of another option for the cross-sectional shape of a first capillary of a first zone of FIGS. 1 and 2A in accordance with an embodiment of the present invention.
Figure 2K:
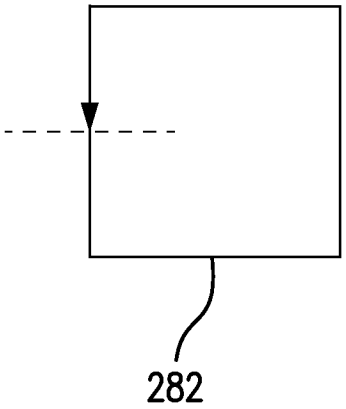
FIG. 2K is an enlarged view of the perimeter of the cross-sectional shape of the capillary of FIG. 2I.
Figure 2J:
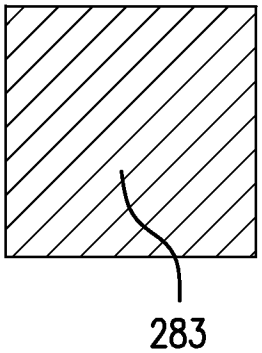
FIG. 2J is an enlarged view of the cross-sectional area of the cross-sectional shape of the capillary of FIG. 2I.
Figure 2I:
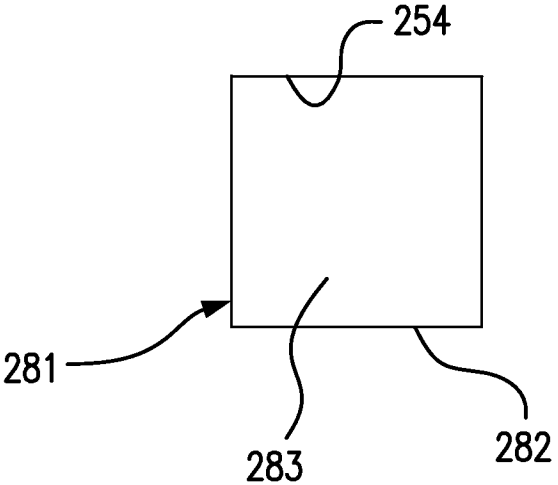
FIG. 2I is an enlarged view of yet another option for the cross-sectional shape of a first capillary of a first zone of FIGS. 1 and 2A in accordance with an embodiment of the present invention.

FIG. 2C shows an enlarged view of a cross-sectional shape 251 (151) of a first capillary 231 (131), a diameter 241 thereof, a perimeter 262 thereof, and cross-sectional area 261 thereof. The cross-sectional shape 251, cross-sectional area 261, and perimeter 262 of the capillary 231 are defined by the indicated portion 252 of the spinneret body 201 that encircles the capillary 231 as it extends through a bottom portion of the spinneret body 201 until it opens at the bottom face 205 of the spinneret body 201. FIGS. 2D and 2E show the cross-sectional area and perimeter, respectively, of the shape of FIG. 2C. The values of these two of the dimensions illustrated in FIGS. 2D and 2E are used in calculating the hydraulic diameter ($D_H$) of the shape 251(151) of FIG. 2C according the indicated formula herein. In this illustration, the cross-sectional area 261 of cross-sectional shape 251 is the cross-hatched space that is shown in FIG. 2D, and the perimeter 262 of the cross-sectional shape 251 is shown in FIG. 2E by the lineal length around the circle indicated by the dashed line starting/ending point where the arrow ends. For a circular cross-sectional shape, such as illustrated in FIG. 2C, the respective values of the cross-sectional area 261 and perimeter 262 can be calculated according to common geometric rules, e.g., such as by knowing the value of the diameter 241, or can be otherwise determined as detailed herein. As indicated, this illustration shows capillaries that can have circular cross-sectional shapes. Other cross-sectional shapes of capillaries that can be used for capillary 231 and other capillaries used in a spinneret of the invention include, for example, oval cross-sectional shape 271 having a corresponding cross-sectional area 273 defined within a surrounding spinneret body portion 253 such as shown in FIG. 2F, or rectangular or square cross-sectional shape 281 having a corresponding cross-sectional area 283 that is defined within a surrounding spinneret body portion 254 as shown in FIG. 2I, or other shapes and corresponding cross-sectional areas. FIGS. 2G and 2H show the cross-sectional area 273 and perimeter 272, respectively, of the shape of FIG. 2F. FIGS. 2J and 2K show the cross-sectional area 283 and perimeter 282, respectively, of the shape of FIG. 2I. The hydraulic diameters of these shapes also can be determined from the corresponding cross-sectional areas and perimeters using the formulas detailed herein. These illustrated types of capillary cross-sectional shapes for the first capillaries of the first zone also can apply to other capillaries described herein for other zones of the spinneret with relative dimensions thereof selected and adjusted according to descriptions herein.

Figure 2L:
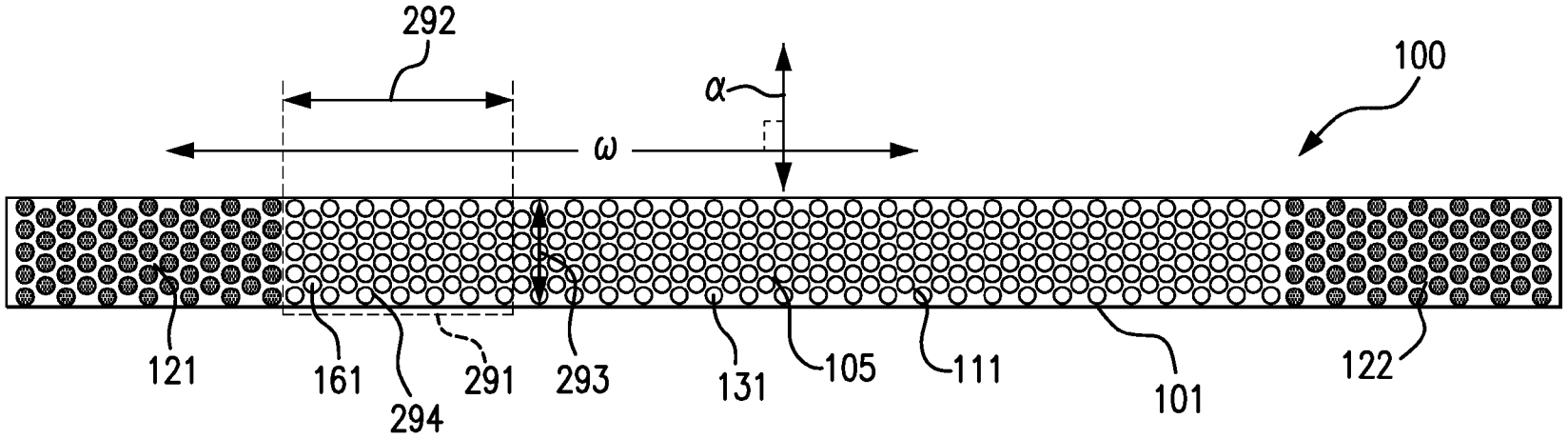
FIG. 2L shows capillary density determinations for the spinneret shown in FIGS. 1 and 2A in accordance with an embodiment of the present invention.

FIG. 2L shows manners of determining capillary density of a spinneret of an embodiment of the present invention with reference made to the spinneret 100 that has spinneret body 101 shown in FIGS. 1 and 2A for sake of illustration. For purposes of this illustration, the capillary density 161 is determined for an arbitrarily selected partial portion 291 of the pattern of capillaries 131 in the first zone 111, but is not intended to be limiting to the particular portion of the spinneret body for which the capillary density can be measured. The portion used to determine the capillary density of a given zone of the spinneret can encompass the entire zone of capillaries or a lesser representative portion thereof. The capillary density 161 can be determined with respect to the width direction ω of the spinneret body 101. In this illustration, for example, there are 59 capillaries per length 292 of portion 291 in the width direction ω of the spinneret body 101, which provides a measure of capillary density for the first zone 111. As another option, the capillary density 161 can be determined based on square area of the face 105 of the spinneret body 101 with respect to both the width direction ω and direction α oriented orthogonal to the width direction ω of the spinneret body. In this illustration, for example, there are 59 capillaries per a square area 294 of the face of the spinneret body 101 with the square area 294 determined by multiplying the length 292 of portion 291 in the width direction ω and the length 293 of portion 291 in the indicated direction α oriented orthogonal to the width direction ω of the spinneret body, which provides a another measure of capillary density for the first zone 111. The densities of other capillaries in other zones of the spinneret, such as described herein, can be determined in similar manners.

Figure 3:
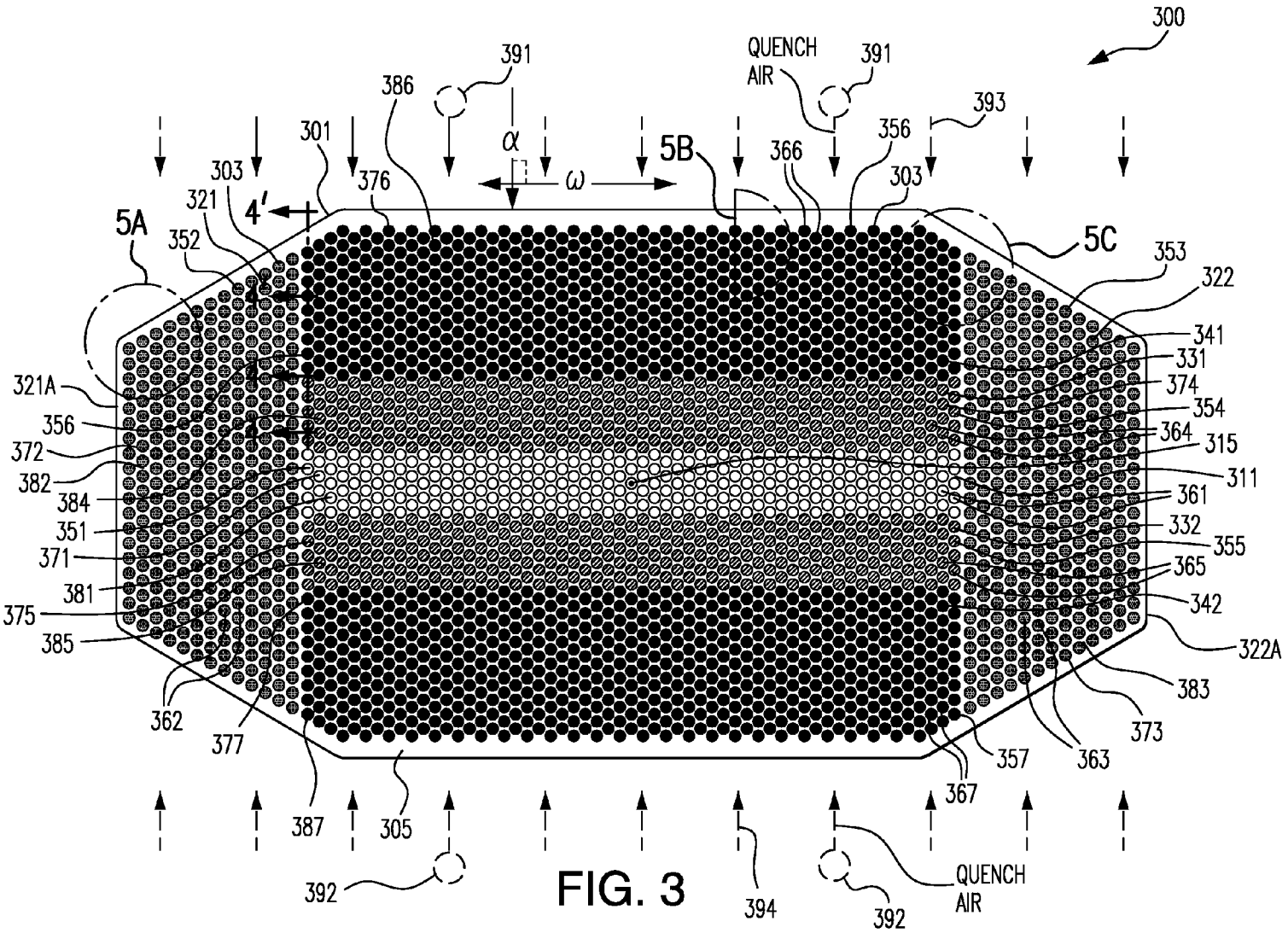
FIG. 3 is a bottom plan view of a multi-zone spinneret in accordance with another embodiment of the invention.

FIG. 3 is a multi-zone spinneret 300 of another embodiment of the invention. The spinneret has a spinneret body 301 that defines orifices 303 in seven zones 311, 321, 322, 331, 332, 341, and 342. The orifices 303 extend through the spinneret body 301 and include capillaries that open at the face 305 of the spinneret body 301. First or central zone 311 comprises first capillaries 351, second and third (or end) zones 321 and 322 comprise second and third capillaries 352 and 353, fourth and fifth (or side) zones 331 and 332 comprise fourth and fifth capillaries 354 and 355, and sixth and seventh (or side) zones 341 and 342 comprise sixth and seventh capillaries 356 and 357. The capillaries 351, 352, 353, 354, 355, 356, and 357 open at a bottom face 305 of the spinneret body 301 from which polymer filament extrusions occur downwardly. In FIG. 3, the orifices and/or capillaries of the different zones are differentiated from each other for purposes of this description by arbitrarily added markings (viz., empty circles (zone 311), mottled grey circles (zones 321, 322), diagonal striped circles (zones 331, 332), solid circles (zones 341, 342)), which markings are not part of the actual spinneret structure. The first capillaries 351 of first zone 311 are arranged in a plurality of different first rows 361 at the face 305 of the spinneret body 301. Similarly, the capillaries 352 and 353 of second and third zones 321 and 322 are arranged in a plurality of different second and third rows 362 and 363, the capillaries 354 and 355 of fourth and fifth zones 331 and 332 are arranged in a plurality of different fourth and fifth rows 364 and 365, and the capillaries 356 and 357 of sixth and seventh zones 341 and 342 are arranged in a plurality of different sixth and seventh rows 366 and 367. The plurality of different rows 361, 362, 363, 364, 365, 366, and 367, are arranged into the indicated plurality of different zones 311, 321, 322, 331, 332, 341, and 342. The first zone 311 located between the zones 321 and 322 in the width direction ω of the spinneret body and between zones 331, 332, 341, and 342 in a direction α oriented orthogonal to direction ω of the spinneret body. The first zone 311 is located closer to an imaginary geometric center 315 of the face 305 of the spinneret body 301 than the other zones 321, 322, 331, 332, 341, and 342. The first capillaries 351 of the first zone 311 individually have a first cross-sectional shape 371. The first rows 361 of the capillaries 351 of the first zone 311 are arranged in a first capillary density 381. The second capillaries 352 of the second zone 321 individually have a second cross-sectional shape 372. The rows 362 of the capillaries 352 of the zone 321 are arranged in a second capillary density 382. The third capillaries 353 of the third zone 322 individually have a third cross-sectional shape 373. The rows 363 of the capillaries 353 of the zone 322 are arranged in a third capillary density 383. The fourth capillaries 354 of the fourth zone 331 individually have a fourth cross-sectional shape 374. The rows 364 of the capillaries 354 of the zone 331 are arranged in a fourth capillary density 384. The fifth capillaries 355 of the fifth zone 332 individually have a fifth cross-sectional shape 375. The rows 365 of the capillaries 355 of the zone 332 are arranged in a fifth capillary density 385. The sixth capillaries 356 of the sixth zone 341 individually have a sixth cross-sectional shape 376. The rows 366 of the capillaries 356 of the zone 341 are arranged in a sixth capillary density 386. The seventh capillaries 357 of the seventh zone 342 individually have a seventh cross-sectional shape 377. The rows 367 of the capillaries 357 of the zone 342 are arranged in a seventh capillary density 387. In an embodiment, the capillaries can be equispaced within a given row for all or substantially all of the rows. In an embodiment, the adjacent rows of capillaries can be equispaced for all or substantially all of the rows relative to the width direction ω of spinneret body 301, or orthogonal direction α, or both. The spinneret body 301 has an overall polygonal shape comprising a rectangular middle portion with trapezoidal end portions.

The cross-sectional shapes of the indicated capillaries shown in FIG. 3 also are based on the exit opening geometry of the capillaries at the face of the spinneret body. As shown in figures described herein, the cross-sectional shape of these capillaries can extend at least partly through the thickness of the spinneret body in which the capillaries have been defined. The cross-sectional shapes of the capillaries also are shown to be circular in this FIG. 3 illustration. As indicated, other geometries can be used for the cross-sectional shapes of the capillaries. In an embodiment, all the zones of the spinneret body contain capillaries that have the same capillary cross-sectional shape, albeit with variations in the other dimensions of the capillaries in some or all of the different capillary zones as described herein. In an embodiment, the capillary densities 381, 384, 385, 386, and 387 of the first, fourth, fifth, sixth, and seventh zones each can be greater than each of the capillary densities 382 and 383 of the end zones 321 and 322. In embodiments, the capillary densities 381, 384, 385, 386, and 387 of the first, fourth, fifth, sixth, and seventh zones can be the same or different from each other. In one embodiment, they are the same. In embodiments, the capillary densities 382 and 383 of the end zones 321 and 322 can be the same or different from each other. In one embodiment, they are the same. The total linear width of the spinneret body 301 shown in FIG. 1 can be determined based on the linear distance in the linear width direction ω between ends 321A and 322A of the spinneret body 301. The spinneret body 301 can be a similar construction and can be manufactured in a similar manner as indicated herein for the spinneret body of FIG. 1. In FIG. 3, the spinneret body 301 is illustrated as having an elongated octagonal perimeter shape wherein the end zones 321 and 322 taper down in the width direction ω moving away from geometric center 315. Other spinneret body shapes may be used, such as other polygonal shapes (e.g., rectangular, square, hexagonal, trapezoidal, and others) and such as elliptical, circular, oval, and other non-polygonal shapes.

Figure 8:
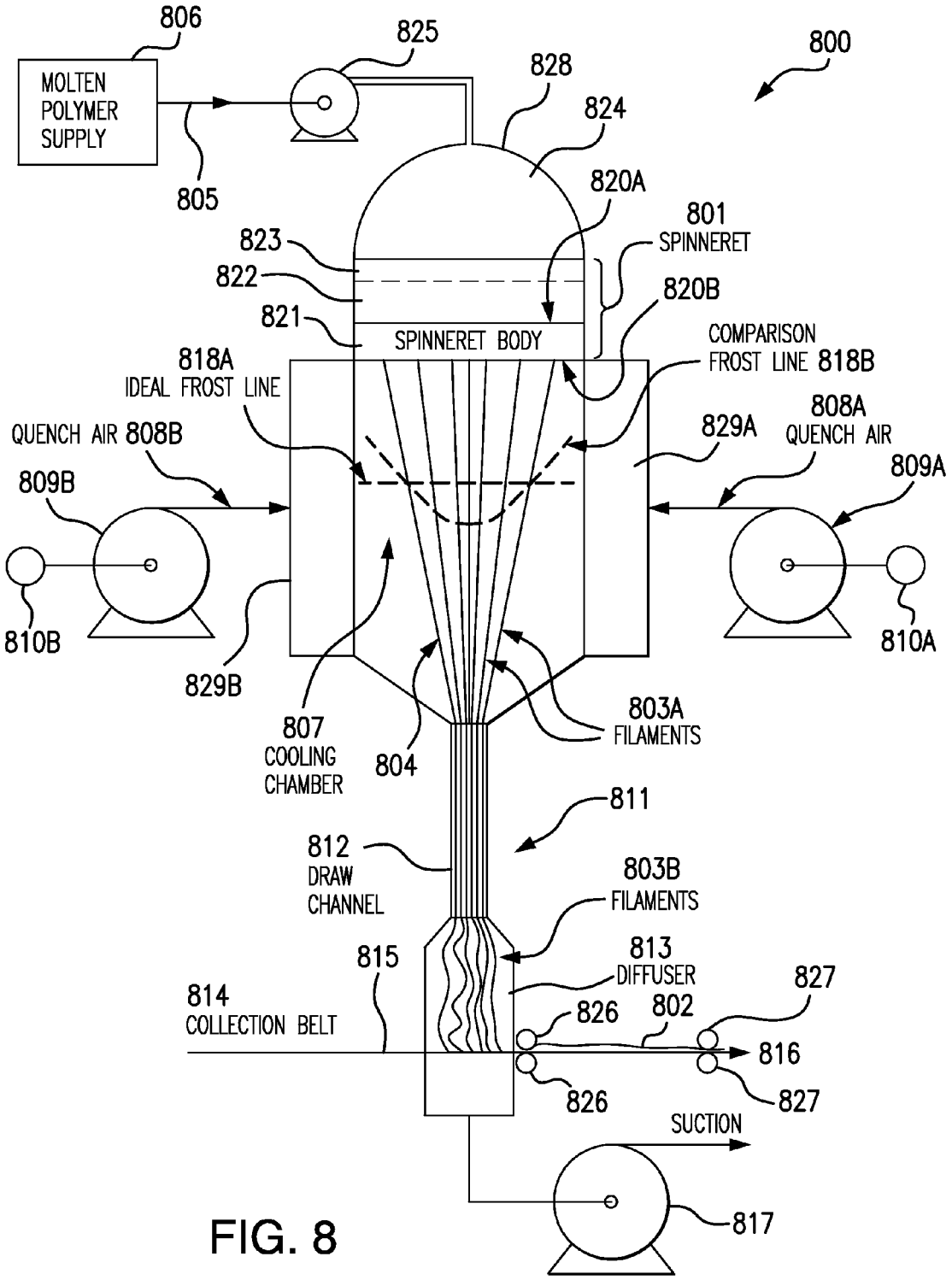
FIG. 8 is a schematic cross section view of an apparatus which uses a spinneret in accordance with an embodiment of the invention.

Arrows are included in FIG. 3 which show cross flow directions of quench air 393 and 394 which can be used relative to the layout of capillary zones of the spinneret, when the spinneret is used in a melt spinning apparatus, such as described in more detail with respect to other figures herein (e.g., FIG. 8). As explained herein, the quench air is arranged to flow below the bottom face of the spinneret from which the filaments are extruded. The quench air can be fed in opposite cross-flowing directions towards the area beneath spinneret body 301 with one or a plurality of quench gas discharge outlets 391 and 392 arranged at each side of the spinneret body 301. To simplify the illustration, only several quench gas discharge outlets are shown in the figure, although more or less may be used as long as quench gas preferably is uniformly or substantially uniformly blown below the spinneret body 301 from opposite sides thereof with the respect to the entire width or substantial entire width of the spinneret body 301.

With respect to the dimensions of the capillaries of spinneret body 301, the orifices 203 and first capillaries 231 of zone 211 of spinneret body 201 shown in FIG. 2A and exemplified herein also can be representative of and the same for the orifices 303 and first capillaries 351 of the first zone 311 and the indicated structures and dimensions thereof in spinneret body 301 shown in FIG. 3. The orifices 203 and second capillaries 232 of zone 221 of spinneret body 201 shown in FIG. 2B and exemplified herein also can be representative of and the same for the orifices 303 and the second and third capillaries 352 and 353 of the second and third zones 321 and 322 and the indicated structures and dimensions thereof of spinneret body 301 shown in FIG. 3. The capillary dimensions of capillaries in zones 331, 332, 341, and 342 of FIG. 3 are described in greater detail with reference made to FIGS. 4A and 4B.

Figures 4A, 4B, 5A, 5B, 5C:
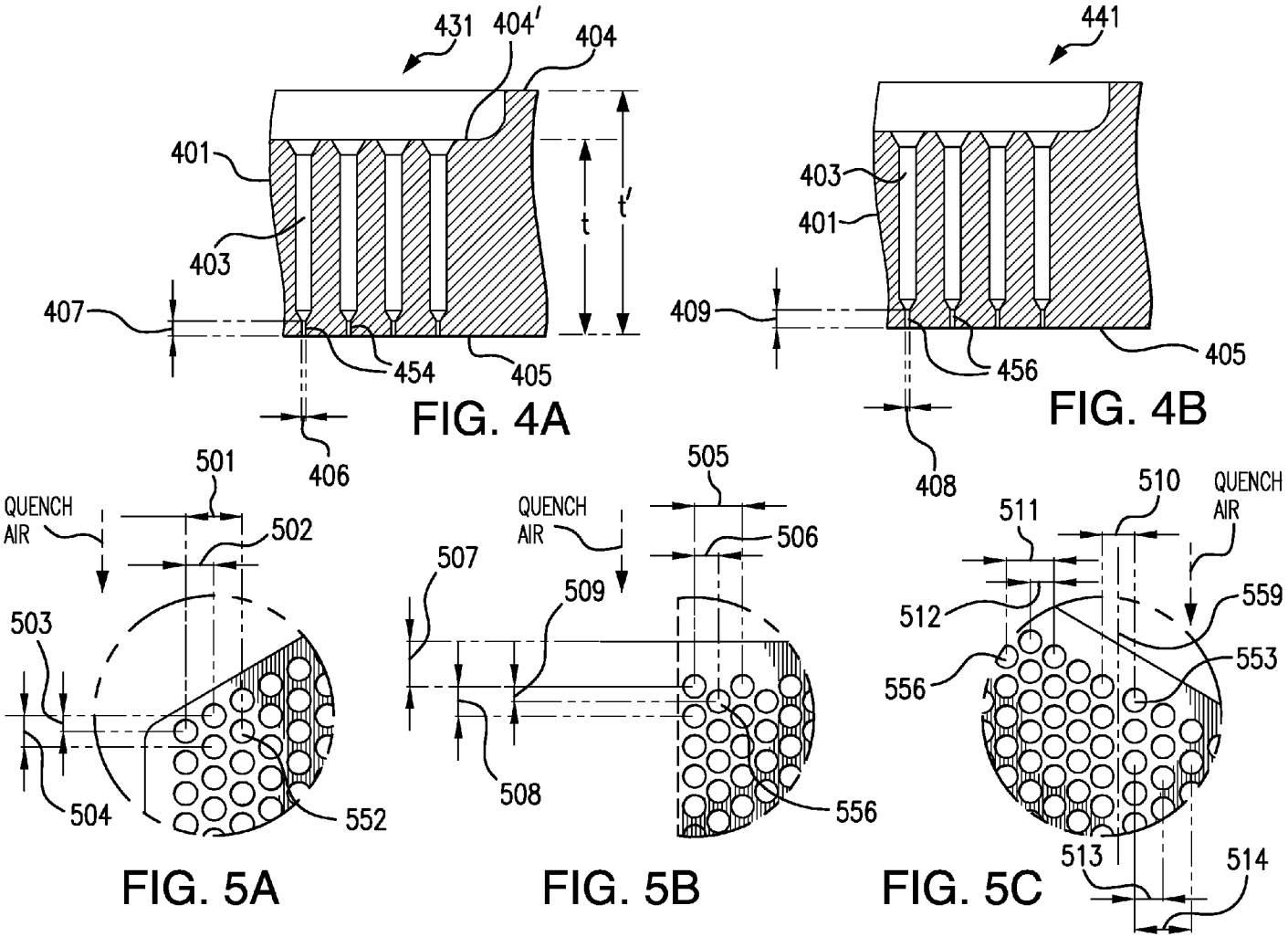
FIG. 4A is an enlarged cross section view of capillaries of a zone of the spinneret along line 4-4 of FIG. 3 in accordance with an embodiment of the present invention.
FIG. 4B is an enlarged cross section view of capillaries of a zone of the spinneret along line 4'-4' of FIG. 3 in accordance with an embodiment of the present invention.
FIGS. 5A, 5B, and 5C are enlarged plan views of several spinneret edge areas of FIG. 3 in accordance with an embodiment of the present invention.

As shown in more detail in FIG. 4A, the orifices 403 (303) extend through the thickness t of the spinneret body 401 (301) from a top face 404' of the spinneret body 401 (301), which is opposite to the bottom face 405 (305) of the spinneret body 401 (301). In this illustration, and although not required, the top face 404' of the spinneret body 401 where the orifices 403 are formed and present away from an edge face portion 404 thereof, is slightly recessed. The outer edge portion 404 of the spinneret body 401 can have a thickness t'. The fourth capillaries 454 (354) of the fourth zone 431 (331) individually can have a fourth hydraulic diameter 406 and a fourth length 407. The hydraulic diameter indicated in FIG. 4A is for a circular cross-sectional shape. A fourth length to hydraulic diameter ratio can be calculated or otherwise determined for these fourth capillaries 454 using the formulas herein. For circular cross-sectional shaped capillaries, for example, $D_H$ and $L/D_H$ ratio values, can be readily calculated from these length and hydraulic diameter dimensional values. FIG. 2C, described above, illustrates a cross-sectional area of such circular cross-sectional shaped capillaries. $L/D_H$ ratio values also can be determined for the circular cross-sectional shaped capillaries in accordance with the calculations described herein. As indicated, the cross-sectional area (CA) values of other cross-sectional shapes of capillaries can be determined in any convenient manner, and hydraulic diameter values are determined by the indicated formula as defined herein. In an embodiment, the orifices 403 (303) and fourth capillaries 454 (354) of zone 431 (331) shown in FIG. 4A and exemplified herein also can be representative of and the same for the orifices 303 and fifth capillaries 355 of the fifth zone 332 and the indicated structures and dimensions thereof, for the spinneret body 301 shown in FIG. 3. As shown in FIG. 4B, the sixth capillaries 456 (356) of the sixth zone 441 (341) of spinneret body 401 individually can have a sixth hydraulic diameter 408 and a sixth length 409. The hydraulic diameter indicated in FIG. 4B is for a circular cross-sectional shape. A sixth length to hydraulic diameter ratio ($L/D_H$) can be calculated or otherwise determined for these sixth capillaries 456. Hydraulic diameter values are determined by the indicated formula as defined herein and $L/D_H$ ratio values can be calculated. In an embodiment, the orifices 403 (303) and sixth capillaries 456 (356) of zone 441 (341) shown in FIG. 4B and exemplified herein also can be representative of and the same for the orifices 303 and seventh capillaries 357 of the seventh zone 342 and the indicated structures and dimensions thereof for the spinneret body 301 shown in FIG. 3.

FIGS. 5A, 5B and 5C are enlarged plan views of several indicated spinneret edge areas 5A, 5B, and 5C, respectively, indicated in FIG. 3. Dimensions 501-514 indicate various pitch distances and relationships between adjacent rows of capillaries in these different edge areas of the spinneret body 301. As used herein, "pitch" refers to the linear center-to-center distance of two adjacent capillaries. The direction of quench air is included similar to that shown in FIG. 3. FIG. 5A shows these features for an edge area 5A including capillaries 552, which correspond to capillaries 352 of zone 321 of spinneret 300 as shown in FIG. 3, as the only type of capillaries in the indicated area of the second zone 321 of FIG. 3. FIG. 5B shows these features for an edge area 5B including capillaries 556, which correspond to capillaries 356 of zone 341 of spinneret 300 as shown in FIG. 3, as the only type of capillaries in the indicated area in sixth zone 341 of FIG. 3. FIG. 5C shows these features for an edge area 5C including both capillaries 556, which are the capillaries located on the left-hand side of imaginary divider line 559, which correspond to capillaries 356 of zone 341 of spinneret 300 as shown in FIG. 3, and capillaries 553, which are the capillaries located on the right-hand side of imaginary divider line 559, which correspond to capillaries 353 of zone 322 of spinneret 300 as shown in FIG. 3, as the types of capillaries used in the indicated area that transitions in tapered portions of the sixth zone 341 to the third zone 322 of spinneret 300. In FIG. 5A, the pitch 502 of the capillaries in adjacent rows of capillaries that are aligned with the direction of the quench air, such as indicated in FIG. 3, can be the same or different (e.g., smaller) than the pitch 504 of capillaries in adjacent rows that are oriented in an orthogonal direction to the direction of the quench air. Distance 501 is a dimension of the pitches of three adjacent capillaries, and distance 503 shows a dimension of capillaries in adjacent rows. In FIG. 5B, the pitch 506 of the capillaries in adjacent rows of capillaries that are aligned with the direction of the quench air, such as indicated in FIG. 3, can be the same or different (e.g., smaller) than the pitch 508 of capillaries in adjacent rows that are oriented in an orthogonal direction to the direction of the quench air. Distance 505 is a dimension of the pitches of three capillaries in adjacent rows, and distance 509 shows a dimension of capillaries in adjacent rows, and distance 507 shows a dimension from an outer capillary of the pattern to an edge of the spinneret body. In FIGS. 5A and 5B, the pitch 502 (of zone 321 of spinneret 300 in FIG. 3) can be greater than pitch 506 (of zone 341 of spinneret 300 in FIG. 3), and pitch 504 can be greater than pitch 508, or other values. In FIG. 5C, the pitch 510 between the capillaries in adjacent rows of different capillaries 556 and 553 (of different zones 341 and 322 of spinneret 300 in FIG. 300) can be greater than each of pitch 512 (which can be the same value as pitch 506 in FIG. 5B) and the pitch 513 (which can be the same value as the pitch 502 in FIG. 5A). Distance 511 is a dimension of the pitches of three capillaries in adjacent rows among capillaries 556, and distances 513 and 514 show dimensions of other capillaries in adjacent rows among capillaries 553. Other pitch values for the dimensions indicated in FIGS. 5A, 5B, and 5C can include those illustrated in the examples included herein.

Referring again to the spinneret shown in FIG. 3, as indicated, in one embodiment thereof the two zones 321 and 322 (or "zones A") located at both ends of the spinneret body, in its width direction ω, can comprise capillaries that have the same hydraulic diameter and length. The zones 341 and 342 (or "zones B"), zones 331 and 332 (or "zones C"), and zone 311 (or zone "D") located between zones 321 and 322 can comprise capillaries that have progressively smaller capillary exit hydraulic diameters (and/or diameters for circular cross-sectional shaped capillaries) and lengths moving in the direction α from the outer zones 341 and 342 towards the central zone 311. For example, the capillaries of zone 311 can have smaller hydraulic diameters (and/or diameters for circular cross-sectional shaped capillaries) and lengths than those of zones 331 and 332, and in turn, the capillaries of zones 331 and 332 can have smaller hydraulic diameters (and/or diameters for circular cross-sectional shaped capillaries) and lengths than those of zones 341 and 342. The length to hydraulic diameter ratios of the capillaries in zones 341 and 342, zones 331 and 332, and zone 311 located between zones 321 and 322 also can become progressively smaller when moving zone-to-zone in the direction α from the outer zones 341 and 342 towards the central zone 311. The zones 341 and 342 can be made of a plurality of longitudinal rows of capillaries which have a length and an exit hydraulic diameter (and/or diameter for circular cross-sectional shaped capillaries) that are less than the capillaries of the end zones 321 and 322. In this example, since the capillary hydraulic diameters (and/or diameters for circular cross-sectional shaped capillaries) and lengths of zones 341 and 342 are less than those of the capillaries of the end zones 321 and 322, the inner zones 331, 332, and 311 have capillaries that are even smaller in hydraulic diameters (and/or diameters for circular cross-sectional shaped capillaries) and lengths as compared to those of the end zones 321 and 322. In an embodiment, each of the zones 311, 321, 322, 331, 332, 341, and 342 can comprise a plurality of longitudinal rows of the capillaries, which all have the same exit hydraulic diameter (and/or diameter for circular cross-sectional shaped capillaries) and length for the capillaries that are located within the same zone thereof. Zones 321, 322, 341, and 342 can have the tapered shape or partial tapered shape as illustrated to minimize the impact of air turbulence and quench deficiencies experienced near the ends of the spinneret. As an option, zones 321 and 322 do not extend up to an area where the number of capillaries per vertical row becomes constant in the non-tapered portions of zones 341 and 342, zones 331 and 332, or zone 331. As indicated, the capillary density for zones 321 and 322 can be lower than for the rest of the spinneret and may be approximately similar to the density used for some commercial spinnerets (e.g., about 6800 capillaries per meter of width of the face of the spinneret body). As indicated, the remaining zones in this illustration of zones 311, 331, 332, 341, and 342 can have the same capillary density value. In the illustrated embodiment, the zones 341, 342, 321, and 322 are the zones located toward the outside of spinneret and first ones affected by the incoming cross-flows of quench air, such as shown in FIG. 3. As an option, portions of nonwoven fabrics that are extruded from the end zones 321 and 322 of the spinneret 300 can be trimmed from nonwoven fabrics produced using the spinneret or they can be retained in the products. Trimming of the portions of nonwoven fabrics that are extruded from the end zones 321 and 322 of the spinneret 300 may be desirable where those fabric portions are inferior to the remaining portions of the nonwoven fabric produced by extrusion of filaments from zones 311, 331, 332, 341, and 342. As an option, additional zones of capillaries can be included in the spinneret body 301 which follow these described arrangements.

The sum of the capillary openings per meter width at a face of the spinneret body can be, for example, at least 3000, or at least 4000, or at least 5000, or at least 6000, or at least 6500, or at least 7000, or at least 7500, or at least 8000, or at least 9000, or at least 9500, or at least 10000, or other values. By increasing the overall number of capillaries per meter width of the spinneret body in a spinneret of the present invention as compared to a spinneret having a single design of capillary, for example, higher throughput can be allowed. More uniform quenching of the filaments also may be allowed, causing less variability in frost line distance from the spinneret body to the fiber collection surface. In that regard, the dimensions of the capillaries for each zone can be selected based on the features of hydraulic diameter, and length selected to maintain a uniform throughput (e.g., in grams per hour per meter, which is also referred to herein as "ghm" or "grams/hour/meter") based on shear stress ($T_{cw}$). Generally, hydraulic diameter of the capillaries decreases going from the outer zones toward the inner zones at the face of the spinneret body to increase the exit filament speed and reduce the initial filament diameter as the zone is closer to the center of the spinneret body in a dual opposing cross-direction quench gas configuration as described herein. Based on experimental results such as described herein, it is believed that using smaller hydraulic diameter capillaries further away from the quench gas discharge outlet can improve the heat transfer from the filament, therefore compensating in part for any higher air temperature and lower air volume expected toward the middle of the spinneret body in a dual opposing cross-directional quench gas configuration. For cross-flow quench designs, for example, a spinneret with different zones having capillaries of different dimensions can be provided, for example, wherein the capillary length, the hydraulic diameter, and the capillary length to hydraulic diameter ratio of the capillaries is reduced progressively going from the outer zones facing the incoming streams of quench air that flow in opposite directions from the outer zones toward the inner and central zone(s). This reduction can be provided zone-to-zone in successive adjacent zones of the capillaries in the spinneret body for at least two zones, and in some embodiments in at least three, four, five, six, seven, or more zones. This can be done to improve quenching toward the middle of the face of the spinneret body and therefore can allow an increase in overall polymer throughput in ghm or improvement in fabric uniformity (e.g. more uniform fibers at equivalent polymer throughput). The capillary length and hydraulic diameter for the capillaries of different zones can be selected based on shear stress ($T_{cw}$) in order to produce even polymer throughput from one zone of capillaries to another one. For purposes herein shear stress is defined as $T_{cw}=\Delta P_c\ D_{Hc}/4L_c$. As pressure drop is assumed to be constant across the length of each capillary and across the face of the spinneret body and solving this equation for ΔP, then $T_{cwa}\ L_{ca}/D_{Ha}=T_{cwb}\ L_{cb}/D_{Hb}=T_{cwc}\ L_{cc}/D_{Hc}$, where $T_{cwx}$ (e.g., $T_{cwa}$, $T_{cwb}$, $T_{cwc}$) is shear stress as obtained from the rheology curves for capillary X having a hydraulic diameter $D_{Hx}$ (e.g., $D_{Ha}$, $D_{Hb}$, $D_{Hc}$), and where $L_{Cx}$ (e.g., $L_{ca}$, $L_{cb}$, $L_{cc}$) is the length of the capillary and ΔP is the pressure drop across the capillary. As the shear stress changes with capillary hydraulic diameter the capillary length can be adjusted to keep the expression ($Tc_{wx}*Lc_x/D_{Hx}$) constant among the different capillary designs. As an option, for circular cross-sectional shaped capillaries, the combination of length to hydraulic diameter ratio for the capillaries can be arranged such that the $Tc_{wx}*L_{cx}/D_{Hx}$ expression is kept constant or within ±35, or ±30, or ±25, or ±20%, or ±15, ±10%, ±5%, or ±3% or ±1%, of the same based on the indicated equation that can be used to design the capillary zones at the face of the in the spinneret body.

These principles also can be adapted to the design of capillaries and capillary zones at the face of the spinneret body of spinnerets of the present invention which can be used in single side quench gas modalities. For example, for single side quench gas modalities, a spinneret body having a face with different zones having capillaries of different dimensions can be provided, for example, wherein the capillary length, the hydraulic diameter, and the capillary length to hydraulic diameter ratio of the capillaries is reduced progressively going from the outer zone nearest the incoming quench gas discharge outlet toward the capillaries located closer to the opposite side of the spinneret body and further away from the quench gas source. This progressive reduction can be provided zone-to-zone in successive adjacent zones of the capillaries at the face of the spinneret body for at least two zones, and in some embodiments of the present invention in at least three, four, five, six, seven, or more zones.

It will be understood that the end zones 321 and 322 of the spinneret body 301 shown in FIG. 3 can have larger capillary dimensions than capillaries of other zones at the face of the spinneret body that are located closer to quench gas discharge outlet(s) because of capillary design modifications made for possible wall effects. It also will be understood that the end zones 321 and 322 of the spinneret body 301 shown in FIG. 3 can have reduced capillary density than capillary densities of other zones at the face of the spinneret body that are located closer to quench gas discharge outlet(s) because of capillary design modifications made for possible wall effects. Wall effects include, but are not limited to, additional turbulence and modified quench gas flow due to interference of the walls (not shown in the Figures) at the edges of the spinneret body in the w direction. That is, the spinneret body 301 in FIG. 3 has an elongated octagonal perimeter shape wherein the end zones 321 and 322 taper down in the width direction ω moving away from geometric center 315. Due to wall effects, the capillaries of end zones 321 and 322 in this illustration can have hydraulic diameters and lengths which are larger than hydraulic diameters and lengths of the capillaries in zones 341 and 342 even though zones 341 and 342 are closer to the quench gas discharge outlet, in use, than the end zones 321 and 322. As used herein, "wall effect(s)" refers to the use of a cooling chamber directly beneath the spinneret body which defines walls that cause turbulence in the flow of quench gas, such as air, near the walls. This wall effect turbulence can cause small filaments spun into these regions from the end zones of the spinneret body to move around and create nonuniformity in side portions of the web produced from the system. These nonuniform side portions may be trimmed off the product or retained. Despite the possible nonuniform side web portions generated, the end zones 321 and 322 can be used to minimize the extent of the wall effect on quench gas flow into the filament bundle by serving as a buffer to the turbulent flow areas near the walls. The end zones 321 and 322 can help to keep throughput uniform across the face of the spinneret body. The end zones 321 and 322 alternatively can be replaced by capillary-free portions at the face of the spinneret body near the walls to reduce wall effect(s). The inclusion of the indicated end zones that produce filaments may be preferable for providing a more effective buffer to the wall effects for the filaments produced from capillaries located closer to the middle of the face of the spinneret body. If a cooling region for the filaments is used that does not involve a chamber that defines walls adjacent to the sides of the spinneret body, then the need for the end zones can be reduced or eliminated as the quench gas flow can be more uniform along the entire width of the face of the spinneret body.

Spinneret and spinneret body polymer throughput in the invention can be provided for processing thermoplastic polymers, such as polyolefins, at values of at least about 15,000 grams per hour per meter width of the face of the spinneret body (i.e., "ghm"), or at least about 25,000 ghm, or at least about 50,000 ghm, or at least about 75,000 ghm, or at least about 100,000 ghm, or at least about 150,000 ghm, or at least about 200,000 ghm, or at least about 250,000 ghm, or at least about 300,000 ghm, or from about 15,000 to about 1,000,000 ghm, or from about 25,000 to about 800,000 ghm, or from about 50,000 to about 700,000 ghm, or from about 75,000 to about 700,000 ghm, or from about 100,000 to about 600,000 ghm, or from about 150,000 to about 500,000 ghm, or from about 150,000 to about 400,000 ghm, or from about 200,000 to about 350,000 ghm, or other values. The "width" associated with ghm is measured in the w direction of the face of the spinneret body such as shown in FIGS. 1, 2L, 3, 6, and 7 herein. A spinneret body can be provided which produces filaments having reduced filament diameter variability, such as a standard deviation of fiber diameter distribution that is less than about 35%.

It should also be noted that the strategy used to adjust the capillary length in function of the capillary hydraulic diameter assumes negligible effect from the entrance geometry to the capillary. However, if that entrance geometry is selected such as to have a non-negligible effect, it can be taken into consideration in the calculation and/or can be used in lieu or in part to compensate for the change in capillary hydraulic diameter. For example, the angle of the counterbore may affect the flow rate (e.g., a tighter angle might have the same effect as lengthening the capillary). In other words, generally, it is assumed that the hydraulic diameter is the same at the capillary opening entrance as at the capillary opening exit at the face of the spinneret body and for the length of the capillary therebetween. However, it is believed that for spinneret bodies of the invention that do not have capillaries having this uniform capillary diameter along its length, then this lack of uniformity can be taken into consideration in the design of the zones and capillaries therein at the face of the spinneret body.

Figure 6:
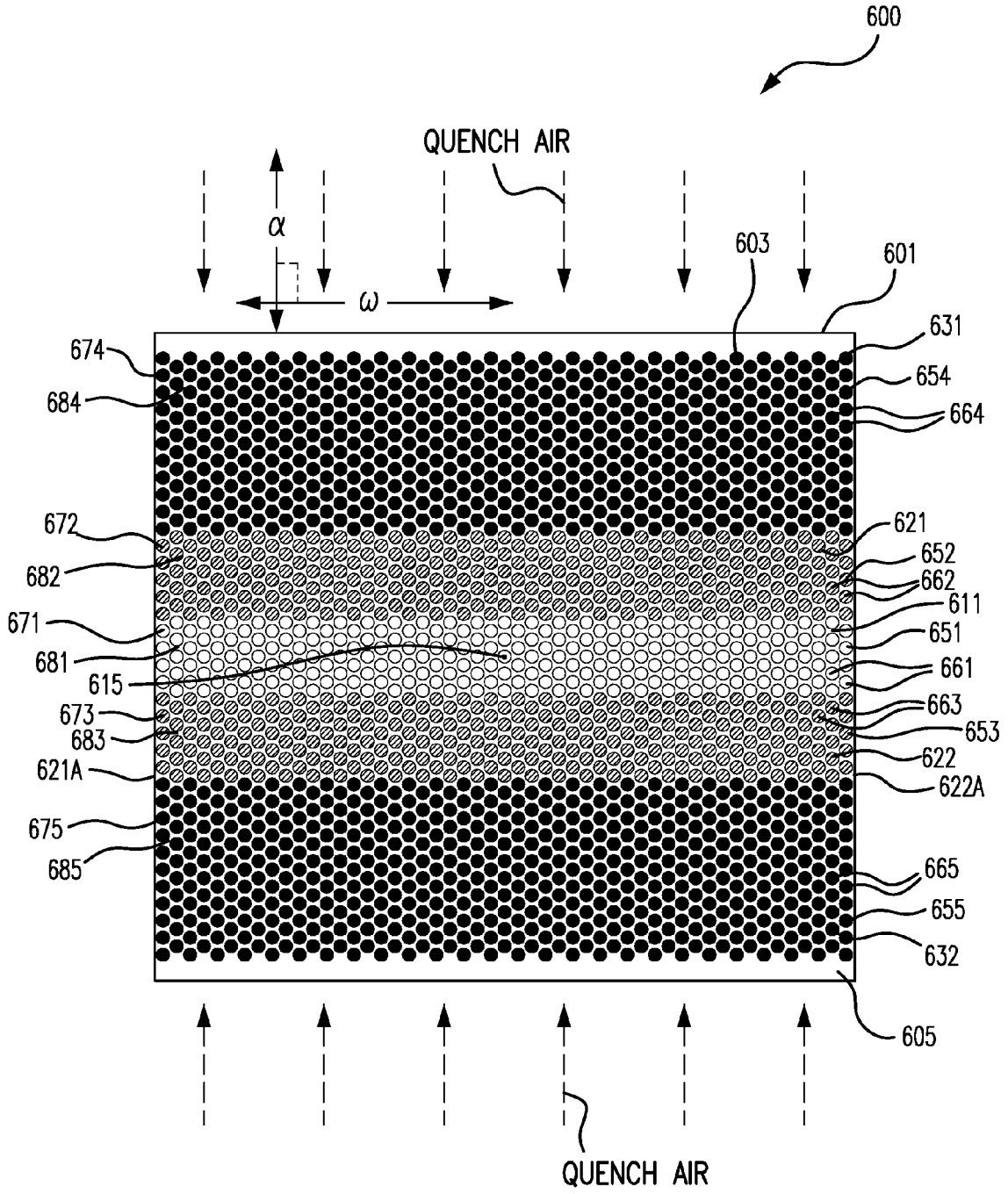
FIG. 6 is a bottom plan view of a multi-zone spinneret in accordance with another embodiment of the invention.

FIG. 6 is a bottom plan view of a multi-zone spinneret 600 of another embodiment of the present invention, which can be used for opposing cross-direction flow (i.e., dual side) gas quench modalities of operation. The spinneret has a spinneret body 601 that defines orifices 603 in five zones 611, 621, 622, 631, and 632 that extend through the spinneret body 601. First or central zone 611 comprises first capillaries 651, second and third zones 621 and 622 comprise second and third capillaries 652 and 653, and fourth and fifth zones 631 and 632 comprise fourth and fifth capillaries 654 and 655. The capillaries 651, 652, 653, 654, and 655 open at a bottom face 605 of the spinneret body 601 from which polymer filament extrusions occur downwardly. In FIG. 6, the orifices and/or capillaries of the different zones are differentiated from each other for purposes of this description by arbitrarily added markings, such as empty circles for zone 611, diagonal striped circles for zones 621 and 622, and solid circles for zones 631 and 632, all of which markings are not part of the actual spinneret body 601 structure. The first capillaries 651 of first zone 611 are arranged in a plurality of different first rows 661 at the face 605 of the spinneret body 601. Similarly, the capillaries 652 and 653 of second and third zones 621 and 622 are arranged in a plurality of different second and third rows 662 and 663, and the capillaries 654 and 655 of fourth and fifth zones 631 and 632 are arranged in a plurality of different fourth and fifth rows 664 and 665. Arrows are included in FIG. 6 which show cross flow directions of quench gas (e.g., air) which can be used relative to the layout of capillary zones at the face 605 of the spinneret body 601, when the spinneret is used in a melt spinning apparatus, such as described in more detail with respect to other figures herein (e.g., FIG. 8).

The plurality of different rows 661, 662, 663, 664, and 665, are arranged into the indicated plurality of different zones 611, 621, 622, 631, and 632. The first zone 611 is located between the zones 621 and 622 in the direction $\alpha$ on the face 605 of the spinneret body 601 that is oriented orthogonally to the width direction $\omega$ on the face of the spinneret body 601, and zones 621 and 622 are located between zones 631 and 632 in the direction $\alpha$ of the face 605 of the spinneret body 601. The first zone 611 is located closer to an imaginary geometric center 615 of the face 605 of the spinneret body 601 than the other zones 621, 622, 631, and 632. The first capillaries 651 of the first zone 611 individually have a first cross-sectional shape 671. The first rows 661 of the capillaries 651 of the first zone 611 are arranged in a first capillary density 681. The second capillaries 652 of the second zone 621 individually have a second cross-sectional shape 672. The rows 662 of the capillaries 652 of the zone 621 are arranged in a second capillary density 682. The third capillaries 653 of the third zone 622 individually have a third cross-sectional shape 673. The rows 663 of the capillaries 653 of the zone 622 are arranged in a third capillary density 683. The fourth capillaries 654 of the fourth zone 631 individually have a fourth cross-sectional shape 674. The rows 664 of the capillaries 654 of the zone 631 are arranged in a fourth capillary density 684. The fifth capillaries 655 of the fifth zone 632 individually have a fifth cross-sectional shape 675. The rows 665 of the capillaries 655 of the fifth zone 632 are arranged in a fifth capillary density 685. In an embodiment, the capillaries can be equispaced within a given row for all or substantially all of the rows. In an embodiment, the adjacent rows of capillaries can be equispaced for all or substantially all of the rows relative to the width direction $\omega$ of spinneret body 601, or orthogonal direction $\alpha$, or both.

The cross-sectional shapes of the indicated capillaries shown in FIG. 6 also are based on the exit opening geometry of the capillaries at the face 605 of the spinneret body 601. As shown in figures described herein, the cross-sectional shape of these capillaries can extend at least partly through the thickness of the spinneret body in which the capillaries have been defined. The cross-sectional shapes of the capillaries also are shown to be circular in this figure. As indicated, other geometries can be used for the cross-sectional shapes of the capillaries. In an embodiment, all the zones of the spinneret body 601 contain capillaries that have the same capillary cross-sectional shape, albeit with variations in the capillary dimensions (other than cross-sectional shape) of the capillaries in one or more of the different zones of capillaries as described herein. In an embodiment, the capillary densities 681, 682, 683, 684, and 685 of the first, second, third, fourth, and fifth zones 611, 621, 622, 631, and 632 can be the same or different. In one embodiment, they are the same. The total linear width of the spinneret body 601 shown in FIG. 6 can be determined based on the linear distance in the linear width direction ω between ends 621A and 622A of the spinneret body 601. The spinneret body 601 can be a similar construction and can be manufactured in a similar manner as indicated herein for the spinneret body of FIGS. 1 and 3. In FIG. 6, the spinneret body 601 has a rectangular periphery shape, and the overall layout of zones of capillaries 631, 621, 611, 622, and 632 has an overall rectangular shaped periphery. Other spinneret body periphery shapes may also be used for this or other embodiments. Such shapes may include, but not be limited to, polygonal, circular, elliptical, oval, trapezoidal, and combinations thereof With respect to the dimensions of the orifices and capillaries of spinneret body 601, the orifices 203 and first capillaries 231 of zone 211 of spinneret body 201 shown in FIG. 2A and exemplified herein also can be representative of and the same for the orifices 603 and first capillaries 651 of the first zone 611 and the indicated structures and dimensions thereof for the spinneret body 601 shown in FIG. 6. The orifices 403 and fourth capillaries 454 of zone 431 of spinneret body 401 shown in FIG. 4A and exemplified herein also can be representative of and the same for the orifices 603 and the second and third capillaries 652 and 653 of the second and third zones 621 and 622 and the indicated structures and dimensions thereof in spinneret body 601 shown in FIG. 6. The orifices 403 and sixth capillaries 456 of zone 441 of spinneret body 401 shown in FIG. 4B and exemplified herein also can be representative of and the same for the orifices 603 and the fourth and fifth capillaries 654 and 655 of the fourth and fifth zones 631 and 632 and the indicated structures and dimensions thereof in spinneret body 601 shown in FIG. 6. The zones 631 and 632, zones 621 and 622, and zone 611 can comprise capillaries that have progressively smaller capillary opening exit hydraulic diameters, lengths, and length to hydraulic diameter ratios when moving from zone-to-zone in the direction α from the outermost zones 631 and 632 inward towards zones 621 and 622 and then the central zone 611, in that order, with these zones arranged such as shown in FIG. 6. As an option, additional zones of capillaries can be included in the spinneret body 601 which follow these described arrangements.

Figure 7:
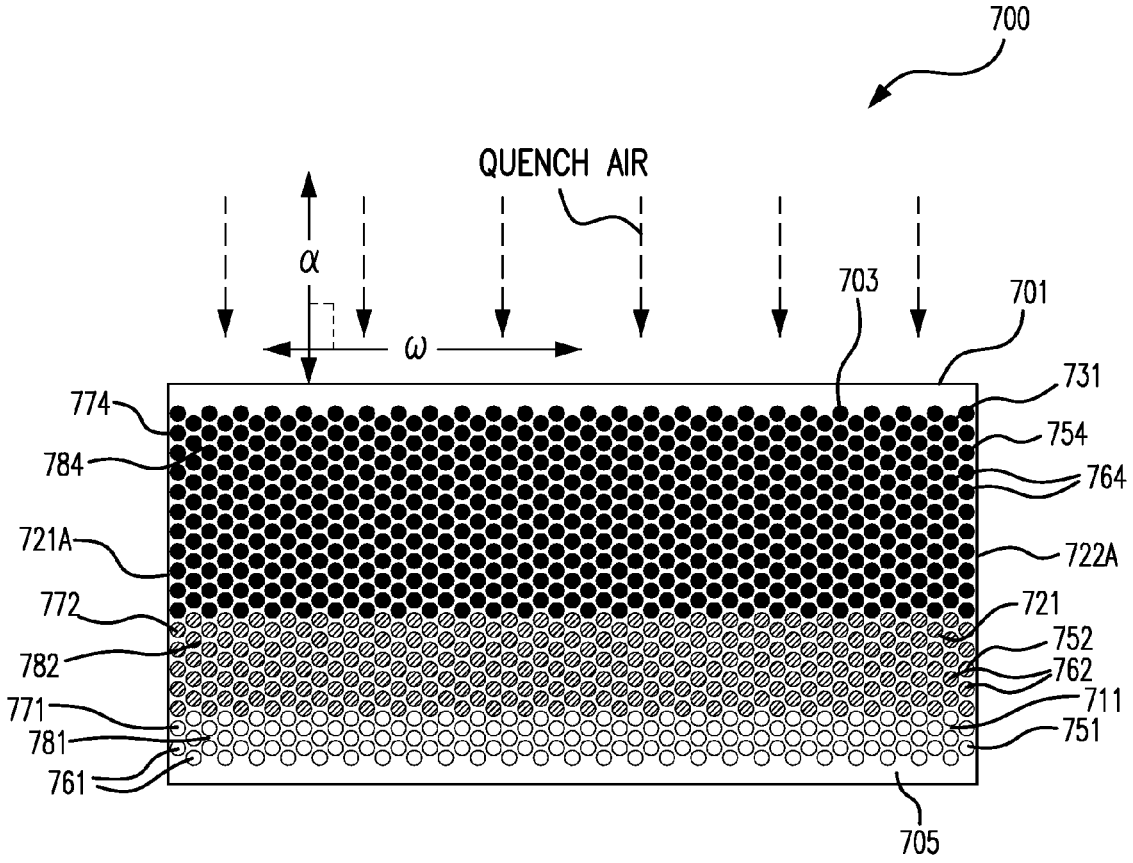
FIG. 7 is a bottom plan view of a multi-zone spinneret in accordance with another embodiment of the invention.

FIG. 7 is a bottom plan view of a multi-zone spinneret 700 of another embodiment of the present invention, which can be used for single side quench gas modalities of operation. The spinneret has a spinneret body 701 that defines orifices 703 in three zones 711, 721, and 731 that extend through the spinneret body 701. First or central zone 721 comprises first capillaries 752, second zone 731 comprises second capillaries 754, and third zone 711 comprises third capillaries 751. The capillaries 751, 752, and 754 open at a bottom face 705 of the spinneret body 701 from which polymer filament extrusions occur downwardly. In FIG. 7, the orifices and/or capillaries of the different zones are differentiated from each other for purposes of this description by arbitrarily added markings, such as empty circles for zone 711, diagonal striped circles for zone 721, and solid circles for zone 731, and all of such markings are not part of the actual spinneret structure. The first capillaries 752 of first zone 721 are arranged in a plurality of different first rows 762 at the face 705 of the spinneret body 701. Similarly, the capillaries 754 of second zone 731 are arranged in a plurality of different second rows 764, and the capillaries 751 of the third zone 711 are arranged in a plurality of different third rows 761. Arrows are included in FIG. 7 which show a single side flow direction of quench air which can be used relative to the layout of capillary zones of the spinneret 700, when the spinneret 700 is used in a melt spinning apparatus, such as described in more detail with respect to other figures herein (e.g., FIG. 8).

The plurality of different rows 761, 762, and 764, are arranged into the indicated plurality of different zones 711, 721, and 731. The first zone 721 is located between zones 731 and 711 at the face 705 in the direction α of the face 705 of spinneret body 701 that is oriented orthogonally to the width direction ω of the face 705 of spinneret body 701. The first zone 721 is located closer to the quench air source than third zone 711, and the second zone 731 is located closer to the quench air source than the first zone 721. The first capillaries 752 of the first zone 721 individually have a first cross-sectional shape 772. The rows 762 of the capillaries 752 of the zone 721 are arranged in a first capillary density 782. The second capillaries 754 of the second zone 731 individually have a second cross-sectional shape 774. The rows 764 of the capillaries 754 of the zone 731 are arranged in a second capillary density 784. The third capillaries 751 of the third zone 711 individually have a third cross-sectional shape 771. The third rows 761 of the capillaries 751 of the third zone 711 are arranged in a third capillary density 781. In an embodiment, the capillaries can be equispaced within a given row for all or substantially all of the rows. In an embodiment, the adjacent rows of capillaries can be equispaced for all or substantially all of the rows relative to the width direction ω of the face 705 of spinneret body 701, or orthogonal direction α, or both.

The cross-sectional shapes of the indicated capillaries shown in FIG. 7 also are based on the exit opening geometry of the capillaries at the face 705 of the spinneret body 701. As shown in figures described herein, the cross-sectional shape of these capillaries can extend at least partly through the thickness of the spinneret body 701 in which the capillaries have been defined. The cross-sectional shapes of the capillaries also are shown to be circular in this FIG. 7 illustration. As indicated, other geometries can be used for the cross-sectional shapes of the capillaries. In an embodiment, all the zones at the face 705 of the spinneret body 701 contain capillaries that have the same capillary cross-sectional shape, albeit with variations in the capillary dimensions (other than cross-sectional shape) of the capillaries in one or more of the different capillary zones as described herein. In an embodiment, the capillary densities 782, 784, and 781 of the first, second, and third zones 721, 721, and 711, respectively, can be the same or different. In one embodiment, they are the same. The total linear width of the spinneret body 701 shown in FIG. 7 can be determined based on the linear distance in the linear width direction ω between ends 721A and 722A of the face 705 of spinneret body 701. The spinneret body can be a metal plate construction or other rigid heat tolerant material. In FIG. 7, the spinneret body 701 has a rectangular shape defined by its periphery, and the overall array of capillary zones 731, 721, and 711 has an overall rectangular shape. Other spinneret body shapes also may be used for this embodiment. For example, this embodiment also may be applied to other polygonal shaped spinneret bodies, such as trapezoidal, square, octagonal, triangular, as well as circular, elliptical, oval, or other non-polygonal shapes.

With respect to the dimensions of capillaries of spinneret body 701, the orifices 203 and first capillaries 231 of zone 211 of spinneret body 201 shown in FIG. 2A and exemplified herein also can be representative of and the same for the orifices 703 and third capillaries 751 of the third zone 711 and the indicated structures and dimensions thereof for the spinneret body 701 shown in FIG. 7. The orifices 403 and fourth capillaries 454 of zone 431 of spinneret body 401 shown in FIG. 4A and exemplified herein also can be representative of and the same for the orifices 703 and the first capillaries 752 of the first zone 721 and the indicated structures and dimensions thereof in spinneret body 701 shown in FIG. 7. The orifices 403 and sixth capillaries 456 of zone 441 of spinneret body 401 shown in FIG. 4B and exemplified herein also can be representative of and the same for the orifices 703 and the second capillaries 754 of the second zone 731 and the indicated structures and dimensions thereof in spinneret body 701 shown in FIG. 7. The zone 731, zone 721, and zone 711 can comprise capillaries that have progressively smaller capillary exit hydraulic diameters, lengths, and length to hydraulic diameter ratios when moving from zone-to-zone in the direction $\alpha$ at the face 705 from the outermost zone 731 that is closest to the quench air source, towards zone 721 and then zone 711, in that order, with these zones arranged such as shown in FIG. 7. As an option, additional zones of capillaries can be included at the face 705 in the spinneret body 701 which follow these described arrangements.

FIG. 8 is a schematic cross section view of an apparatus 800 which uses a spinneret 801 to produce a meltspun nonwoven web or fabric 802 in accordance with an embodiment of the invention. The apparatus 800 can provide continuous manufacture of a meltspun web from extruded and aerodynamically stretched filaments made of a thermoplastic polymer. The apparatus 800 has a downwardly directed spinneret 801 for extruding hot thermoplastic filaments 803A that move downward along a flow path 804. The spinneret 801 can comprise a spinneret body 821 that has features such as illustrated in and described with respect to the preceding figures. The spinneret 801 can include, in addition to the spinneret body 821, a breaker plate 822 and filter(s) 823 overlying the spinneret body 821. The breaker plate and filters of the present invention can have conventional designs for these spinneret components. For example, the breaker plate can comprise an array of orifices that can even out the distribution of the polymer received from the die cavity (e.g., 824) before it reaches the spinneret 801. Molten polymer 805 can be fed from a molten polymer supply 806, such as a screw extruder, under pressure, which can be further increased and controlled by using a spin or gear pump 825, to a die cavity 824. In this illustration, the die cavity 824 is defined by a "coat-hanger" shaped enclosure 828 shown in FIG. 8. The polymer introduced to the die cavity 824 is fed to the top side of the spinneret 801, and from there passes under pressure through the filter(s) 823 and breaker plate 822 before reaching the top surface 820A of the spinneret body 821. A thermoplastic polymer, such as a polypropylene-based resin may be introduced into the polymer supply 806 and blended by any procedure that causes an intimate admixture of the resin and any additives. For example, the polymer resin and any additives may be blended in a continuous mixer or extruder, tumbler, static mixer, batch mixer, or a combination thereof. For example, the polymer supply 806 may include a continuous mixer, such as those known in the art, such as twin-screw mixing extruders, static mixers for mixing molten polymer streams of low viscosity, impingement mixers, and the like. As indicated, the polymer melt exiting die cavity 824 can be filtered in filters 823 and passed through breaker plate 822 to help evenly distribute the polymer before arriving at the spinneret body 821. The polymer passes through orifices and capillaries in the spinneret body 821, such as described herein, and emerges as filaments 803A from a bottom surface or face 820B of the spinneret body 821. Beneath and downstream of the spinneret 801, i.e., immediately below the bottom surface or face 820B of the spinneret body 821, is a cooling chamber 807. In this illustration, the cooling chamber 807 is supplied with streams of quench air 808A and 808B or other cooling gas in cross-flowing directions through the extruded filaments 803A in the cooling chamber 807 to cool or "quench" the filaments 803A in the cooling chamber 807. The streams of quench air 808A and 808B can be transmitted under pressure into the cooling chamber 807 using air compressors or fans 809A and 809B. The cooling chamber 807 can be a single compartment, or can be subdivided into multiple vertically arranged compartments (not shown), in which the filaments 803A are cooled with cooling process air at the same or at different temperatures coming from respective cooling air sources 810A and 810B. The quench air 808A and 808B can be passed through honeycomb structures 829A and 829B or similar quench air handling structures which help to ensure uniform laminar air flow across filaments 803A. Although FIG. 8 shows the quench air 808A and 808B across from each other at opposite sides of the cooling chamber 807 for convenience, it will be appreciated that the quench air 808A and 808B can be arranged so that each one feeds quench air from both sides of the cooling chamber 807, but at different vertical levels of the chamber 807. This can provide upper and lower quench zones in the cooling chamber 807 that may be independently controlled with respect to air flow rate and temperature. As an option, the quench air 808A and 808B are fed to the extruded filaments 803A at the same or substantially the same temperature. The quench gas (e.g., air) temperature that is used can vary, such as depending on the processed materials and process equipment and operational conditions. For example, the quench gas (e.g., air) temperature may be in the general range of from about 12° C. to about 25° C. when used for quenching thermoplastic filaments, such as polyolefin-based filaments or other types, after exiting a spinneret of the present invention. Other ranges of temperatures may be selected for different polymers. Quench air systems and discharge outlet arrangements thereof for spun filaments that may be adapted for use in the apparatus of the present invention include, but are not limited to, those known in the art, such as those shown in U.S. Pat. Nos. 4,820,142, 5,814,349, 6,918,750, and 7,762,800, which are incorporated herein by reference in their entireties. Downstream of the cooling chamber 807 is a filament attenuation unit 811, such as a narrow channel or slot into which the filaments 803A are directed from the cooling chamber 807, where a downward force is applied to the filaments 803A. For example, after exiting the spinneret, the molten fibers are quenched by a cross-flow air quench system, and then pulled away from the spinneret and attenuated (drawn) by high speed air. There are generally two methods of air attenuation, one is based on the difference in pressure between the cooling chamber and the atmosphere and the other use the venturi effect. The venture effect is generally applied by one of two methods where the first method attenuates the filaments using an aspirator slot (i.e., slot draw), which may run the width of the spinneret or the width of the cooling. The second method attenuates the filaments through a nozzle or aspirator gun. Other attenuation methods may be used. As another option, the filaments may be attenuated mechanically. As illustrated in FIG. 8, the attenuation unit 811 has a draw channel 812 defining a passage having vertical inner walls. The filaments 803B under the effect of air drag pass from the draw channel 812 into a diffuser 813 which has inner walls that diverge over at least a part of the downward length thereof. The filaments 803B encounter turbulence in the diffuser 813. Attenuated filaments 803B that have passed through the diffuser 813 are deposited on a continuously moving foraminous collection belt 814, which is used as a deposition surface for the meltspun web. The collection belt 814 can be, for example, an endless forming belt including a collection surface 815 wrapped around rollers (not shown) so the endless forming belt can be driven at least in part in the direction as shown by the arrow 816. An additional depositing unit known in the art may be used (not shown) for the deposition of the attenuated filaments 803B on the collection belt 814. At least one suction device 817 can be provided beneath the foraminous collection belt 814 and diffuser 813, to pull a vacuum and balance air by which filaments 803B can be deposited on foraminous collection belt 814. The collection belt 814 can move off in a horizontal direction indicated by the directional arrow 816 in FIG. 8 while carrying the deposited and collected nonwoven web 802. The speed of the belt 814 may be, for example, about 600 to about 700 meters per minute, or other values, such as depending on the polymer, system and process specifics. A pair of pressure rollers 826 can be used to apply pressure to the nonwoven web 802 while traveling on the belt 814 immediately after the web clears the diffuser 813. The web 802 also can be passed through calendering unit 827 (e.g., a heated patterned roll and an opposing heated smooth roll) to further consolidate the web into a fabric before further handling, storage, and use.

Although not desiring to be bound to theory, it is believed that the apparatus 800 using spinneret body 821 may allow provision of a frost line 818A that has a uniform or at least more uniform distance to the bottom face 820B of the spinneret body 821 in the indicated width direction (ω direction) of the spinneret body 821 than comparison frost line 818B' provided to represent a frost line where the spinneret includes only a single dimensional design of capillaries therein. The comparison frost line 818B extends downwardly or sags below the central area of the spinneret body 821, indicative of an uneven filament surface cooling and solidification through the bundle of extruded filaments 803A. The belt 814 can be used to carry away the web of attenuated filaments 803B to additional process stations or units, such as for at least one treatment among edge trimming (e.g., to remove the filaments extruded from any of the indicated zones A used in the spinneret), bonding, compressing, consolidating (e.g., hydraulic entangling, mechanical needling, stitching), convective or radiation heat welding, laminating, or other treatments that can be applied to nonwoven webs to make nonwoven fabrics. For example, filaments formed in this manner can be collected on a screen ("wire") or porous forming belt to form the web, and then the web may be further processed, for example, by passing the web through compression rolls and then between heated calendar rolls where the raised lands on one roll bond the web at points thereof to form a bonded nonwoven fabric. Some properties of the deposited and collected web 802, such as basis weight, can be controlled or further controlled by factors such as, but not limited to, one or more of spinning speed, mass throughput, temperature, polymer composition, or attenuating conditions. The general operation of such a meltspun forming apparatus which has been adapted to include a multi-zone spinneret as described herein can be within the ability of those of ordinary skill in the art in view of the descriptions and examples provided herein.

Suitable polymers to be used as the meltspun material in melt-spinning filaments can include any natural or synthetic polymer that is suitable for forming spunbond fibers such as polyolefin, polyester, polyamide, polyimide, polylactic acid, polyhydroxyalkanoate, polyvinyl alcohol, polyacrylates, viscose rayon, lyocell, regenerated cellulose, or any copolymers or combinations thereof. As a preferred option, the polymer is a thermoplastic polymer. As used herein, the term "polyolefin" includes polypropylene, polyethylene, polybutylene, and copolymers and combinations thereof. As used herein, the term "polypropylene" includes all thermoplastic polymers where at least 50% by weight of the building blocks used are propylene monomers. Polypropylene polymers also include homopolymer polypropylenes in their isotactic, syndiotactic or atactic forms, polypropylene copolymers, polypropylene terpolymers, and other polymers comprising a combination of propylene monomers and other monomers. As an option, polypropylenes, such as isotactic homopolymer polypropylenes made with Ziegler-Natta, single site or metallocene catalyst system, may be used as the polymer. Polypropylene, for example, may be used which has a melt flow rate (MFR) of from about 5 g/10 min. to about 400 g/10 min. or preferably from 15 to 45 g/10 min., or other values. With respect to polypropylene, MFR refers to the results achieved by testing the polymer composition by the standard test method ASTM D1238 performed at a temperature of 230° C. and with a weight of 2.16 kg. Optionally, other processing aids or performance ingredients or additives can be incorporated into the polymer or polymer resin compositions. Optional additives for the polymer or polymer resin can include, for example, pigments, viscosity modifiers, aromatics, antimicrobials, fire retardants, thermochromics, fluoro-chemistries, softness additives, and any combinations thereof. The optional additives can further be used to modify the processability and/or to modify physical properties of the nonwoven web or fabric or an article incorporating such web or fabric.

Nonwoven fabrics and webs made with the spinnerets and apparatus of the present invention can be used singly or in combination with similar or different materials. For example, the nonwoven webs made using the spinnerets and/or apparatus of the present invention can be combined with other materials such as compositionally different spunbond webs (S) or with different types of webs, such as but not limited to, meltblown webs (M), such as S, SS, SSS, SMS, SMMS, or other combinations thereof. One or more of the nonwoven webs or fabrics also can be combined with film materials. Suitable films in this respect can include, for example, cast films and extruded films and can further be selected from microporous films, monolithic films, and reticulated films. The multi-layer materials, if provided, can be consolidated or unified in known manners. The nonwoven webs and fabrics also can be used in a variety of articles that perform at least one function. For example, the nonwoven webs can be used alone or as a component or components of apparel, hygiene, home furnishings, health care, engineering, industrial, and consumer goods, or other articles. Articles can include, but are not limited to, surgical gowns, drapes, scrubs, face masks, caps, shoe covers, diapers, wipes, bandages, filters, geotextiles, bags, covers, wrappings, disposable clothing, acoustical system components, packaging, or other articles.

EXAMPLES

Test Methods

Basis Weight (BW)

Basis weight of the following examples was measured in a way that is consistent with ASTM D756 and EDANA ERT-40,3-90 test methods. The results were provided in units of mass per unit area in $g/m^2$ (gsm) and were obtained by weighing a minimum of ten 10 centimeter by 10 centimeter samples described in each of the Examples or Comparative Examples below.

Denier and DPF Determination

Denier is the mass in grams per 9,000 meters length of fiber. If individual filaments are used to form a nonwoven web, then denier is the same as denier per filament or DPF. Determining the average denier of individual filaments formed into a spunbond fabric is a common test for those knowledgeable in the art (for meltspun fibers, the diameter is typically between 10 and 50 microns). For circular cross-sectional shaped fibers, it typically involves measuring the width of the individual fibers using an optical microscope and, for such a circular fiber width is equal to the diameter. The measurement device is first calibrated using an acceptable standard (e.g., Optical grid calibration slide 03A00429 S16 Stage Mic 1 MM/0.01 DIV from Pyser-SGI Limited, Kent, UK or SEM Target grid SEM NIST SRM 4846 #59-27F). A common method to select fibers at random is to measure the width of fibers along a line drawn between two points set across the sample piece (a nonwoven web) being examined. This approach minimizes multiple measurements of the same fiber. For the examples described herein, 15 readings were done in 6 locations spread across the width of the samples, therefore providing a total of 90 data points per sample. That average fiber diameter is then converted into denier by using the following formula:

$$\text{Denier}=D^2*G*0.007069$$

where D is the average width or diameter of circular filaments expressed in microns and G is the polymer density at solid state expressed in grams per cubic centimeter. For polypropylene used in the examples, a density of 0.91 grams per cubic centimeter was used for the polymer density at solid state.

For filaments having a cross-section other than circular, another approach is to cut the filaments and examine their cross-section under a microscope. The area of the cross-section can be measured by different well known methods including the use of commercially available image analysis software. Knowing this fiber or filament cross-section area (CSA) in square microns, the denier can be calculated using the following formula:

$$\text{Denier}=\text{CSA}*0.009*G$$

where CSA is cross-section area of the filament in square microns, and G is the density of the polymer in grams per cubic centimeter.

Capillary Length, Cross-Sectional Area, Perimeter and Hydraulic Diameter

Capillary length and hydraulic diameter were used as indicated in the specification on the engineering drawing of the spinneret manufacturer. For circular capillaries, the capillary hydraulic diameter ($D_H$) and the capillary diameter ($D_c$), as indicated in the specification of the spinneret manufacturer, are the same as calculated herein; and capillary cross-sectional area $CA_c$, is calculated per the following equations:

$$D_c=\text{internal diameter of the capillary}$$

$$CA_c=\pi D_c^2/4 \text{ or } 3.1416*D_c^2/4.$$

A method to calculate cross-sectional (CA) and perimeter (CP) for a capillary having a cross-section that is circular or other than circular involves studying the capillary exit using a microscope and, more typically an optical microscope. As an example, for simple regular geometric shapes like a circle, a square, a rectangle or a triangle, one could use an optical microscope in combination with a calibration standard (e.g. Optical grid calibration slide 03A00429 Stage Mic 1 MM/0.01 DIV from Pyser-SGI Limited, Kent UK) to measure the key dimensions used to either calculate the perimeter or determine the capillary cross sectional area.

For more complex shapes like multi-lobal capillaries, an example of a method that can applied includes the use a microscope capable of capturing the image digitally and, using a software to analyze the image in order to calculate the perimeter and cross section for the area contained inside the wall of the capillary. For example, one can use a microscope like the Digital Microscope KH-7700 from Hirox Company, Ltd 2-15-17 Koenji Minami, Suginami-ku, Tokyo 155-0003, Japan. This microscope is supplied with a proprietary software used to analyze the digital imaged recorded. More precisely, one can use the length and area measurement methodologies for the indicated microscope as described in Chapter 3, pages 117 to 132 of the Operation manual 1st Edition with a revision date of October 2006, to calculate the perimeter or the cross section area of the capillary shape. From those measurements the hydraulic radius $R_H$ and the hydraulic diameter $D_H$ can be computed using the indicated formulas of $R_H$=CA/CP and $D_H$=4 $R_H$.

Experiment and Results

Nonwoven fabrics were prepared on a meltspun line designed by Reifenhauser Reicofil GmbH & Co. KG of Troisdorf, Germany, in which the typical Reicofil 4 meltspun beam was modified to use a multi-zone spinneret of a type such as illustrated in FIG. 3 having the indicated four different types of capillary zones as shown and described herein. As referenced for this example, zone A is similar to zones 321 and 322 shown in FIG. 3, zone B is similar to zones 341 and 342 in FIG. 3, zone C is similar to zones 331 and 332 in FIG. 3, and zone D is similar to zone 311 in FIG. 3. The multi-zone spinneret used in these experiments contained a spinneret body at the face of which the orifices had capillaries with circular cross-sectional shapes and different length and hydraulic diameter dimensions in different zones thereof. FIGS. 4A-B and 5A-C show additional capillary features used in the spinneret body of the spinneret. For comparison, nonwoven fabrics were made on the same line using a spinneret having only one dimensional type of capillaries.

For the comparison spinneret, the Reicofil 4 meltspun beam was provided with spinnerets that comprise only one dimensional type of capillaries and that were uniformly spaced and had similar exit diameter as well as similar length, wherein a 3.5 meter wide spinneret contained 22,454 total capillaries having an exit geometry that is circular at a hydraulic diameter of 0.6 mm (6349 square mm open area) and had a length (L) of 2.7 mm, and these capillaries had a length to hydraulic diameter ratio of 4.5 and a capillarity density of 6800 capillaries per linear meter width of the face of the spinneret body and 3.37 capillaries per centimeter squared. The capillaries having these dimensions are also referred to herein as zone A capillaries. It is noted that since circular cross-sectional shaped capillaries were used for all the capillaries in all the zones of the spinneret of these examples that the indicated capillary hydraulic diameter values for these examples also are equivalent to the diameter values for these examples, and the indicated length to hydraulic diameter ratio values for these examples also are equivalent to the length to diameter ratio values for these examples.

For the multi-zone spinneret, and with reference made to FIGS. 3-5 herein, a 3.5 meter wide spinneret had two zones A one of which is located at each end of the spinneret that comprise the capillaries that have a hydraulic diameter of 0.6 mm and a length of 2.7 mm for a length to hydraulic diameter ratio value of 4.5, at a density of about 3.37 capillaries per centimeter squared for these zones. Each zone A had 325 total capillaries. The spinneret body and zones A were tapered down away from the zones B, C, and D, such as shown in FIG. 3. The width (e.g., in direction ω shown in FIG. 3) of each of the zones A was about 75 mm. The front-to-back length (e.g., in direction α shown in FIG. 3) of each zone A was approximately about 68-70 mm. Tapered zone A had corner regions such as indicated by edge area 5A in FIGS. 3 and 5A, which had the following dimensions with reference to the element numbering used in FIG. 5A: 501=10.4 mm, 502=5.2 mm, 503=2.85 mm, and 504=5.7 mm. The remaining zones B, C, and D had the same density of capillaries, which was about 8000 capillaries per meter width of the spinneret body (about 4.13 capillaries per square centimeter). The zones B, C and D differed from each other in the exit hydraulic diameters of the capillaries and their lengths. Both of these capillary hydraulic diameter and length dimensions became progressively smaller moving from the outer zones B towards the center of the spinneret body first to the middle zones C and then to the central zone D. The two zones B were the zones located toward the outside of the spinneret body between zones A and were the first ones affected, along with adjacent outer portions of zones A, by the incoming quench air fed below the spinneret body from opposite cross-flowing directions, such as in the manner shown in FIG. 3. Each of these zones B contained 8007 capillaries arranged in 21 longitudinal rows (as counted in the zone in the α direction shown in FIG. 3). The total number of capillaries of both zones B is 16,014. In these zones B, the capillaries had a length of 2.2 mm and an exit hydraulic diameter of 0.55 mm for a length to hydraulic diameter ratio of 4. Zones C were adjacent to and between the zones B. Each of the zones C contained 3815 capillaries arranged in about 10 longitudinal rows of capillaries (as counted in the zone in the α direction shown in FIG. 3). The total number of capillaries is both zones C is 7,630. The zone C capillaries had a length of 1.73 mm and an exit hydraulic diameter of 0.5 mm for a length to hydraulic diameter ratio of 3.46. The central zone D was located in the middle of the spinneret adjacent to and between the two zones C. The capillaries for zone D had a 1.4 mm length and hydraulic diameter of 0.45 mm for a length to hydraulic diameter ratio of 3.12. There were 9 rows of capillaries provided in zone D (as counted in the zone in the α direction shown in FIG. 3), and it had 3434 total capillaries. The width (e.g., in direction ω shown in FIG. 3) of the zones B, C, and D was about 3.35 m. The front-to-back length (e.g., in direction α shown in FIG. 3) of each zone B was about 56 mm, the front-to-back length of each zone C was about 27 mm, and the front-to-back length of zone D was about 25 mm. The total front-to-back length of the spinneret body was about 192.5 mm for the multi-zone spinneret and the comparison spinneret. Further, zone B had a central rectangular shaped region having capillaries arranged in the manner such as illustrated by edge area 5B in FIGS. 3 and 5B, which had the following dimensions with reference to the element numbering used in FIG. 5B: 505=8.8 mm, 506=4.4 mm, 507=8.25 mm, 508=5.5 mm, and 509=2.75 mm. Furthermore, zone B also had corner regions with rows of capillaries that tapered down towards and in similar angles as the rows of capillaries in adjacent zones A such as illustrated by edge area 5C in FIGS. 3 and 5C, which had the following dimensions with reference to the element numbering used in FIG. 5C: 510=6 mm, 511=8.8 mm, 512=4.4 mm, 513=5.2 mm, and 514=10.4 mm. The pitch dimensions indicated for dimensions 508 and 509 of edge area 5B in the α direction of the spinneret body were also used for the pitch dimensions in the same direction for the capillaries of zones B and A in edge area 5C. Based on these dimensions, the length to hydraulic diameter ratio for the capillaries of zone A was about 4.5, about 4 for zone B, about 3.46 for zone C, and about 3.12 for zone D. Hydraulic diameters thereof trended similarly for the circular shaped capillaries used in these zones. The comparison spinneret had a similar outer perimeter profile and polygonal shape and size as the multi-zone spinneret, but differed with respect to the zones of capillaries formed therein as indicated.

The following explain how the length of the capillaries of different selected hydraulic diameters were arrived at for this example of the inventive spinneret.

First, rheological curves were developed or obtained from the resin supplier for the resin of interest at the melt temperature at which the resin is expected to be processed. Typically, those curves are obtained by measuring the pressure at different flow rates for a capillary of known length and diameter as described in test method ISO 11443.

For this specific example rheological curves were obtained for polypropylene resin Isplen® 089Y1E, a 30 MFR isotactic homopolymer polypropylene sold by Repsol Quimica S. A. Madrid, Spain at melt temperature of 230° C. Those curves provided shear viscosities (SV) over a range of shear rates (SR). Those curves can be used to calculated the shear stress ($T_W$) for a given polymer at a given temperature as per the expression $T_W$=SR*SV.

Those data were plotted as Log (SR) vs. Log ($T_W$). For that resin at 230° C., the best fitted curve could be expressed as per the following equation:

$$\mathrm{Log}(T_W)=2.092+1.367*\log(\mathrm{SR})-0.1573*\log(\mathrm{SR})^2$$

where $T_W$ is expressed in Pascals and SR is in $s^{-1}$.

Next, the characteristics of a capillary B of the inventive spinneret were selected: A hydraulic diameter $D_{Hb}$ of 0.55 mm (this is a circular capillary so the hydraulic diameter is the same as the actual diameter) with a capillary length $L_b$ equal to 2.2 mm for a $L_b/D_{Hb}$ ratio of 4.0. A throughput per capillary of 0.5 gcm was selected as it is within a typical range of throughputs at which the spinneret was expected to operate. This throughput of 0.5 gcm could be converted into a volumetric flow (Q) of 0.01126 $cm^3$/sec assuming a density for molten polypropylene that is 0.74 g/$cm^3$ and using the following expression:

$$Q=\text{throughput per orifice in gcm}/(60*\text{density of the molten polymer in g/cm}^3).$$

For the circular capillary B having a hydraulic diameter of 0.55 mm and for a volumetric flow of polymer Qb of 0.01126 cm3/sec, the shear rate (SRb) for that polymer at 230° C. was calculated based on the following power law equation used for non-Newtonian fluid:

$$SR_b=((3n+1)/n)*(Q_b/(3.1416*(D_{Hb}/2)^3)=778\ sec^{-1}$$

where: n is 0.35, the power law constant for polypropylene (Page 46, Giles, Harold F., "Extrusion: the definitive processing guide and handbook", William Andrew Inc., 2005 ISBN: 0-8155-1473-5), $D_{Hb}$ is the radius for the capillary B, and $Q_b$ is the mass flow rate in $cm^3$/sec.

Using this value of $SR_b$ and the results from the rheological curve for this polymer at 230° C., a shear stress $T_{Wb}$ of 53603 Pascals was obtained.

The diameters for the other capillaries A, C and D were selected as 0.6, 0.5 and 0.45 mm respectively. The shear rates (SR) were calculated for those capillaries using the following expression and assuming a constant throughput per capillary of 0.5 gcm:

$$SRx=((3n+1)/n)*(Qx/(3.1416*(D_{Hx}/2)^3).$$

Knowing the shear rate (SR) for each capillary diameter, the shear stress ($T_W$) was calculated based on the results of the rheological curve and is reported in Table 1. Using the calculated shear stress ($T_W$) for this polymer processed at 230° C. for each capillary diameter and, assuming that the pressure drop during operation is the same for all the capillaries of a given spinneret, the following expressions could be resolved for the capillary length $L_a$, $L_c$, and $L_d$ that would produce the same theoretical throughput:

$$L_a=(T_{Wb}*2.2\ mm*0.6\ mm)/(T_{Wa}*0.55\ mm)=2.69$$

$$L_c=T_{Wb}*2.2\ mm*0.5\ mm)/(T_{Wc}*0.55\ mm)=1.78$$

$$L_d=T_{Wb}*2.2\ mm*0.45\ mm)/(T_{Wd}*0.55\ mm)=1.43.$$

The resolution of those equations is based on the shear stress equation for a non-newtonian fluid flowing through a circular capillary at a given throughput and polymer viscosity: $T_W=\Delta P*D_H/(4*L)$ where $T_W$ is the shear stress of a fluid flowing through a capillary having a hydraulic diameter $D_H$ and a length L and, where the pressure drop is ΔP. ΔP is assumed constant across all the capillaries going through the spinneret body, therefore knowing the shear stress, length and hydraulic diameter for a capillary allows the calculation of the lengths of capillaries having different diameter and for which the shear stress has been estimated.

The actual lengths of the capillary A, B, C and D for the manufactured spinneret were respectively about 2.7, 2.2, 1.73 and 1.4 mm.

TABLE 1

| Capillary diameter (mm) | Shear Rate ($sec^{-1}$) | Shear Stress (Pascals) | Optimum L/D |
|---|---|---|---|
| 0.6 | 778 | 53603 | 2.69 |
| 0.55 | 1010 | 60123 | 2.20 |
| 0.5 | 1344 | 67454 | 1.78 |
| 0.45 | 1843 | 75613 | 1.43 |

Using the same approach in reverse, the theoretical throughputs were calculated for the actual dimension of the capillaries A, B, C, and D operated with the same polymer and temperature and, the largest difference among the capillaries was about 9%

The spinneret having a multi-zone capillary design at the face of the spinneret body of an embodiment of the present invention was manufactured having the indicated capillary dimensions and used to evaluate its spinning, processing conditions and resulting nonwoven fabric properties. These trials were performed using a single beam from an SSS/RF4 commercial line suitable for light basis weight products. Those trials were performed using an isotactic polypropylene resin having a nominal viscosity of 30 MFR and sold under the name Isplen® 089Y1 by Rep sol Quimica S. A. Madrid, Spain. Some of the samples were run with and without the addition of a baseline of $TiO_2$ pigment. The multi-zone spinneret (i.e., having about 8000 capillaries per meter in the indicated zones A, B, C, and D) was installed on the line in the same manner as the comparison spinneret (i.e., having 6800 single dimension capillaries per meter).

The melt spinning system generally had the configuration shown in FIG. 8. The system included an extruder that delivered molten polymer to a spin pump (melt pump), which pump was set to deliver the molten polymer to the die cavity and spinneret under positive pressure. The extruder temperature profile was set to provide a polymer temperature at the gear pump of about 225° C. and a melt temperature measured at the spinneret body of about 254° C. The extruder screw speed was set to a value adequate to provide a continuous supply of the polymer to the melt pump at an about constant pressure. The spinneret body was supported by an asymmetric breaker plate and the filter(s) within the spinneret. For Examples 1 to 5, a spin pump setting of about 46 rpm was used to provide the throughputs of the multi-zone and comparison spinnerets indicated herein. For example 6, the spin pump setting was 53.4 rpm in order to deliver a higher throughput. After exiting the spinneret, the molten polymer filaments were quenched by a cross-flow air quench system, such as illustrated with reference to various figures herein, then pulled away from the spinneret and attenuated (drawn) by high speed air. The line used had a dual quench air system characteristic of the R4 line design. For those lines, there are two quench zones per side that are disposed relative to each other in a vertical manner. For those experiments, the flow and temperature of the air was adjusted to produce a stable process. The quenched and attenuated fibers were deposited on a moving porous web to form a mat of nonwoven web. Line speeds were selected to produce the desired basis weight at the throughput uses.

Examples 1 and 2

While operating the system as similarly shown in FIG. 8 and fitted with the multi-zone inventive spinneret, samples of spunbond were produced at a calculated polymer throughput of 0.43 grams per capillary per minute (gcm) or a total throughput of about 716 Kilograms per hour (Kg/h), using a cooling chamber pressure of 3600 Pascals, and a ratio of quench air volumes of about 1:2 between the upper and lower gas quench zones with air temperatures that are reported in Table 1. The line speed was adjusted to produce a basis weight of about 12 grams per square meter (gsm), and the calendar was set at a pressure of 89 decaNewtons per centimeter (daN/cm) with an embossed roll temperature set at 166 degrees Celsius, and the smooth roll temperature set at 164 degrees Celsius. The pigment concentration in percent (%) used in the formulation fed to the extruder in all the examples and comparative example was controlled by blender setting to be approximately 0.4 to 0.5 wt % except for Example 1 which had none added. Additional process conditions as well as test results can be found in Table 2.

TABLE 2

Process Conditions and Test Results for Examples 1 to 6

| | Units | Ex. 1 | Ex. 2 | Comp. Ex. 3 | Ex. 4 | Ex. 5 | Ex. 6 |
|---|---|---|---|---|---|---|---|
| Spinneret (1) | | M-Z | M-Z | Standard | M-Z | M-Z | M-Z |
| Total throughput | Kg/h | 716 | 717 | 717 | 717 | 717 | 832 |
| Average Throughput per capillary | gcm (2) | 0.43 | 0.43 | 0.525 | 0.43 | 0.43 | 0.5 |
| Cooling Chamber pressure | Pascals | 3597 | 3593 | 3606 | 5000 | 5005 | 3597 |
| QA Ratio (3) | | 2.0 | 2.15 | 5.6 | 2.0 | 2.0 | 1.95 |
| QA temp. U/L (4) | ° C. | 21.5/20 | 20/15.5 | 24.5/17.0 | 22.5/17.5 | 23/17 | 22/17 |
| Line speed | m/min | 290 | 290 | 290 | 290 | 290 | 150 |
| Basis weight | gsm | 11.9 | 12.3 | 12.1 | 11.9 | 12.2 | 27.1 |
| average denier | Dpf | 1.31 | 1.4 | 1.54 | 1.14 | 1.26 | 1.36 |
| denier variability | St. Dev. (5) | 0.24 | 0.34 | 0.32 | 0.26 | 0.35 | 0.28 |

(1) M-Z describes the multi-zone spinneret of this invention and standard is the comparative spinneret (2) gcm stands for gram of polymer per capillary per minute (3) QA ratio is the ratio between the volume of quench air fed through the lower quench air ducts and the air fed through the upper quench air ducts (4) temperature of the air fed to the upper quench air ducts/temperature of the air fed to the lower quench air ducts (5) Standard deviation for the denier measurement

Comparative Example 3

Using a comparative "single zone" (i.e., one zone of single dimensional capillaries) spinneret with uniformly dimensioned capillaries at a density of about 6800 capillaries per meter width of the face of the spinneret body with each capillary having a hydraulic diameter of 0.6 mm and a capillary length of 2.7 mm), a sample was prepared using a calculated average throughput of 0.525 gcm or a total throughput of about 717 Kg/h, a cooling chamber pressure chamber of 3600 Pascals, and a ratio of air volume of about 1:5.5 between the upper and lower quench zone with air temperatures that are reported in Table 1. Additional process conditions as well as test results can be found in Table 2. The calender was set-up the same as used for Examples 1 and 2.

Examples 4 and 5

Examples 4 and 5 were produced the same way as Examples 1 and 2 with the exception of the cooling chamber pressure which was raised to 5000 Pascals. The ratio of quench air volume was set at about 1:2. The calender was set-up the same as for Examples 1 and 2. Those samples were produced to demonstrate the ability of the multi-zone spinneret to produce nonwoven filaments for use in nonwoven fabrics at the same process stability and with at least no reduction in the denier variability.

Example 6

Example 6 was also run using the multi-zone inventive spinneret, however the calculated average throughput was raised to 0.5 gcm or total throughput of about 832 Kg/h and, the line speed was adjusted to produce a basis weight of 27 gsm. The ratio of quench air volumes was set at about 1:2 between the upper and lower quench zones. For this example, the calender set up was the same as for Examples 1 and 2. This Example was made to illustrate the ability of the inventive spinneret to provide a stable spinning process at higher throughput with no or little reduction in the average fiber denier or its variability.

Results:

With a few minor process adjustments the spinning stability for Examples 1 and 2 made at 716 Kg/h as well as Example 6 made at 832 Kg/h while using the inventive multi-zone spinneret at a cooling chamber pressure of 3600 Pascals was observed to be comparable to the spinning stability observed for Example 3 using the comparison RF4/6,800 capillary per meter spinneret body at a throughput of 716 Kg/h and the same cooling chamber pressure and while using the same indicated polypropylene resin. No polymer drips or hard spots were observed for Examples 1, 2 and 6. The cooling chamber pressure of 3600 Pascals was selected because this is near the maximum cooling chamber pressure at which a very stable process can be obtained with the standard spinneret body and the indicated polypropylene resin. It was also observed that the average denier of the filaments from Examples 1 and 2 were lower than the denier measured for the comparative Example 3. Denier variability was also comparable or better for Examples 1 and 2 than for Example 3. The results can be found in Table 2.

Spinning stability of Examples 4 and 5 made using a cooling chamber pressure of 5000 Pascals with the inventive spinneret at throughput of 716 Kg/h was also comparable to spinning stability observed for the comparative Example 3 produced at a cooling chamber pressure of 3600 Pascals. No polymer drips or hard spots were observed for those Examples. As a result of using the higher cooling chamber pressure, average denier was significantly reduced with an improved or about equal denier variability. The results can be found in Table 2.

Air permeability, strength, and elongation properties of the nonwoven webs made in Examples 1-6 were determined and found to be commercially suitable.

Overall nonwoven fabric appearance was found to be improved with the spinneret containing the spinneret body having the multi-zone capillary design as compared to the comparison spinneret body. The improvement was more noticeable at 5000 Pascals cooling chamber pressure.

In summary, the experimental test results showed that the indicated multi-zone spinneret body design of the present invention can maximize filament uniformity without compromising spinning quality. The 8000 capillaries per meter containing spinneret body of the multi-zone spinneret design of the present invention had approximately 10% less flow area as compared to the indicated 6800 capillary per meter containing spinneret body in the comparison spinneret (6022 $mm^2$). This created slightly higher initial operational pressure. However, the back pressure combined with the differential capillary hydraulic diameter per zone, helped to compensate for polymer speed differences at spinning in complement to the asymmetric breaker plate used in the spinneret. The indicated four different capillary configurations with differential length to hydraulic diameter ratios in the indicated spinneret body of the multi-zone spinneret were used to help compensate for non-uniform filament quenching speed and are believed to have helped avoid sections with frost line sag and non-uniformity. The designation of number of capillaries per row and number of rows per zone was determined by maintaining the same resulting polymer flow open area. Pitch between capillaries was maintained constant across the high capillary density zone.

As additional observations made during the trials, while the density of the capillaries in the multi-zone spinneret is close to 20% higher than the comparison spinneret, the spinning of filaments was observed to be comparable to the comparison spinneret in terms of nonwoven fabric hard spots. These results for the high capillary density zone showed improved formation with lower filament deniers and higher polymer throughputs. A multi-zone spinneret design of the present invention with the different zones of capillaries enabled a spinning quality comparable to the comparison spinneret and this featured enabled the increase of cooling chamber pressure up to 5000 Pascals. Using progressively increasing length to hydraulic diameter ratios in various zones of the spinneret body of the multi-zone spinneret to compensate for filament quenching inefficiency made a significant impact that enabled use of different hydraulic diameters adjacent to each other without impacting performance.

Unless indicated otherwise, all amounts, percentages, ratios and the like used herein are by weight. When an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

Although the invention herein has been described with reference to particular embodiments, it is to be understood that these embodiments are merely illustrative of the principles and applications of the present invention. It will be apparent to those skilled in the art that various modifications and variations can be made to the method and apparatus of the present invention without departing from the spirit and scope of the invention. Thus, it is intended that the present invention include modifications and variations that are within the scope of the appended claims and their equivalents.

What is claimed is:

1. A spinneret for melt-spinning polymeric filaments, comprising:

a spinneret body configured to provide a uniform filament denier in dual-quench melt-spinning operations; wherein the spinneret body has a non-circular periphery and an overall length to hydraulic diameter ratio and defining orifices extending through the spinneret body, wherein the orifices comprise capillaries that open at a face of the spinneret body for polymer filament extrusion therefrom, wherein the capillaries are arranged in a plurality of different rows at the face of the spinneret body, and wherein the plurality of different rows are arranged into a plurality of different zones at the face of the spinneret body, wherein the plurality of different zones comprises:

a first zone located centrally at the face of the spinneret body, comprising a plurality of first rows, each of said first rows comprising a plurality of first capillaries, wherein the first capillaries are arranged in a first capillary density, and the first capillaries individually having a first cross-sectional shape, a first hydraulic diameter, a first length, and a first length to hydraulic diameter ratio, a second zone located adjacent to the first zone at the face of the spinneret body, comprising a plurality of second rows, each of said second rows comprising a plurality of second capillaries, wherein the second capillaries are arranged in a second capillary density, and the second capillaries individually having a second cross-sectional shape, a second hydraulic diameter, a second length, and a second length to hydraulic diameter ratio, a third zone located adjacent to the first zone at the face of the spinneret body, comprising a plurality of third rows, each of said third rows comprising a plurality of third capillaries, wherein the third capillaries are arranged in a third capillary density, and the third capillaries individually having a third cross-sectional shape, a third hydraulic diameter, a third length, and a third length to hydraulic diameter ratio;

wherein the first zone is located between the second and third zones, and the first zone is closer to a center of the face of the spinneret body than the second and third zones, and wherein the overall length to hydraulic diameter ratio is at least 3 percent;

wherein at least one of (i) the first hydraulic diameter of each of the first capillaries is less than the second hydraulic diameter of each of the second capillaries, and the first hydraulic diameter of each of the first capillaries is less than the third hydraulic diameter of each of the third capillaries; and (ii) the first length of each of the first capillaries is less than the second length of each of the second capillaries, and the first length of each of the first capillaries is less than the third length of each of the third capillaries.

2. The spinneret of claim 1, wherein the first cross-sectional shape of each of the first capillaries and the second cross-sectional shape of each of the second capillaries and the third cross-sectional shape of each of the third capillaries are the same.

3. The spinneret of claim 2, wherein the first cross-sectional shape of each of the first capillaries and the second cross-sectional shape of each of the second capillaries and the third cross-sectional shape of each of the third capillaries are circular or oval.

4. The spinneret of claim 1, wherein the first length to hydraulic diameter ratio of each of the first capillaries is less than the second length to hydraulic diameter ratio of each of the second capillaries, and the first length to hydraulic diameter ratio of each of the first capillaries is less than the third length to hydraulic diameter ratio of each of the third capillaries.

5. The spinneret of claim 4, wherein the second length to hydraulic diameter ratio of each of the second capillaries and the third length to hydraulic diameter ratio of each of the third capillaries are the same.

6. The spinneret of claim 1, wherein said spinneret body has a plurality of zone-to-zone length to hydraulic diameter ratios, and wherein at least one of said zone-to-zone length to hydraulic diameter ratios is at least 2%.

7. The spinneret of claim 1, wherein the first capillary density is greater than each of the second capillary density and the third capillary density.

8. The spinneret of claim 1, further comprising:

a fourth zone comprising a plurality of fourth rows, each of said fourth rows comprising a plurality of fourth capillaries, wherein the fourth capillaries are arranged in a fourth capillary density, and the fourth capillaries individually having a fourth cross-sectional shape, a fourth hydraulic diameter, a fourth length, and a fourth length to hydraulic diameter ratio, a fifth zone comprising a plurality of fifth rows, each of said fifth rows comprising a plurality of fifth capillaries, wherein the fifth capillaries are arranged in a fifth capillary density, and the fifth capillaries individually having a fifth cross-sectional shape, a fifth hydraulic diameter, a fifth length, and a fifth length to hydraulic diameter ratio;

wherein the first zone is located between the fourth and fifth zones, and wherein the fourth cross-sectional shape of each of the fourth capillaries and the fifth cross-sectional shape of each of the fifth capillaries are the same as the first cross-sectional shape of each of the first capillaries and the second cross-sectional shape of each of the second capillaries and the third cross-sectional shape of each of the third capillaries, wherein the fourth hydraulic diameter of each of the fourth capillaries and the fifth hydraulic diameter of each of the fifth capillaries are less than the second hydraulic diameter of each of the second capillaries and are less than the third hydraulic diameter of each of the third capillaries; and the first hydraulic diameter of each of the first capillaries is less than the fourth hydraulic diameter of each of the fourth capillaries, and the first hydraulic diameter of each of the first capillaries is less than the fifth hydraulic diameter of each of the fifth capillaries; and wherein the fourth length of each of the fourth capillaries and the fifth length of each of the fifth capillaries are less than the second length of each of the second capillaries and the third length of each of the third capillaries; and the first length of each of the first capillaries is less than the fourth length of each of the fourth capillaries, and the first length of each of the first capillaries is less than the fifth length of each of the fifth capillaries.

9. The spinneret of claim 8, wherein the first capillary density, the fourth capillary density, and the fifth capillary density are the same.

10. The spinneret of claim 8, wherein the first length to hydraulic diameter ratio of each of the first capillaries is less than the fourth length to hydraulic diameter ratio of each of the fourth capillaries, and the first length to hydraulic diameter ratio of each of the first capillaries is less than the fifth length to hydraulic diameter ratio of each of the fifth capillaries.

11. The spinneret of claim 8, further comprising:

a sixth zone comprising a plurality of sixth rows, each of said sixth rows comprising a plurality of sixth capillaries, wherein the sixth capillaries are arranged in a sixth capillary density, and the sixth capillaries individually having a sixth cross-sectional shape, a sixth hydraulic diameter, a sixth length, and a sixth length to hydraulic diameter ratio, a seventh zone comprising a plurality of seventh rows, each of said seventh rows comprising a plurality of seventh capillaries, wherein the seventh capillaries are arranged in a seventh capillary density and the seventh capillaries individually having a seventh cross-sectional shape, a seventh hydraulic diameter, a seventh length, and a seventh length to hydraulic diameter ratio;

wherein the first, fourth, and fifth zones are located between the sixth and seventh zones, and wherein the sixth cross-sectional shape of each of the sixth capillaries and the seventh cross-sectional shape of each of the seventh capillaries are the same as the first cross-sectional shape of each of the first capillaries, the second cross-sectional shape of each of the second capillaries, the third cross-sectional shape of each of the third capillaries, the fourth cross-sectional shape of each of the fourth capillaries, and the fifth cross-sectional shape of each of the fifth capillaries;

wherein the sixth hydraulic diameter of each of the sixth capillaries and the seventh hydraulic diameter of each of the seventh capillaries are less than the second hydraulic diameter of each of the second capillaries and the third hydraulic diameter of each of the third capillaries, and the fourth hydraulic diameter of each of the fourth capillaries and the fifth hydraulic diameter of each of the fifth capillaries are less than the sixth hydraulic diameter of each of the sixth capillaries and less than the seventh hydraulic diameter of each of the seventh capillaries; and wherein the sixth length of each of the sixth capillaries and the seventh length of each of the seventh capillaries are less than the second length of each of the second capillaries and the third length of each of the third capillaries, and the fourth length of each of the fourth capillaries and the fifth length of each of the fifth capillaries are less than the sixth length of each of the sixth capillaries and are less than the seventh length of each of the seventh capillaries.

12. The spinneret of claim 11, wherein the first capillary density, the fourth capillary density, the fifth capillary density, the sixth capillary density, and the seventh capillary density are the same.

13. The spinneret of claim 11, wherein the fourth length to hydraulic diameter ratio of each of the fourth capillaries and the fifth length to hydraulic diameter ratio of each of the fifth capillaries are less than the sixth length to hydraulic diameter ratio of each of the sixth capillaries and the seventh length to hydraulic diameter ratio of each of the seventh capillaries.

14. The spinneret of claim 1, wherein the spinneret body has an overall length to hydraulic diameter ratio of at least 5%.

15. The spinneret of claim 1, wherein a sum of the capillaries that open at a face of the spinneret body is at least 3000.

16. The spinneret of claim 1, wherein the face of the spinneret body is polygonal.

17. A spinneret for melt-spinning polymeric filaments, comprising:

a spinneret body configured to provide a uniform filament denier in dual-quench melt-spinning operations; wherein the spinneret body has a non-circular periphery and defines orifices extending through the spinneret body, wherein the orifices comprise capillaries that open at a face of the spinneret body for polymer filament extrusion therefrom, wherein the capillaries are arranged in a plurality of different rows at the face of the spinneret body, and wherein the plurality of different rows are arranged into a plurality of different zones at the face of the spinneret body, wherein the plurality of different zones comprises:

a first zone located centrally at the face of the spinneret body, comprising a plurality of first rows, each of said first rows comprising a plurality of first capillaries, wherein the first capillaries are arranged in a first capillary density, and the first capillaries individually having a first cross-sectional shape, a first hydraulic diameter, a first length, and a first length to hydraulic diameter ratio, a second zone located adjacent to the first zone at the face of the spinneret body, comprising a plurality of second rows, each of said second rows comprising a plurality of second capillaries, wherein the second capillaries are arranged in a second capillary density, and the second capillaries individually having a second cross-sectional shape, a second hydraulic diameter, a second length, and a second length to hydraulic diameter ratio, a third zone located adjacent to the first zone at the face of the spinneret body, comprising a plurality of third rows, each of said third rows comprising a plurality of third capillaries, wherein the third capillaries are arranged in a third capillary density, and the third capillaries individually having a third cross-sectional shape, a third hydraulic diameter, a third length, and a third length to hydraulic diameter ratio;

wherein the first zone is located between the second and third zones, and the first zone is closer to a center of the face of the spinneret body than the second and third zones;

wherein the first cross-sectional shape of each of the first capillaries and the second cross-sectional shape of each of the second capillaries and the third cross-sectional shape of each of the third capillaries are the same;

wherein the second hydraulic diameters of each of the second capillaries are identical, and the third hydraulic diameters of each of the third capillaries are identical;

wherein the first hydraulic diameter of each of the first capillaries is less than the second hydraulic diameter of each of the second capillaries, and the first hydraulic diameter of each of the first capillaries is less than the third hydraulic diameter of each of the third capillaries; and the first length of each of the first capillaries is less than the second length of each of the second capillaries, and the first length of each of the first capillaries is less than the third length of each of the third capillaries;

wherein the first length to hydraulic diameter ratio of each of the first capillaries is less than the second length to hydraulic diameter ratio of each of the second capillaries, and the first length to hydraulic diameter ratio of each of the first capillaries is less than the third length to hydraulic diameter ratio of each of the third capillaries, and wherein an overall length to hydraulic diameter ratio of the spinneret body is at least 3 percent.

18. The spinneret of claim 17, wherein the face of the spinneret body is polygonal.

19. The spinneret of claim 18, wherein the face of the spinneret body is rectangular.

20. A spinneret for melt-spinning polymeric filaments, comprising:

a spinneret body has a non-circular periphery and is configured to provide a uniform filament denier in single-side cross-flow quench melt-spinning operations, having the spinneret body has an overall length to hydraulic diameter ratio and defining orifices extending through the spinneret body, wherein the orifices comprise capillaries that open at a face of the spinneret body for polymer filament extrusion therefrom, wherein the capillaries are arranged in a plurality of different rows at the face of the spinneret body, and wherein the plurality of different rows are arranged into a plurality of different zones at the face of the spinneret body, wherein the plurality of different zones comprises:

a first zone located centrally at the face of the spinneret body, comprising a plurality of first rows, each of said first rows comprising a plurality of first capillaries, wherein the first capillaries are arranged in a first capillary density, and the first capillaries individually having a first cross-sectional shape, a first hydraulic diameter, a first length, and a first length to hydraulic diameter ratio, a second zone located adjacent to the first zone at the face of the spinneret body, comprising a plurality of second rows, each of said second rows comprising a plurality of second capillaries, wherein the second capillaries are arranged in a second capillary density, and the second capillaries individually having a second hydraulic diameter, a second cross-sectional shape, a second length, and a second length to hydraulic diameter ratio, a third zone located adjacent to the first zone at the face of the spinneret body, comprising a plurality of third rows, each of said third rows comprising a plurality of third capillaries, wherein the third capillaries are arranged in a third capillary density and the third capillaries individually having a third cross-sectional shape, a third hydraulic diameter, a third length, and a third length to hydraulic diameter ratio, wherein the first zone is located between the second and third zones, wherein the third hydraulic diameter of each of the third capillaries is less than the first hydraulic diameter of each of the first capillaries, wherein the first hydraulic diameter of each of the first capillaries is less than the second hydraulic diameter of each of the second capillaries, wherein the third length of each of the third capillaries is less than the first length of each of the first capillaries, wherein the first length of each of the first capillaries is less than the second length of each of the second capillaries, wherein the third length to hydraulic diameter ratio of each of the third capillaries is less than the first length to hydraulic diameter ratio of each of the first capillaries, and the first length to hydraulic diameter ratio of each of the first capillaries is less than the second length to hydraulic diameter ratio of each of the second capillaries, and wherein the overall length to hydraulic diameter ratio is at least 3 percent.

21. The spinneret of claim 20, wherein the spinneret body has a plurality of zone-to-zone length to hydraulic diameter ratios, and wherein at least one of said zone-to-zone length to hydraulic diameter ratios is at least 2%.

22. The spinneret of claim 20, wherein the first capillary density, the second capillary density, and the third capillary density are the same.

23. An apparatus for producing a meltspun nonwoven web, comprising: a polymer supply system;

a filament collection surface;

a spinneret located above the collection surface for extruding molten polymer received from the polymer supply system for producing extruded filaments that move downward along a path toward the collection surface;

at least one quench gas supply device for supplying at least one stream of cooling gas; and a cooling region below the spinneret in which the at least one stream of the cooling gas is directed to flow beneath the spinneret and across extruded filaments along a path toward the collection surface, wherein the spinneret comprises:

a spinneret body configured to provide a uniform filament denier in dual-quench melt-spinning operations; wherein the spinneret body; wherein the spinneret body has a non-circular periphery and an overall length to hydraulic diameter ratio and defining orifices extending through the spinneret body, wherein the orifices comprise capillaries that open at a face of the spinneret body for polymer filament extrusion therefrom, wherein the capillaries are arranged in a plurality of different rows at the face of the spinneret body, and wherein the plurality of different rows are arranged into a plurality of different zones at the face of the spinneret body, wherein the plurality of different zones comprises:

a first zone located centrally at the face of the spinneret body, comprising a plurality of first rows, each of said first rows comprising a plurality of first capillaries, wherein the first capillaries are arranged in a first capillary density, and the first capillaries individually having a first cross-sectional shape, a first hydraulic diameter, a first length, and a first length to hydraulic diameter ratio, a second zone located adjacent to the first zone at the face of the spinneret body, comprising a plurality of second rows, each of said second rows comprising a plurality of second capillaries, wherein the second capillaries are arranged in a second capillary density, and the second capillaries individually having a second cross-sectional shape, a second hydraulic diameter, a second length, and a second length to hydraulic diameter ratio, a third zone located adjacent to the first zone at the face of the spinneret body, comprising a plurality of third rows, each of said third rows comprising a plurality of third capillaries, wherein the third capillaries are arranged in a third capillary density, and the third capillaries individually having a third cross-sectional shape, a third hydraulic diameter, a third length, and a third length to hydraulic diameter ratio;

wherein the first zone is located between the second and third zones, and the first zone is closer to a center of the face of the spinneret body than the second and third zones, and wherein the overall length to hydraulic diameter ratio is at least 3 percent;

wherein at least one of (i) the first hydraulic diameter of each of the first capillaries is less than the second hydraulic diameter of each of the second capillaries, and the first hydraulic diameter of each of the first capillaries is less than the third hydraulic diameter of each of the third capillaries; and (ii) the first length of each of the first capillaries is less than the second length of each of the second capillaries, and the first length of each of the first capillaries is less than the third length of each of the third capillaries; and wherein the at least one quench gas supply device is configured to (i) supply a first stream of cooling gas that flows initially beneath the second zone and (2) supply a second stream of cooling gas that flows initially beneath the third zone.

24. The apparatus of claim 23, wherein the first cross-sectional shape of each of the first capillaries and the second cross-sectional shape of each of the second capillaries and the third cross-sectional shape of each of the third capillaries are the same.

25. The apparatus of claim 23, wherein the first length to hydraulic diameter ratio of each of the first capillaries is less than the second length to hydraulic diameter ratio of each of the second capillaries, and the first length to hydraulic diameter ratio of each of the first capillaries is less than the third length to hydraulic diameter ratio of each of the third capillaries.

26. The apparatus of claim 25, wherein the second length to hydraulic diameter ratio of each of the second capillaries and the third length to hydraulic diameter ratio of each of the third capillaries are the same.

27. The apparatus of claim 26, wherein the first cross-sectional shape of each of the first capillaries and the second cross-sectional shape of each of the second capillaries and the third cross-sectional shape of each of the third capillaries are circular or oval.

28. The apparatus of claim 23, wherein said spinneret body has a plurality of zone-to-zone length to hydraulic diameter ratios, and wherein at least one of said zone-to-zone length to hydraulic diameter ratios is at least 2%.

29. The apparatus of claim 23, wherein the first capillary density is greater than each of the second capillary density and the third capillary density.

30. The apparatus of claim 23, wherein the at least one quench gas supply device is operable to direct the at least one stream of the cooling gas to cross-flow from opposite directions beneath the spinneret.

31. The apparatus of claim 23, wherein the spinneret body has an overall length to hydraulic diameter ratio of at least 5%.

32. The apparatus of claim 23, wherein a sum of the capillaries that open at a face of the spinneret body is at least 3000.

33. The apparatus of claim 23, wherein the face of the spinneret body is polygonal.

34. The apparatus of claim 33, wherein the face of the spinneret body is rectangular.

35. The apparatus of claim 23, further comprising:

a fourth zone comprising a plurality of fourth rows, each of said fourth rows comprising a plurality of fourth capillaries, wherein the fourth capillaries are arranged in a fourth capillary density, and the fourth capillaries individually having a fourth cross-sectional shape, a fourth hydraulic diameter, a fourth length, and a fourth length to hydraulic diameter ratio, a fifth zone comprising a plurality of fifth rows, each of said fifth rows comprising a plurality of fifth capillaries, wherein the fifth capillaries are arranged in a fifth capillary density and the fifth capillaries individually having a fifth cross-sectional shape, a fifth hydraulic diameter, a fifth length, and a fifth length to hydraulic diameter ratio; wherein the first zone is located between the fourth and fifth zones, and wherein the fourth cross-sectional shape of each of the fourth capillaries and the fifth cross-sectional shape of each of the fifth capillaries are the same as the first cross-sectional shape of each of the first capillaries and the second cross-sectional shape of each of the second capillaries and the third cross-sectional shape of each of the third capillaries, wherein the fourth hydraulic diameter of each of the fourth capillaries and the fifth hydraulic diameter of each of the fifth capillaries are less than the second hydraulic diameter of each of the second capillaries and are less than the third hydraulic diameter of each of the third capillaries; and the first hydraulic diameter of each of the first capillaries is less than the fourth hydraulic diameter of each of the fourth capillaries, and the first hydraulic diameter of each of the first capillaries is less than the fifth hydraulic diameter of each of the fifth capillaries; and wherein the fourth length of each of the fourth capillaries and the fifth length of each of the fifth capillaries are less than the second length of each of the second capillaries and the third length of each of the third capillaries; and the first length of each of the first capillaries is less than the fourth length of each of the fourth capillaries, and the first length of each of the first capillaries is less than the fifth length of each of the fifth capillaries.

36. The apparatus of claim 35, further comprising:

a sixth zone comprising a plurality of sixth rows, each of said sixth rows comprising a plurality of sixth capillaries, wherein the sixth capillaries are arranged in a sixth capillary density, and the sixth capillaries individually having a sixth cross-sectional shape, a sixth hydraulic diameter, a sixth length, and a sixth length to hydraulic diameter ratio, a seventh zone comprising a plurality of seventh rows, each of said seventh rows comprising a plurality of seventh capillaries, wherein the seventh capillaries are arranged in a seventh capillary density and the seventh capillaries individually having a seventh cross-sectional shape, a seventh hydraulic diameter, a seventh length, and a seventh length to hydraulic diameter ratio;

wherein the first, fourth, and fifth zones are located between the sixth and seventh wherein the sixth cross-sectional shape of each of the sixth capillaries and the seventh cross-sectional shape of each of the seventh capillaries are the same as the first cross-sectional shape of each of the first capillaries, the second cross-sectional shape of each of the second capillaries, the third cross-sectional shape of each of the third capillaries, the fourth cross-sectional shape of each of the fourth capillaries, and the fifth cross-sectional shape of each of the fifth capillaries;

wherein the sixth hydraulic diameter of each of the sixth capillaries and the seventh hydraulic diameter of each of the seventh capillaries are less than the second hydraulic diameter of each of the second capillaries and the third hydraulic diameter of each of the third capillaries, and the fourth hydraulic diameter of each of the fourth capillaries and the fifth hydraulic diameter of each of the fifth capillaries are less than the sixth hydraulic diameter of each of the sixth capillaries and less than the seventh hydraulic diameter of each of the seventh capillaries; and wherein the sixth length of each of the sixth capillaries and the seventh length of each of the seventh capillaries are less than the second length of each of the second capillaries and the third length of each of the third capillaries, and the fourth length of each of the fourth capillaries and the fifth length of each of the fifth capillaries are less than the sixth length of each of the sixth capillaries and are less than the seventh length of each of the seventh capillaries.

37. The apparatus of claim 36, wherein the first capillary density, the fourth capillary density, the fifth capillary density, the sixth capillary density, and the seventh capillary density are the same.

38. The apparatus of claim 36, wherein the fourth length to hydraulic diameter ratio of each of the fourth capillaries and the fifth length to hydraulic diameter ratio of each of the fifth capillaries are less than the sixth length to hydraulic diameter ratio of each of the sixth capillaries and the seventh length to hydraulic diameter ratio of each of the seventh capillaries.

39. An apparatus for producing a meltspun nonwoven web, comprising: a polymer supply system;

a filament collection surface;

a spinneret located above the collection surface for extruding molten polymer received from the polymer supply system for producing extruded filaments that move downward along a path toward the collection surface;

at least one quench gas supply device for supplying at least one stream of cooling gas; and a cooling region below the spinneret in which the at least one stream of the cooling gas is directed to flow beneath the spinneret and across extruded filaments along the path toward the collection surface, wherein the spinneret comprises:

a spinneret body having a non-circular periphery and is configured to provide a uniform filament denier in single-side cross-flow quench melt-spinning operations, wherein the spinneret body has an overall length to hydraulic diameter ratio and defining orifices extending through the spinneret body, wherein the orifices comprise capillaries that open at a face of the spinneret body for polymer filament extrusion therefrom, wherein the capillaries are arranged in a plurality of different rows at the face of the spinneret body, and wherein the plurality of different rows are arranged into a plurality of different zones at the face of the spinneret body, wherein the plurality of different zones comprises:

a first zone located centrally at the face of the spinneret body, comprising a plurality of first rows, each of said first rows comprising a plurality of first capillaries, wherein the first capillaries are arranged in a first capillary density, and the first capillaries individually having a first cross-sectional shape, a first hydraulic diameter, a first length, and a first length to hydraulic diameter ratio, a second zone located adjacent to the first zone at the face of the spinneret body, comprising a plurality of second rows, each of said second rows comprising a plurality of second capillaries, wherein the second capillaries are arranged in a second capillary density, and the second capillaries individually having a second hydraulic diameter, a second cross-sectional shape, a second length, and a second length to hydraulic diameter ratio, a third zone located adjacent to the first zone at the face of the spinneret body, comprising a plurality of third rows, each of said third rows comprising a plurality of third capillaries, wherein the third capillaries are arranged in a third capillary density, and the third capillaries individually having a third cross-sectional shape, a third hydraulic diameter, a third length, and a third length to hydraulic diameter ratio, wherein the first zone is located between the second and third zones, wherein the third hydraulic diameter of each of the third capillaries is less than the first hydraulic diameter of each of the first capillaries, wherein the first hydraulic diameter of each of the first capillaries is less than the second hydraulic diameter of each of the second capillaries, wherein the third length of each of the third capillaries is less than the first length of each of the first capillaries, wherein the first length of each of the first capillaries is less than the second length of each of the second capillaries, wherein the third length to hydraulic diameter ratio of each of the third capillaries is less than the first length to hydraulic diameter ratio of each of the first capillaries, and the first length to hydraulic diameter ratio of each of the first capillaries is less than the second length to hydraulic diameter ratio of each of the second capillaries, wherein the overall length to hydraulic diameter ratio is at least 3 percent; and wherein the at least one quench gas supply device is configured to supply a first stream of cooling gas that flows initially beneath the second zone, then beneath the first, and then the third zone.

* * * * *